US007394348B2

(12) United States Patent
Roeske

(10) Patent No.: US 7,394,348 B2
(45) Date of Patent: Jul. 1, 2008

(54) METHOD AND SYSTEM TO CONTROL MULTIPLE TYPES OF SCOREBOARDS

(76) Inventor: Rodney E. Roeske, 2752 Gaston Ave., #1011, Dallas, TX (US) 75226

( * ) Notice: Subject to any disclaimer, the term of this patent is extended or adjusted under 35 U.S.C. 154(b) by 645 days.

(21) Appl. No.: 10/830,243

(22) Filed: Apr. 22, 2004

(65) Prior Publication Data

US 2005/0240872 A1 Oct. 27, 2005

(51) Int. Cl.
*A63B 69/00* (2006.01)
*A63B 71/06* (2006.01)
*G07C 1/24* (2006.01)

(52) U.S. Cl. ..... 340/323 R; 368/47

(58) Field of Classification Search ..... 340/323 R; 700/92; 368/10, 47
See application file for complete search history.

(56) References Cited

U.S. PATENT DOCUMENTS

| | | | | |
|---|---|---|---|---|
| 3,981,002 | A * | 9/1976 | Gardner | 340/323 R |
| 5,898,587 | A * | 4/1999 | Bell et al. | 700/92 |
| 6,980,113 | B1 * | 12/2005 | Uehran | 340/323 R |
| 7,031,225 | B2 * | 4/2006 | McDonald | 340/323 R |
| 7,037,198 | B2 * | 5/2006 | Hameen-Anttila | 340/323 R |

* cited by examiner

*Primary Examiner*—John Tweel, Jr.
(74) *Attorney, Agent, or Firm*—Ruben C. DeLeon

(57) ABSTRACT

The present disclosure provides a system and method accurately maintaining times and scoring for a sports activity.

12 Claims, 78 Drawing Sheets

TRUE TIME Application

Home Foul Handler

Home Score Edit

Visitor Score Edit

Edit Score

Edit Both Scores

Edit Both Score Dialog

Home Foul Edit

Home Foul Edit Dialog

Visitor Foul Edit

Visitor Foul Edit Dialog

Home Timeout Select Dialog

Home Timeout Select

2700

Home Full Timeout

Visitor Timeout Handler

Period Increment (Cont.)

Period Edit (Cont.)

Home Timeout Edit

Visitor Timeout Edit

All Timeout Edit Dialog (Cont.)

Violation

Ops Update

Ops Update (Cont.)

Set To 5

Official Timeout

Timeout End

Visitor Team Select

On Clock Stop Select Change

Possession Select Change

Bad Reset Select Change

Clock Callback (Cont.)

Clock Callback (Cont.)

Clock Callback (Cont.)

Edit Both Clocks Dialog (Cont.)

Custom Hardware Block

Scoreboard to Video Switcher (Linear Key)

METHOD AND SYSTEM TO CONTROL MULTIPLE TYPES OF SCOREBOARDS

BACKGROUND OF THE INVENTION

The present invention relates generally to a new and improved method and system to control multiple types of scoreboards and, more particularly, to a method and system for accurately maintaining times and scoring for a sports activity.

Currently, at least three types of controllers are used to operate scoreboards in college and professional sports. In particular, two controllers are commonly used in professional basketball arenas. Daktronic controllers are installed in at least 13 arenas, while Whiteway controllers are also installed in 13 arenas.

Therefore, what is needed, is a system and method that provides an improved method and system to control multiple types of scoreboards.

SUMMARY OF THE INVENTION

The present disclosure provides a system and method that provides an improved method and system to control multiple types of scoreboards.

Therefore, in accordance with the previous summary, objects, features and advantages of the present disclosure will become apparent to one skilled in the art from the subsequent description and the appended claims taken in conjunction with the accompanying drawings.

DETAILED DESCRIPTION OF THE PREFERRED EMBODIMENTS

The present disclosure can be described by the embodiments given below. It is understood, however, that the embodiments below are not necessarily limitations to the present disclosure, but are used to describe a typical implementation of the invention.

Figure 1:
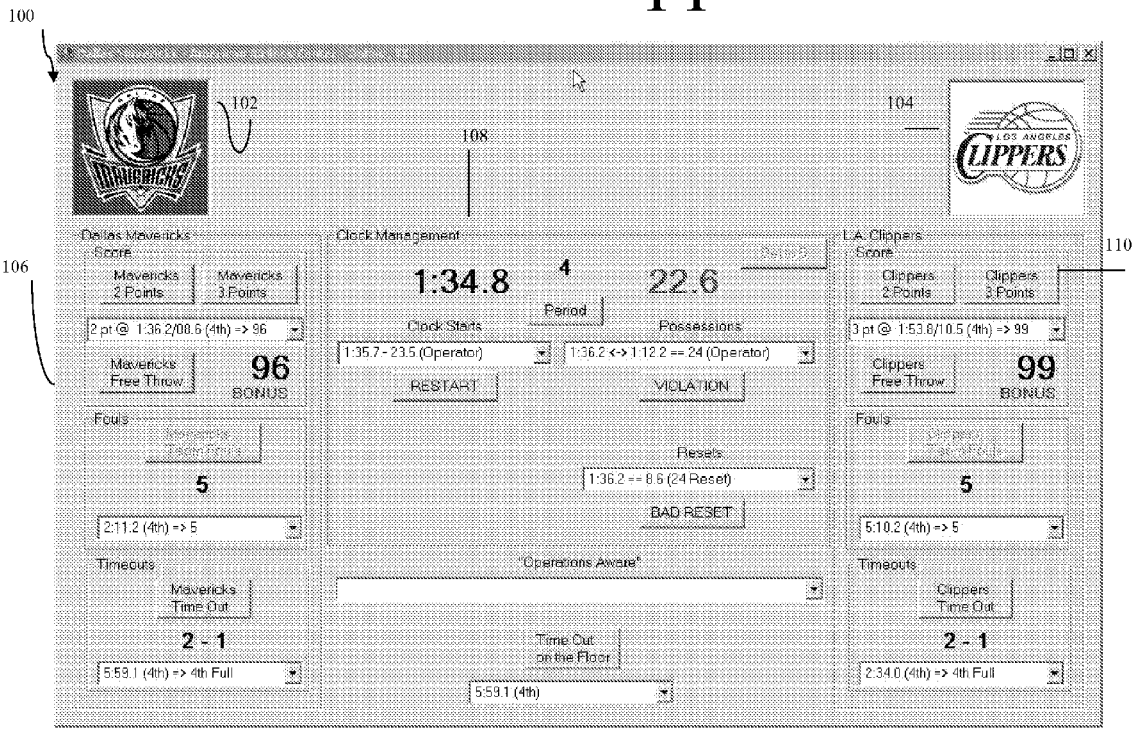
FIG. 1 is an example of graphical user interface according to at least one aspect of the preferred embodiment.

In the preferred embodiment, the system and method is described in relation to a professional basketball game played in the National Basketball Association. The home team is the Dallas Mavericks and the visiting team in this embodiment is the Los Angeles Clippers. FIG. 1 shows an example of a main screen of the invention. Both emblems 102, 104 of the basketball teams are shown on each top corner of the screen 100. The rest of the screen 100 is divided into three areas: Mavericks statistics 106, clock management 108, and Clippers statistics 110. Each of these three areas will be described in more detail below.

Figure 2:
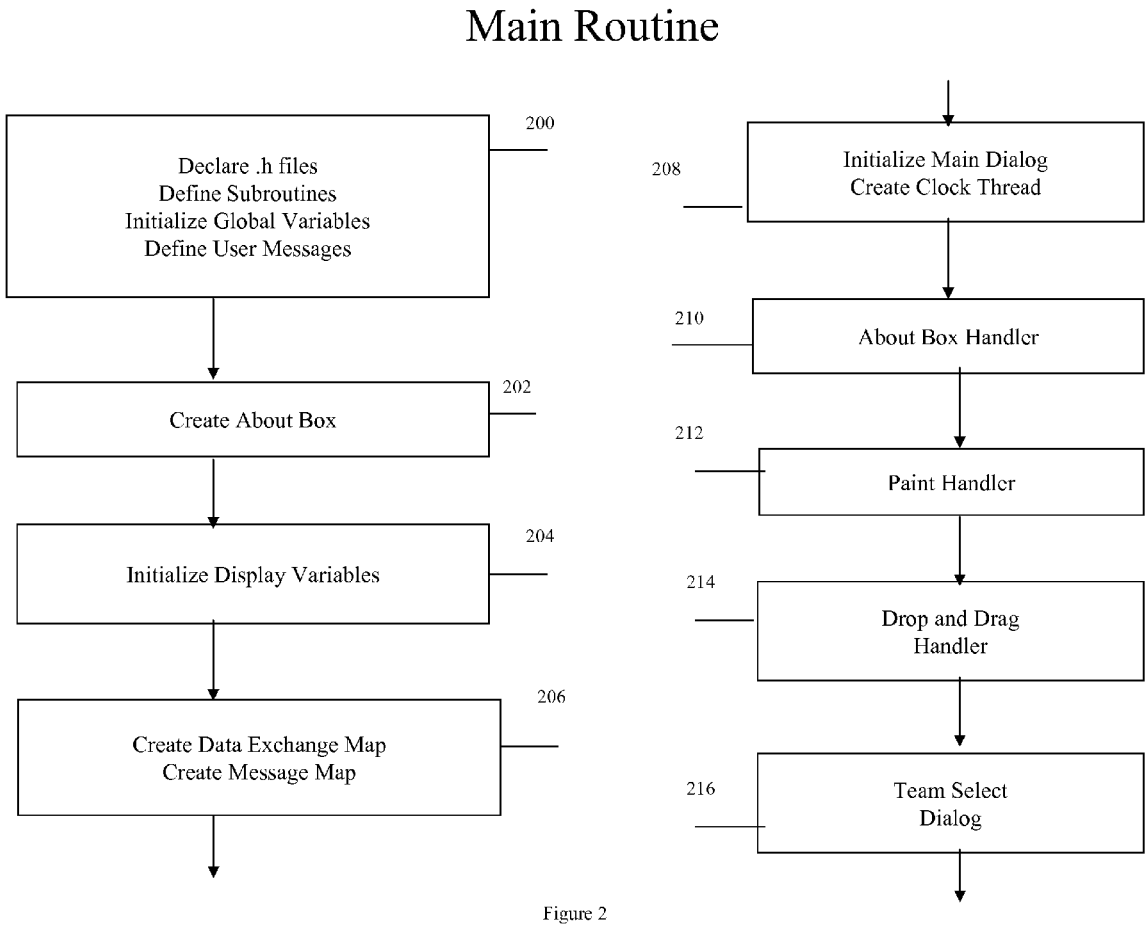
FIGS. 2-16 are flow charts of the preferred embodiment.

The system of preferred embodiment initializes by executing a main routine as depicted in FIG. 2. Module 200 starts by declaring .h files, defining subroutines, initializing global variables, and defining internal messages. Module 202 creates an about box. Module 204 initializes display variables, while module 206 creates a data exchange map and a message map. Module 208 initializes a main dialog and creates a clock thread. Module 210 initializes an about box handler, while module 212 initializes a paint handler. Module 214 initializes a drop and drag handler and a team select dialog is called in module 216.

Figure 3:
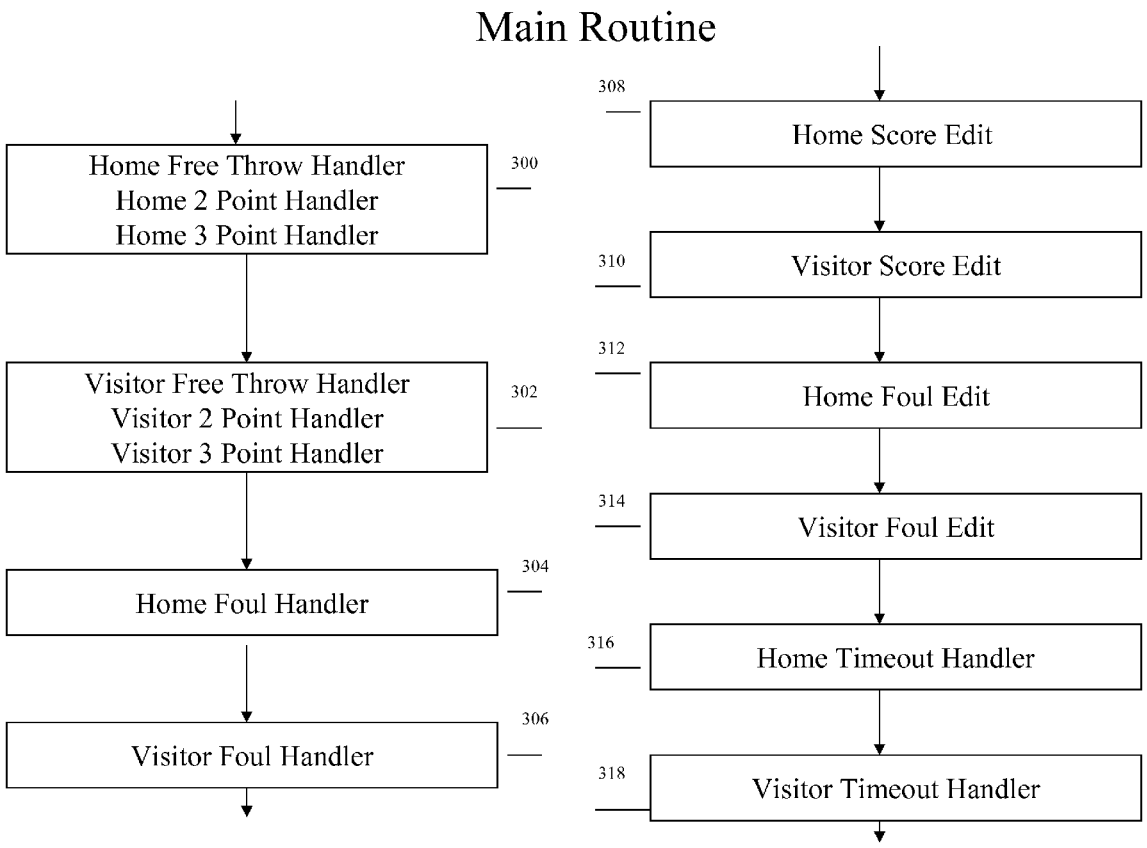

Now referring to FIG. 3, the main routine continues by establishing home free throw (1 point), home 2point and home 3 point Button handlers in module 300. Module 302 then establishes Button handlers for visitor free throw (1 point), visitor 2 point and visitor 3 points. Module 304 establishes a home foul Button handler while module 306 establishes a visitor foul Button handler. Modules 308 and 310 establish a home score edit handler and a visitor score edit handler, respectively, while modules 312 and 314 also establish a home foul edit handler and a visitor foul edit handler, respectively. In addition, modules 316 and 318 establish a home timeout button handler and a visitor timeout button handler, respectively.

Figure 4:
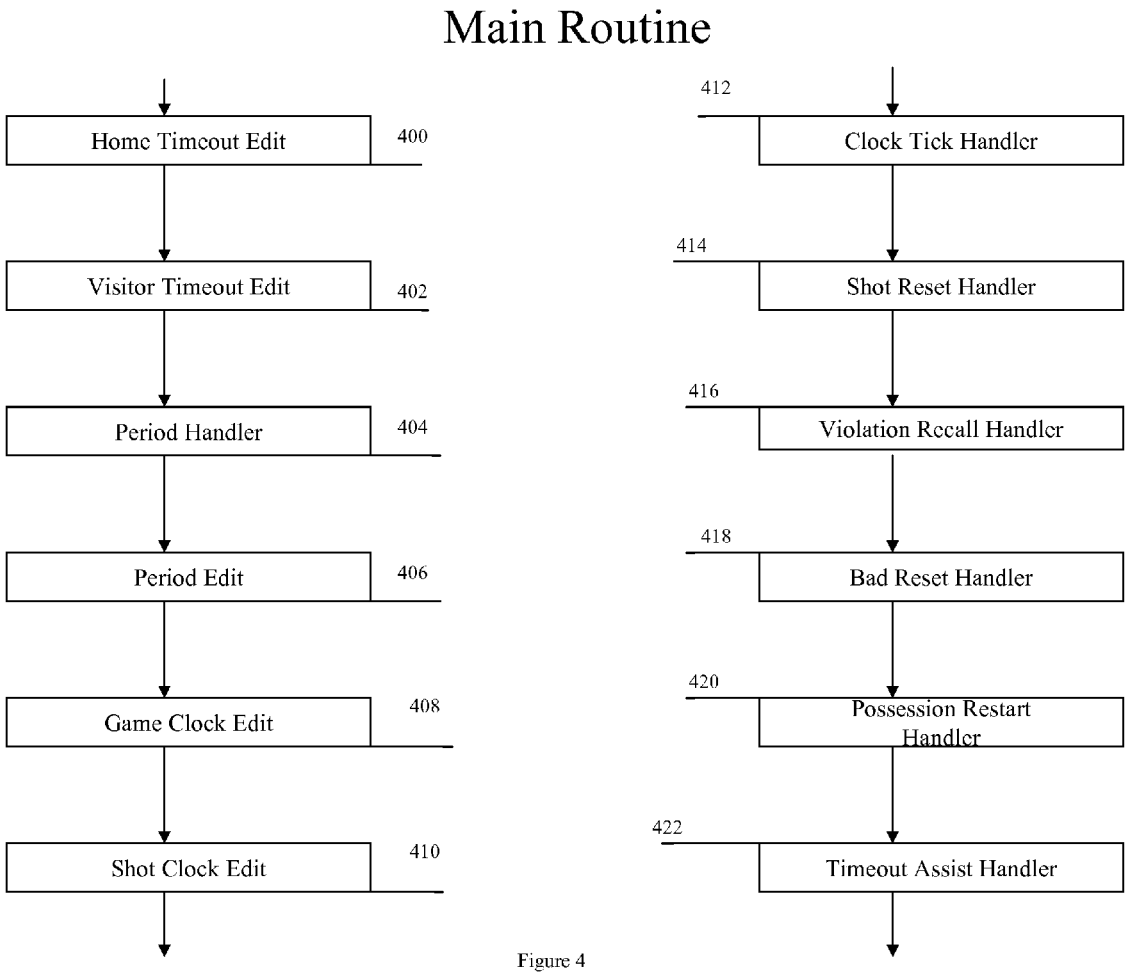

Now referring to FIG. 4, the main routine continues by establishing the home timeout edit handler and visitor timeout edit handler in modules 400 and 402, respectively. Moreover, a period button handler is established in module 404. Additionally, a period edit handler, a game clock edit handler, and a shot clock edit handler are established in modules 406, 408 and 410, respectively. Furthermore, handlers are established for a clock tick, a shot reset handler, violation recall button handler, and bad reset handler in modules 412, 414, 416 and 418, respectively. Module 420 establishes a possession restart button handler, while a timeout assist handler is established in module 422.

Figure 5:
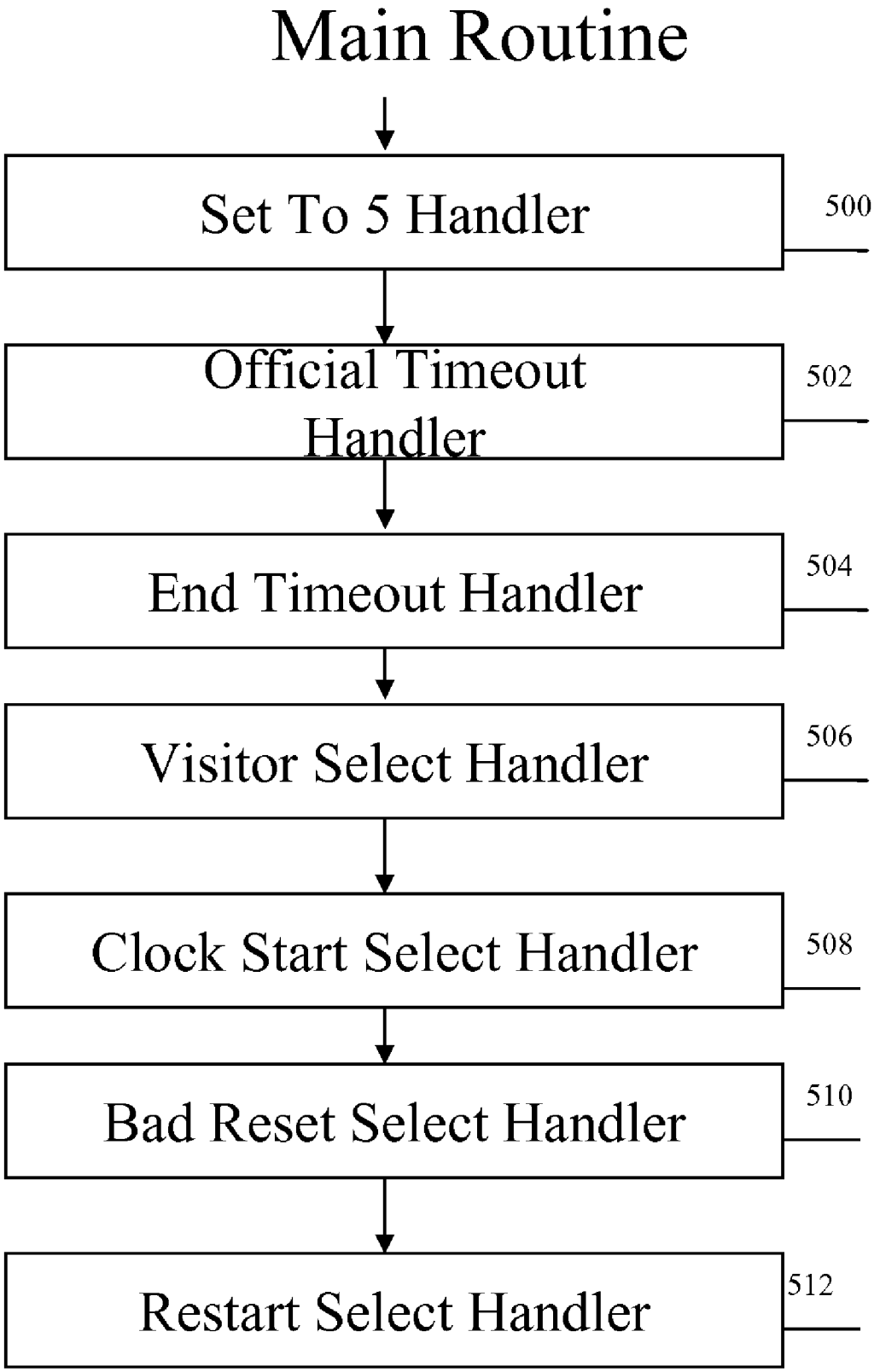

Now referring to FIG. 5, the main routine continues by establishing a 'set to 5' button handler in module 500, an official timeout button handler in module 502, an end timeout handler in module 504 and a visitor select menu handler in module 506. Module 508 creates a handler which allows the user to change the selected clock start. Module 510 creates a handler for the user to change the selected bad reset and module 512 creates a handler for the user to change the restart selection.

Figure 6:
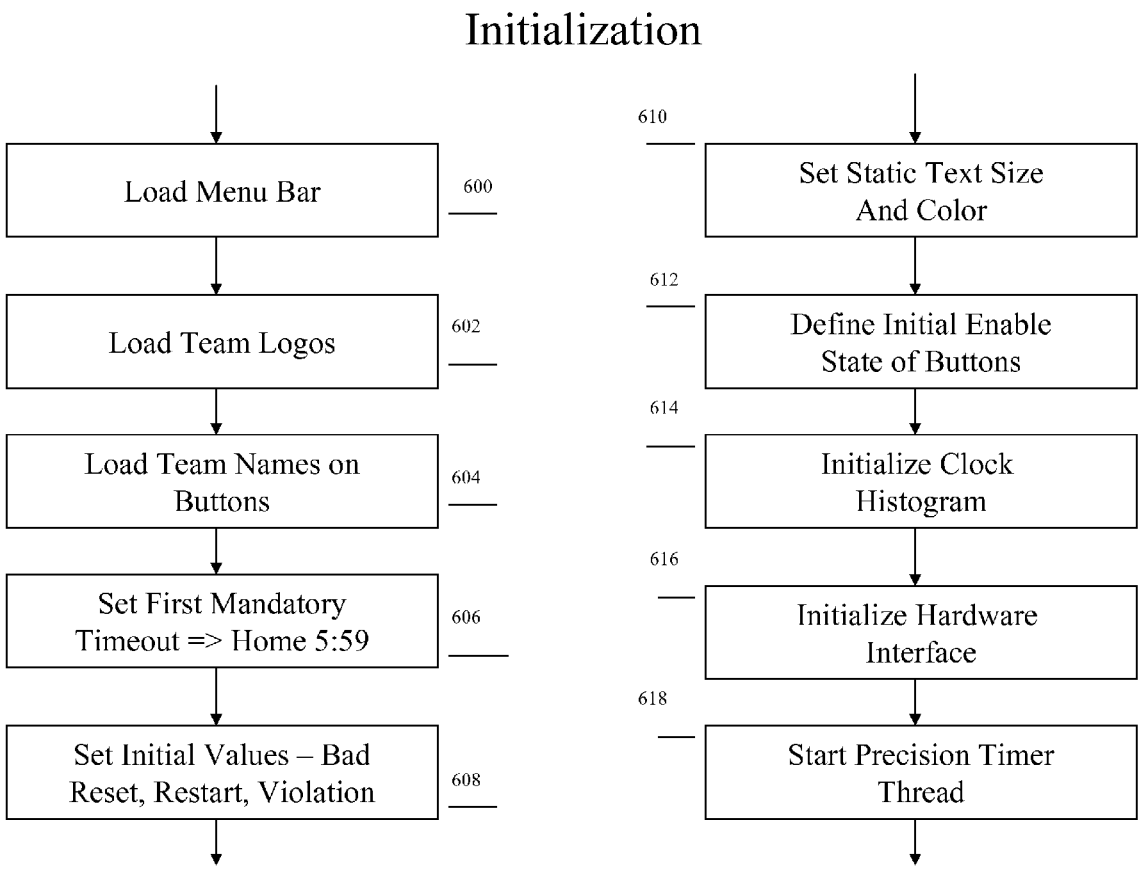

FIG. 6 depicts initialization of the user interface 100 (pictured in FIG. 1). The menu bar is loaded in module 600 while the team logos are loaded in module 602 and the team names are loaded on the buttons in module 604. The first mandatory timeout is set as a Home Timeout at 5:59 in module 606 while initial values are set for bad reset, restart and violation in module 608. In addition, static text size and color are set in module 610 while initializing the enable state of buttons is defined in module 612. Moreover, a clock histogram is initialized in module 614 while a hardware interface is initialized in module 616. In addition, a precision timer thread (Windows Multimedia Timer in this embodiment) is started in module 618.

Figure 7:
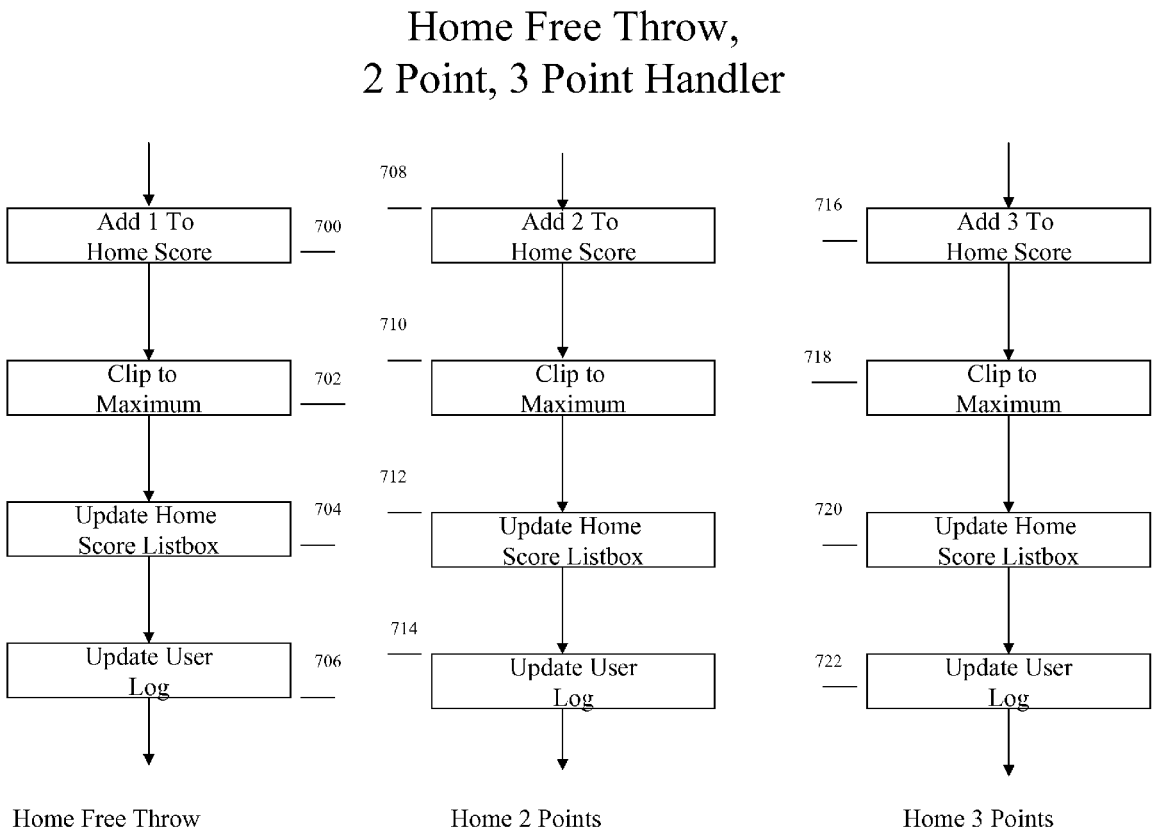

FIG. 7 illustrates the home free throw (1 point), the 2 point and the 3 point handler called in module 300 in FIG. 3. The home free throw starts by adding 1 to the home score as depicted in module 700. Then, module 702 clips to a maximum, while module 704 updates the home score listbox. The user log is then updated as depicted by module 706.

The home 2 point process starts by adding 2 to the home score as depicted in module 708 while a clip to maximum is depicted in module 710. The home score listbox is then updated in module 712 while the user log is updated in module 714.

The home 3 point process starts adding 3 to the home score in module 716 while a clip to maximum is performed in module 718. The home score listbox is updated in module 720 while the user log is updated in module 722.

Figure 8:
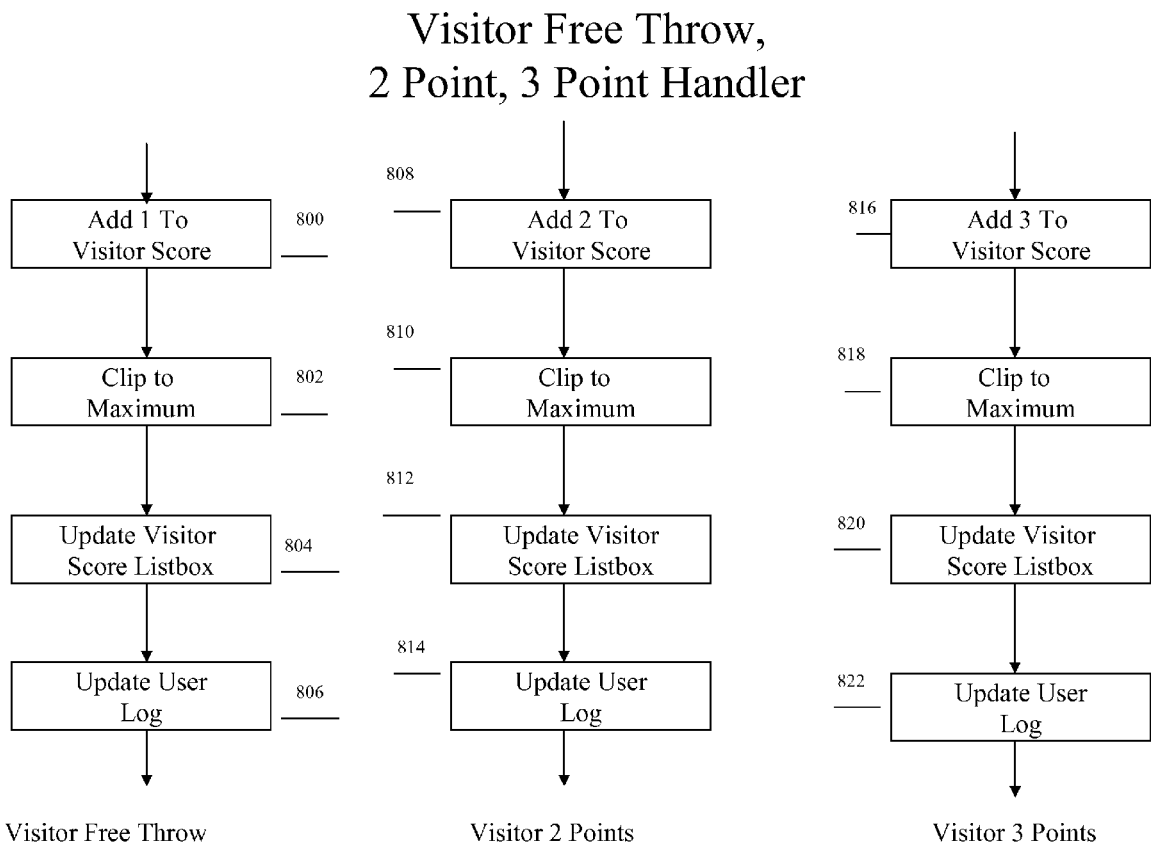

Similarly, FIG. 8 illustrates the visitor free throw (1 point), the 2 point and the 3 point handler called in module 302 of FIG. 3. The visitor free throw starts by adding 1 to the visitor score as depicted in module 800. Then, module 802 clips to a maximum, while module 804 updates the visitor score listbox. The user log is then updated as depicted by module 806.

The visitor 2 point process starts by adding 2 to the visitor score as depicted in module 808 while a clip to maximum is depicted in module 810. The visitor score listbox is then updated in module 812 while the user log is updated in module 814.

The visitor 3 point process starts adding 3 to the visitor score in module 816 while a clip to maximum is performed in module 818. The visitor score listbox is updated in module 820 while the user log is updated in module 822.

Figure 9:
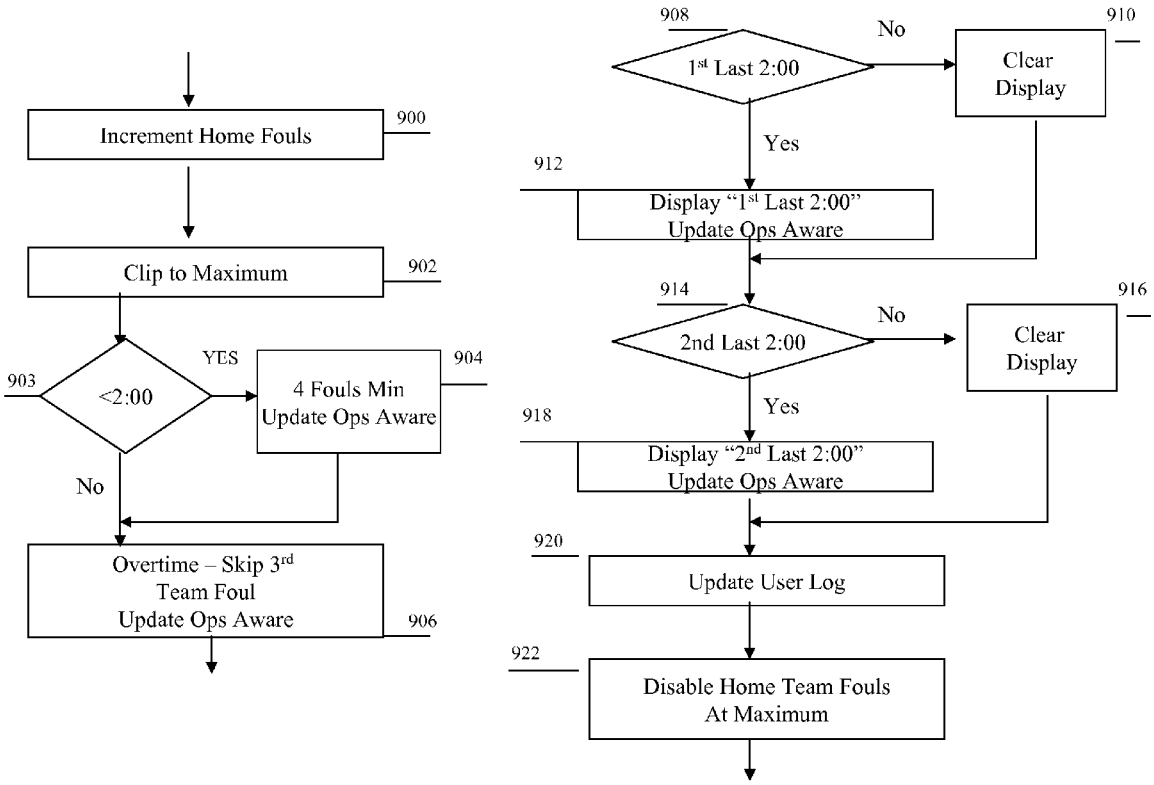

Now referring to FIG. 9, the home foul handler, which is called in module 304 in FIG. 3, starts by incrementing home fouls as depicted in module 900 while a clip to maximum is performed in module 902. Module 903 checks for less than 2 minutes. Module 904 then updates operations aware ("ops aware") with 4 fouls minimum, if less than 2 minutes is true. Module 906 updates "ops aware" and skips the $3^{rd}$ home team foul in overtime. The process proceeds by checking to see if the home team foul is the $1^{st}$ in the last 2 minutes is true in module 908; if its not true, the 'last 2:00' display is cleared by module 910. While it's true, module 912 displays "$1^{st}$ last 2:00" and updates "ops aware". The process then continues in module 914 by checking if the home team foul is the $2^{nd}$ in the last 2 minutes. If it's not true, the 'last 2:00' display is cleared by module 916. If it's true, module 918 displays "$2^{nd}$ last 2:00" and updates "ops aware". Either way, the process then continues to module 920 that updates user log while module 922 disables the home team foul button at maximum.

Figure 10:
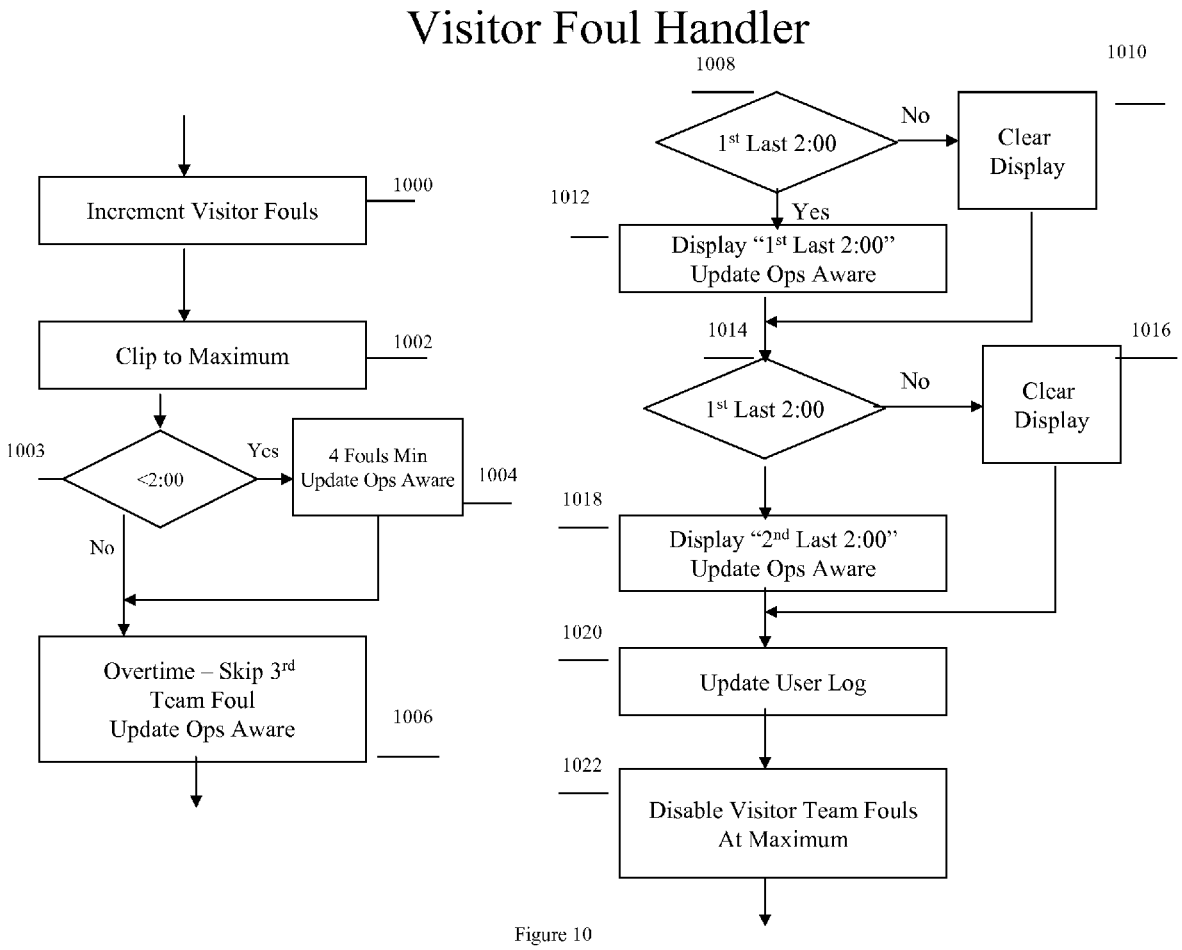

Similarly, FIG. 10 depicts the visitor foul handler called in module 306 in FIG. 3. The process starts by incrementing visitor fouls as depicted in module 1000 while a clip to maximum is performed in module 1002. Module 1003 checks for less than 2 minutes. Module 1004 then updates operations aware ("ops aware") with 4 fouls minimum, if there is less than 2 minutes. Module 1006 updates "ops aware" and skips $3^{rd}$ visitor team foul in overtime. The process proceeds by checking to see if the $1^{st}$ visitor team foul in the last 2 minutes is true in module 1008; if its not true, the 'last 2:00' display is cleared by module 1010. While it's true, module 1012 displays "$1^{st}$ last 2:00" and updates "ops aware". The process then continues by checking if the $2^{nd}$ visitor team foul in the last 2 minutes is true in module 1014; if its not true, the 'last 2:00' display is cleared by module 1016. While if it is true, module 1018 displays "$2^{nd}$ last 2:00" and updates "ops aware". Either way, the process then continues to module 1020 that updates the user log while module 1022 disables visitor team fouls at maximum.

Figure 11:
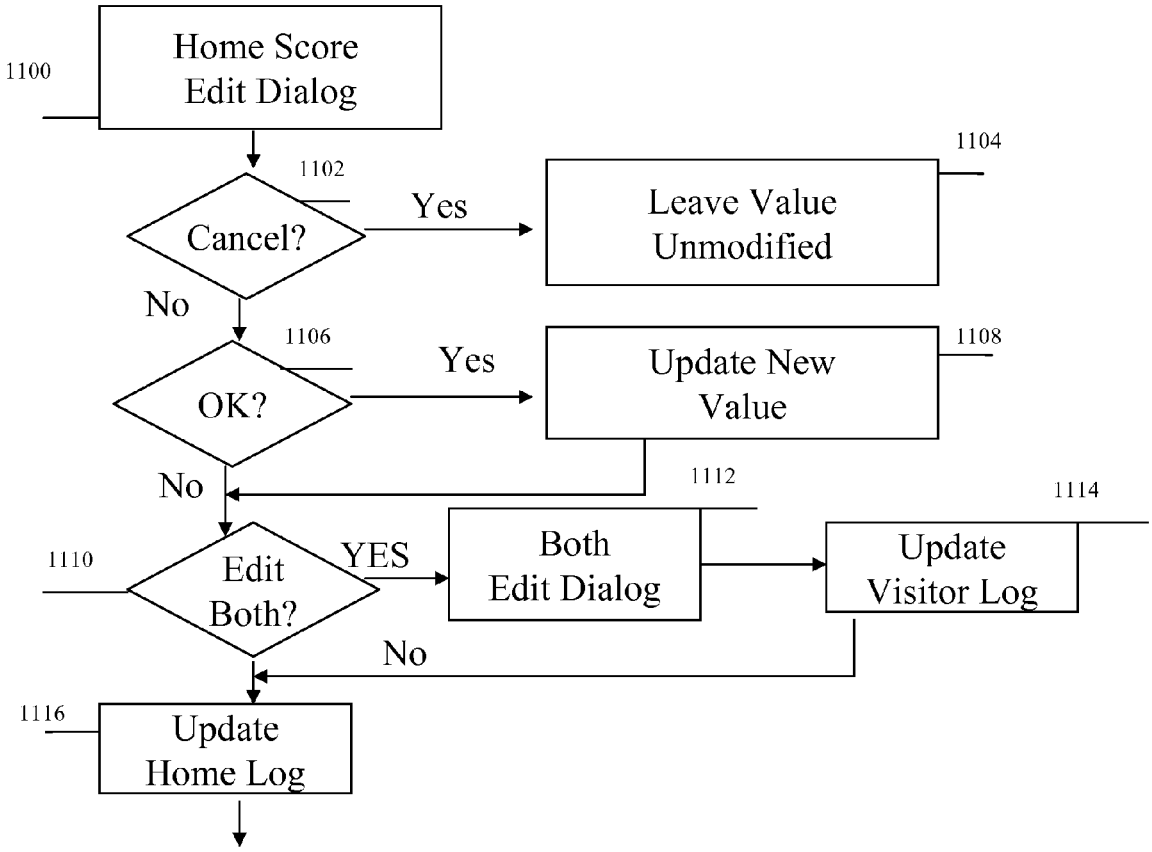
Figure 12:
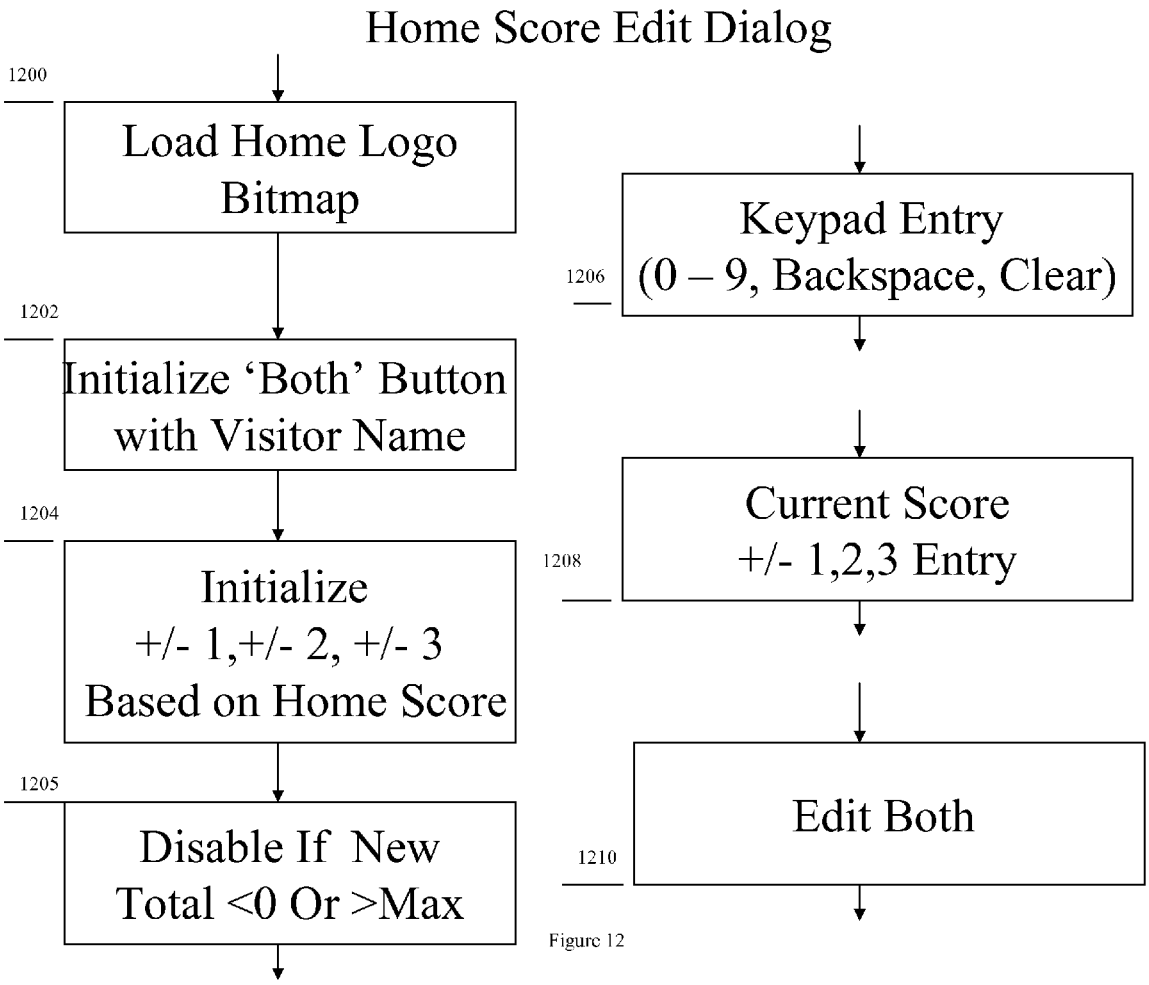

Now referring to FIG. 11, the home score edit process is illustrated, which is called in module 308 in FIG. 3. The process starts by module 1100 calling the home score edit dialog (FIG. 12). Upon returning from the dialog box, module 1102 checks to see if cancel was pressed, and if so the home score is left unmodified in module 1104 and the routine exits. The process then checks to see if the user pressed OK in module 1106. If true, the home score is updated in module 1108. Module 1110 checks to see if the user presses 'both edit', in which case the edit both dialog (FIG. 19) is called in module 1112. Upon return from edit both dialog, module 1114 updates the visitor listbox. If OK or both edit, module 1116 updates the home listbox and the user log.

FIG. 12 illustrates more detail of the dialog called in module 1100 (of FIG. 11). The process first loads the home logo bitmap as depicted in module 1200. Module 1202 then initializes "Both" button with the visitor's name while module 1204 initializes buttons with +/−1, +/−2, or +/−3 based on the current home score. Module 1205 disables buttons that result in scores less than 0 or greater than the maximum. Module 1206 then allows keypad entry and with 0-9, backspace and clear entries. Module 1208 allows the current score +/−1, 2 or 3 to be entered while module 1210 allows the edit both dialog to be called in FIG. 19.

Figure 13:
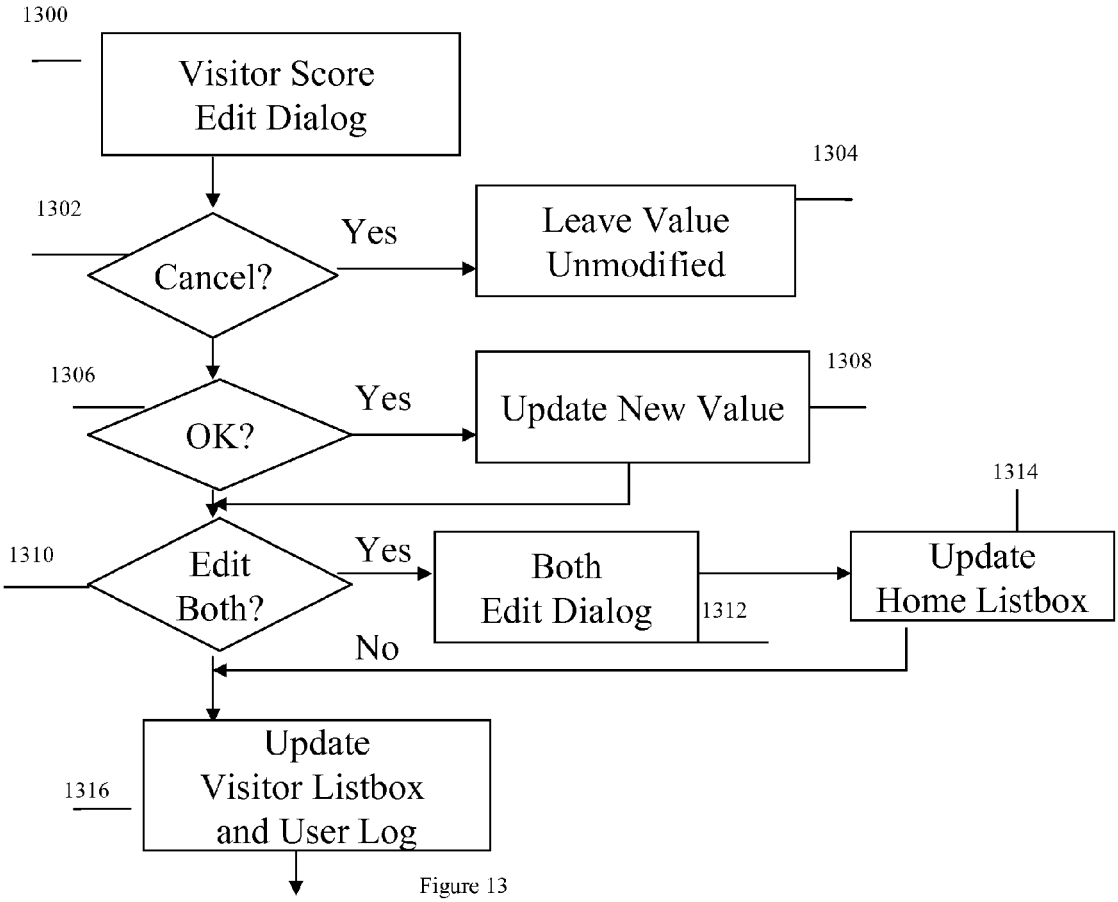

Similarly, FIG. 13 illustrates the visitor score edit process called from module 310 in FIG. 3. The process starts by module 1300 calling the visitor score edit dialog (depicted in FIG. 14). Upon returning from the dialog box, module 1302 checks to see if cancel has been pressed, and if so the visitor score is left unmodified in module 1304 and the routine exits. The process then checks to see if the user pressed OK in module 1306. If true, the visitor score is updated in module 1308. Module 1310 checks to see if the user presses 'both edit', in which case the edit both dialog (FIG. 19) is called in module 1312. Upon return from the edit both dialog, module 1314 updates the home listbox. If OK or both edit, module 1316 updates the visitor listbox and the user log.

Figure 14:
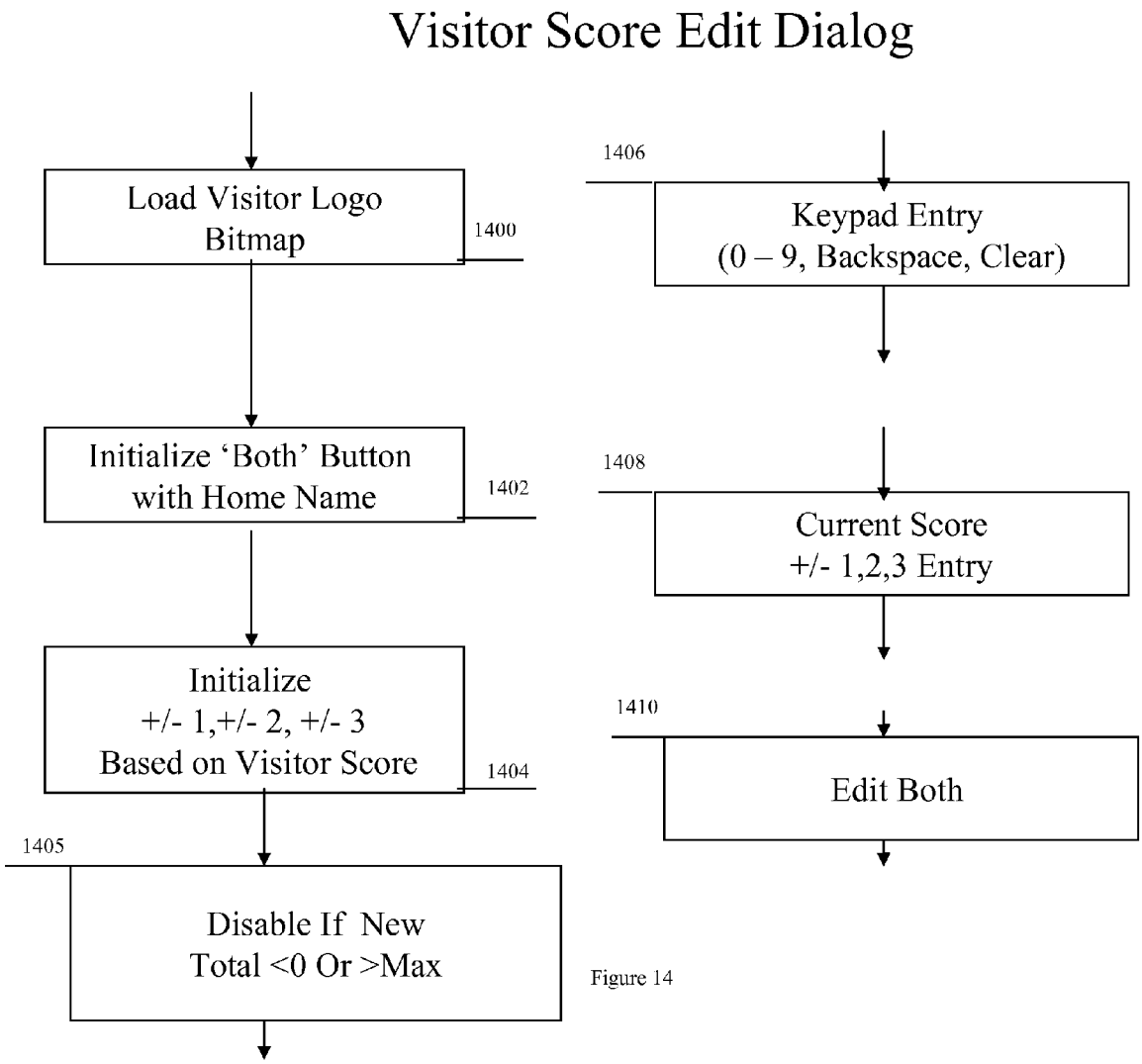

FIG. 14 illustrates more detail of the dialog called in module 1300 (of FIG. 13). The process first loads the visitor logo bitmap as depicted in module 1400. Module 1402 then initializes "Both" button with the home team's name while module 1404 initializes buttons with +/−1, 2, or +/−3 based on the current visitor score. Module 1405 disables buttons that result in scores less than 0 or greater than the maximum. Module 1406 then allows the keypad entry with 0-9, backspace and clear entries. Module 1408 allows the current score +/−1, 2 or 3 to be entered while module 1410 calls the edit both dialog (illustrated in FIG. 19).

Figure 15:
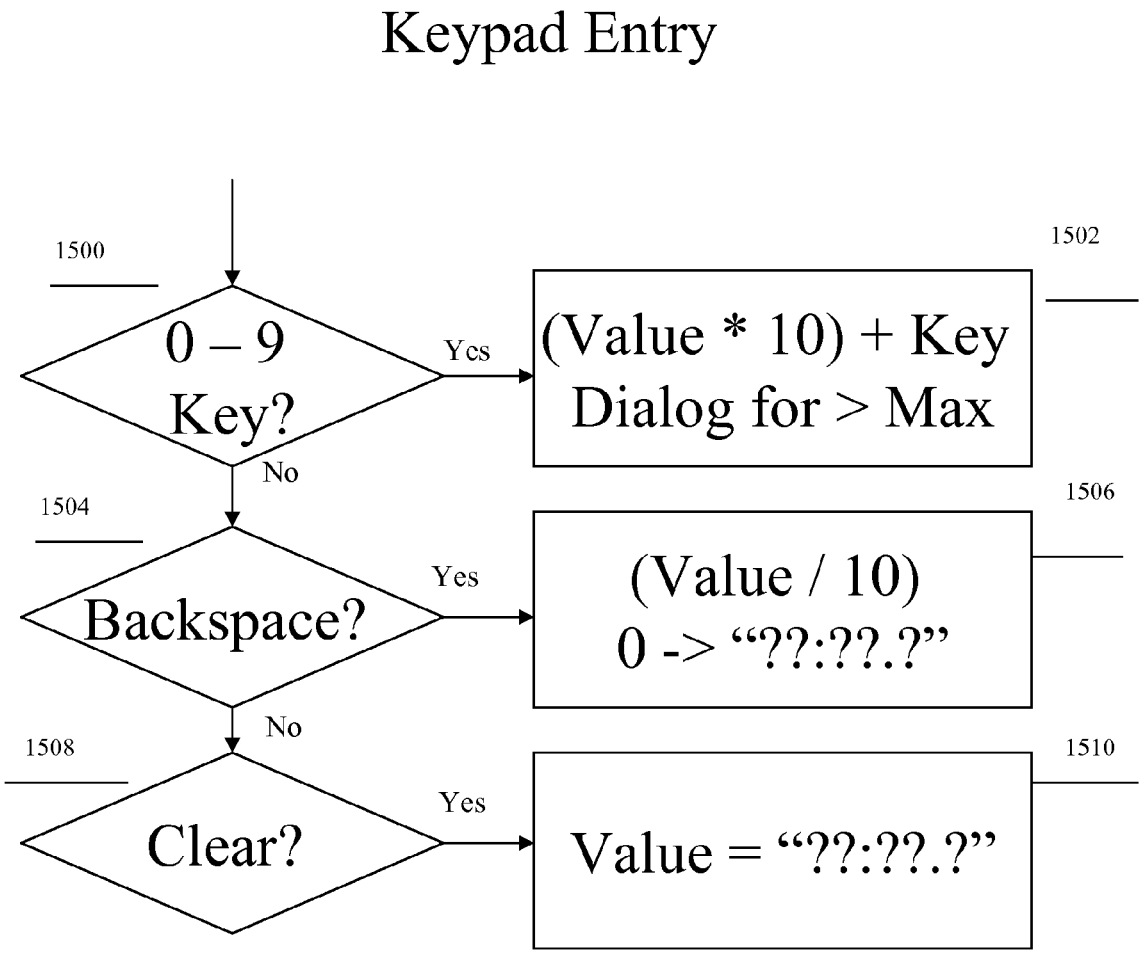

FIG. 15 illustrates more detail of the keypad entry used in modules 1206 and 1406 depicted in FIGS. 12 and 14, respectively. The process checks to see if a 0-9 key is depressed in module 1500. If one of those keys was depressed, module 1502 formulates the value to by multiplying the current value by 10 and adding the selected 0-9 key, clipping the value and issuing a messagebox dialog if greater than the maximum. The process then checks to see if a backspace was pressed in module 1504. If a backspace was depressed, module 1506 formulates the new value by dividing it by 10. If the new value is 0, the display reads "??:??.?". The process then checks to see if the user inputs a clear key in module 1508. If so, module 1510 sets the value to 0 and sets the display to "??:??.?".

Figure 16:
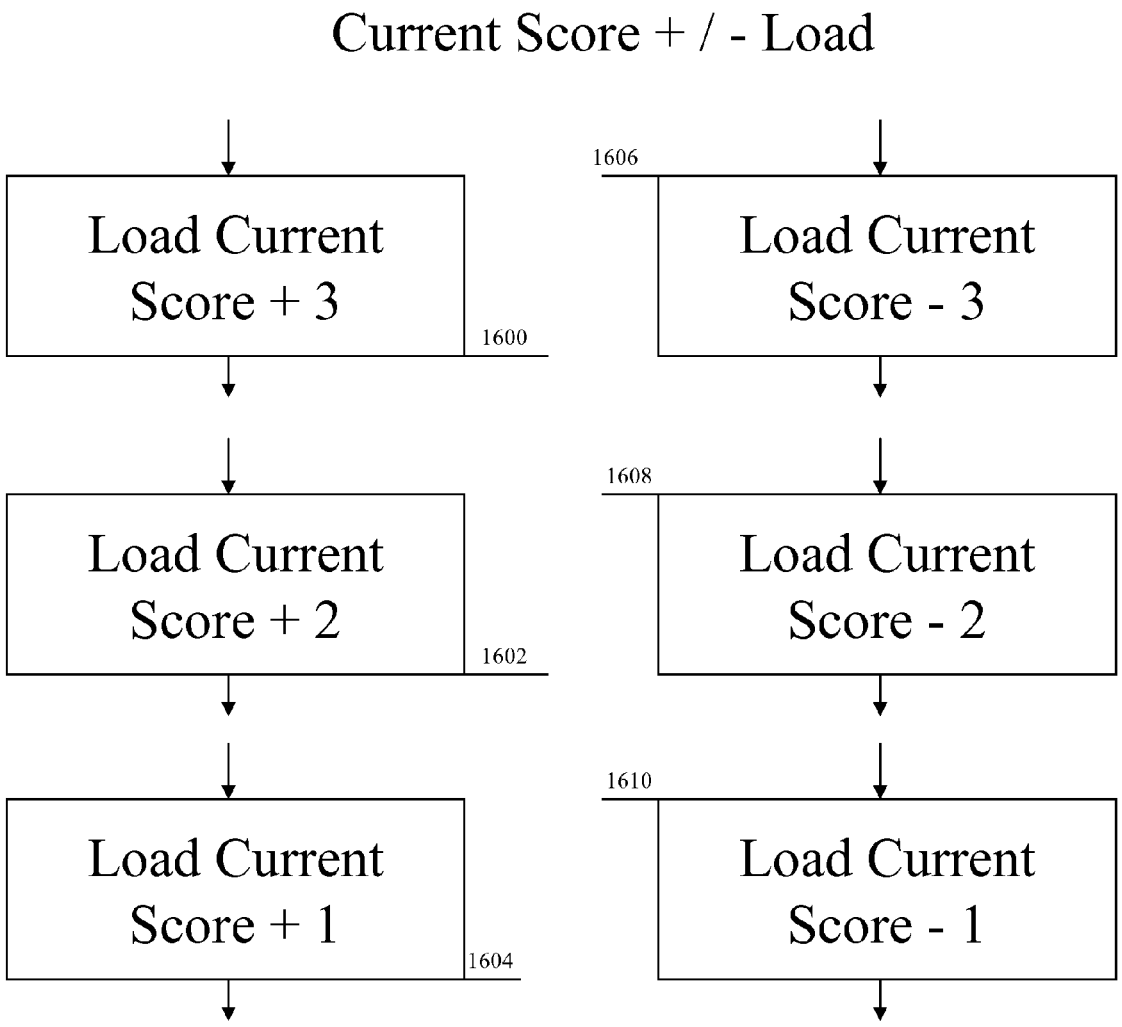

FIG. 16 illustrates more details of the result obtained by pressing the current score +/−1, 2, 3 button entry in modules 1208 and 1408 in FIGS. 12 and 14, respectively. Module 1600, cause the score to be the value of the current score plus 3, while module 1602 causes the score to be the current score plus 2, while module 1604 causes the score to be the current score plus 1. Likewise, module 1606 causes the score to be the current score minus 3, while module 1608 causes the score to be the current score minus 2, while module 1610 causes the score to be the current score minus 1.

Figure 17:
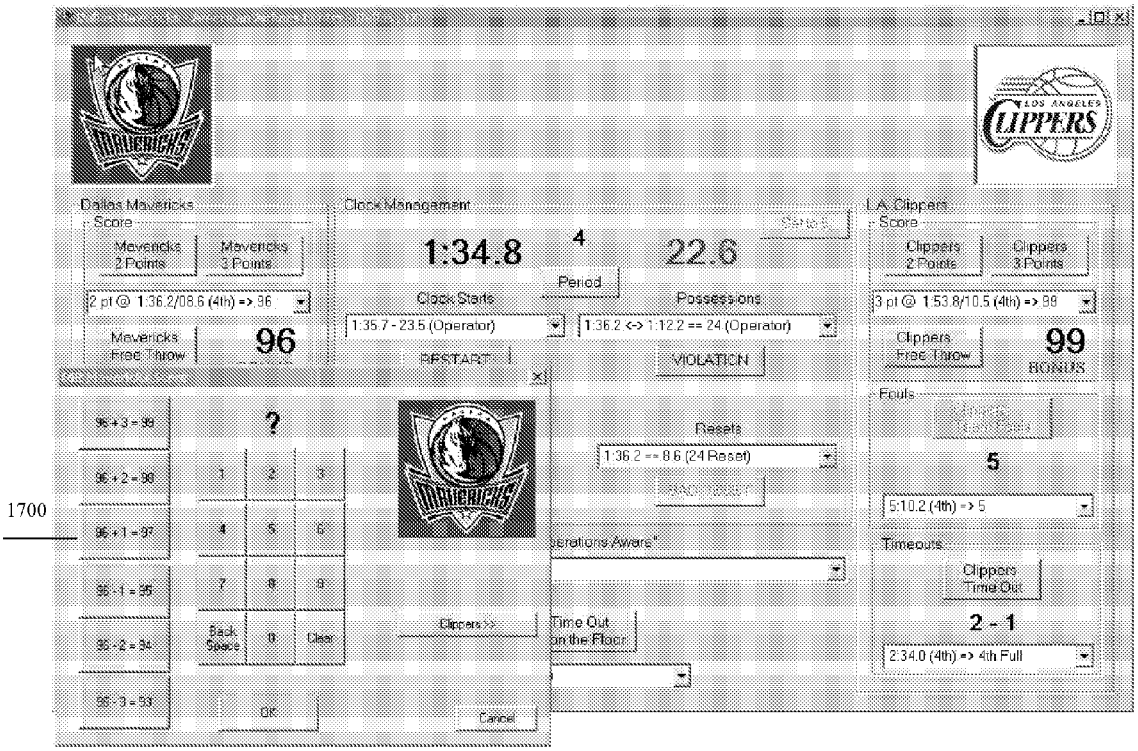
FIG. 17-18 are examples of graphical user interfaces according to at least one aspect of the invention.

FIG. 17 illustrates an example of an edit home team dialog box 1700.

Figure 18:
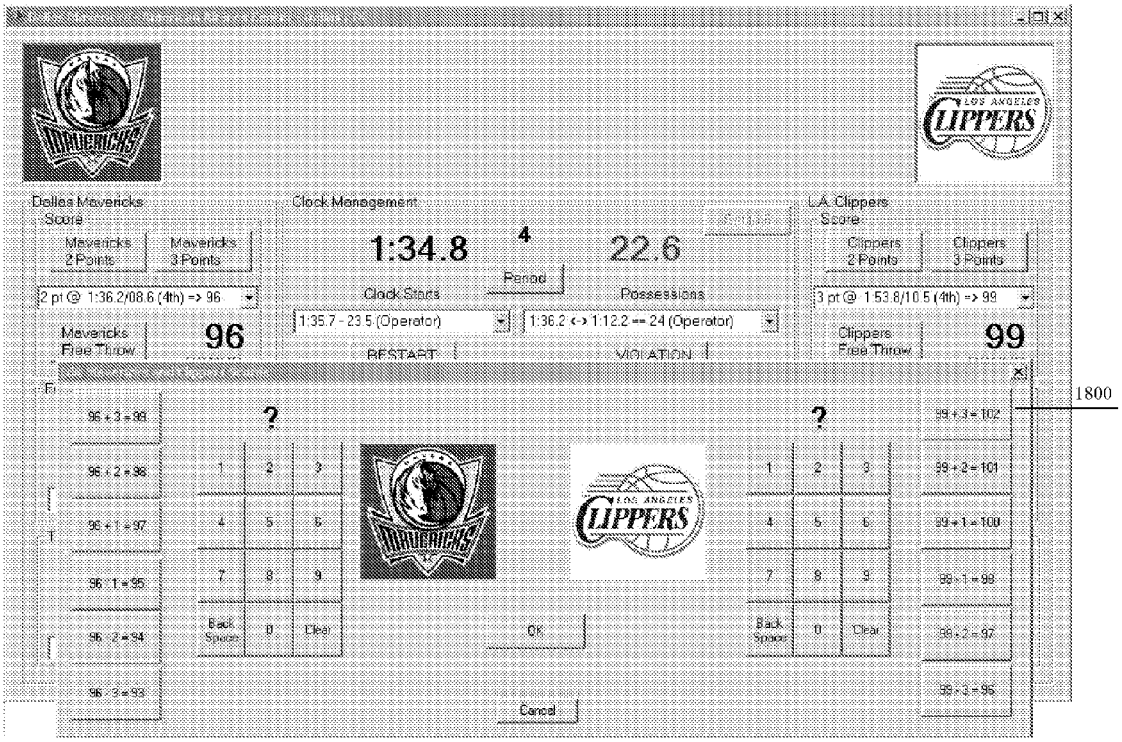

FIG. 18 depicts the edit both dialog box 1800.

Figure 19:
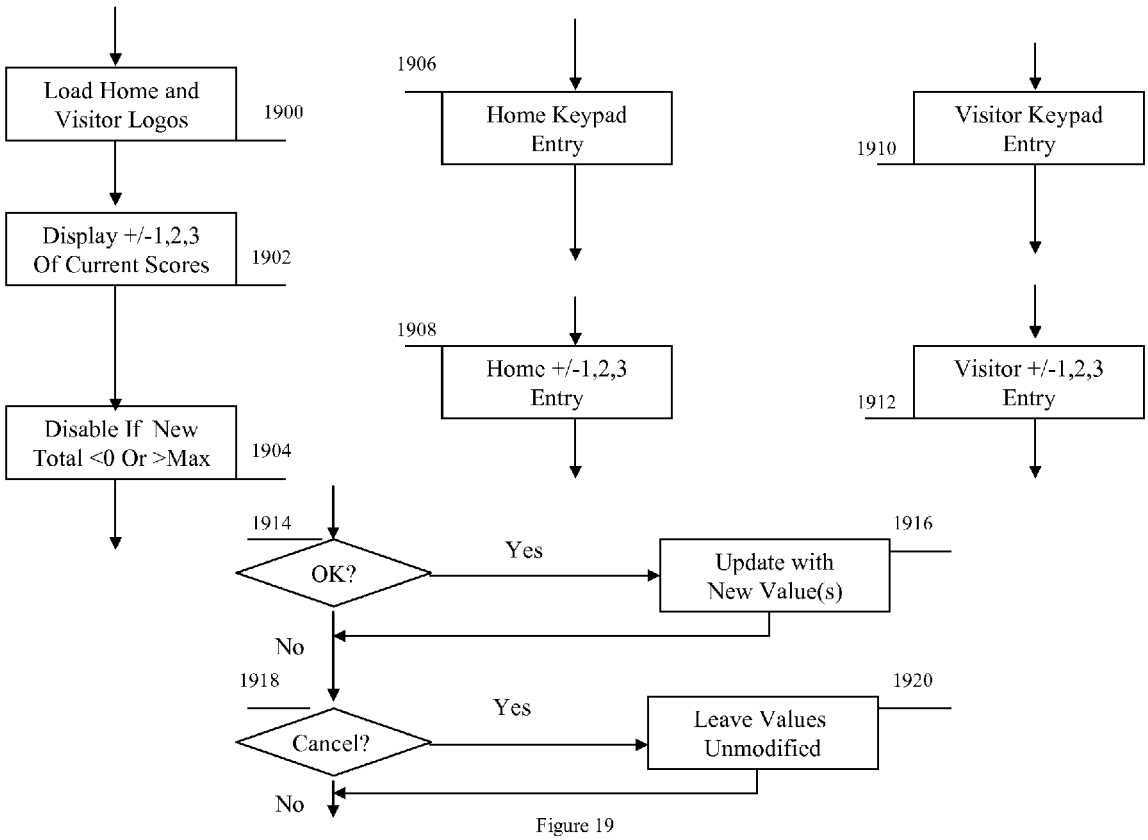
FIGS. 19-26 are flow charts of the preferred embodiment.

FIG. 19 shows more detail of the edit both dialog process called from module 1112 and 1312 in FIGS. 11 and 13, respectively. Module 1900 loads the home and visitor logos while module 1902 displays the scores on buttons of each side with +/−1, 2, 3 of each current score. Module 1904 disables the buttons which would result in a new score total less than 0 or greater than the maximum. Module 1906 allows for home keypad entries, while module 1908 allows for home entries of the +/−1, 2, 3 of the current home score. Similarly, module 1910 allows for visitor keypad entries while module 1912 allows for visitor entries of the +/−1, 2, 3 of the current visitor score. Module 1914 checks to see if the user presses the OK button and if so, updates the new values as indicated in module 1916. Module 1918 checks to see if the cancel button is pressed and if so, leaves the values unmodified as indicated in module 1920.

Figure 20:
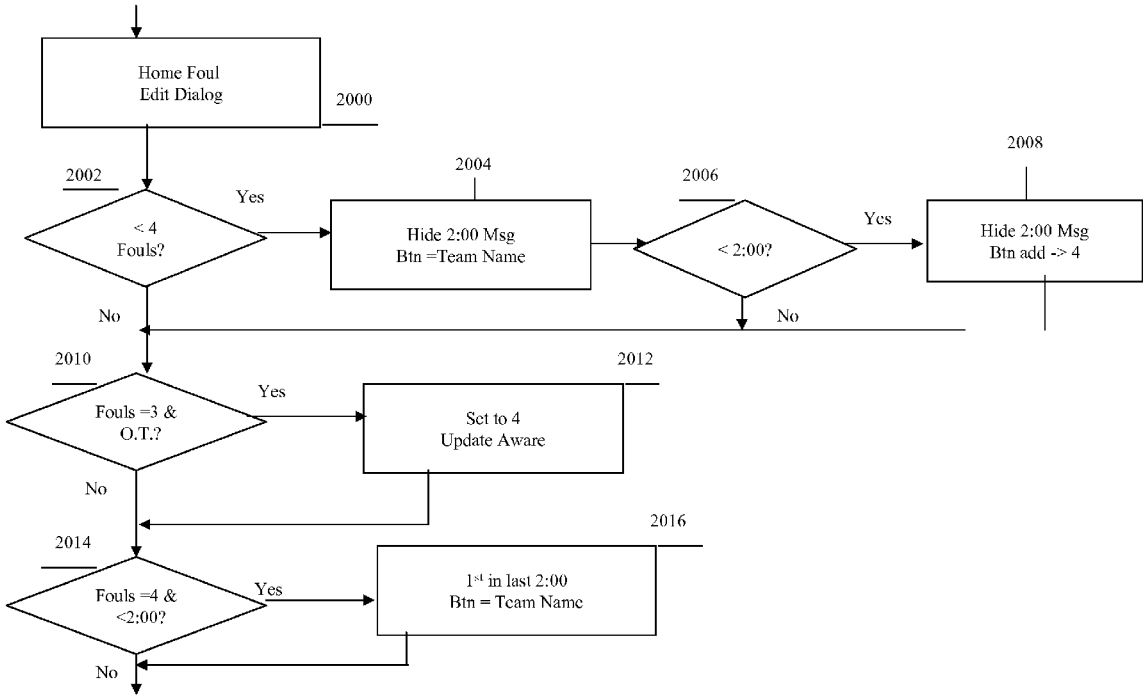
Figure 21:
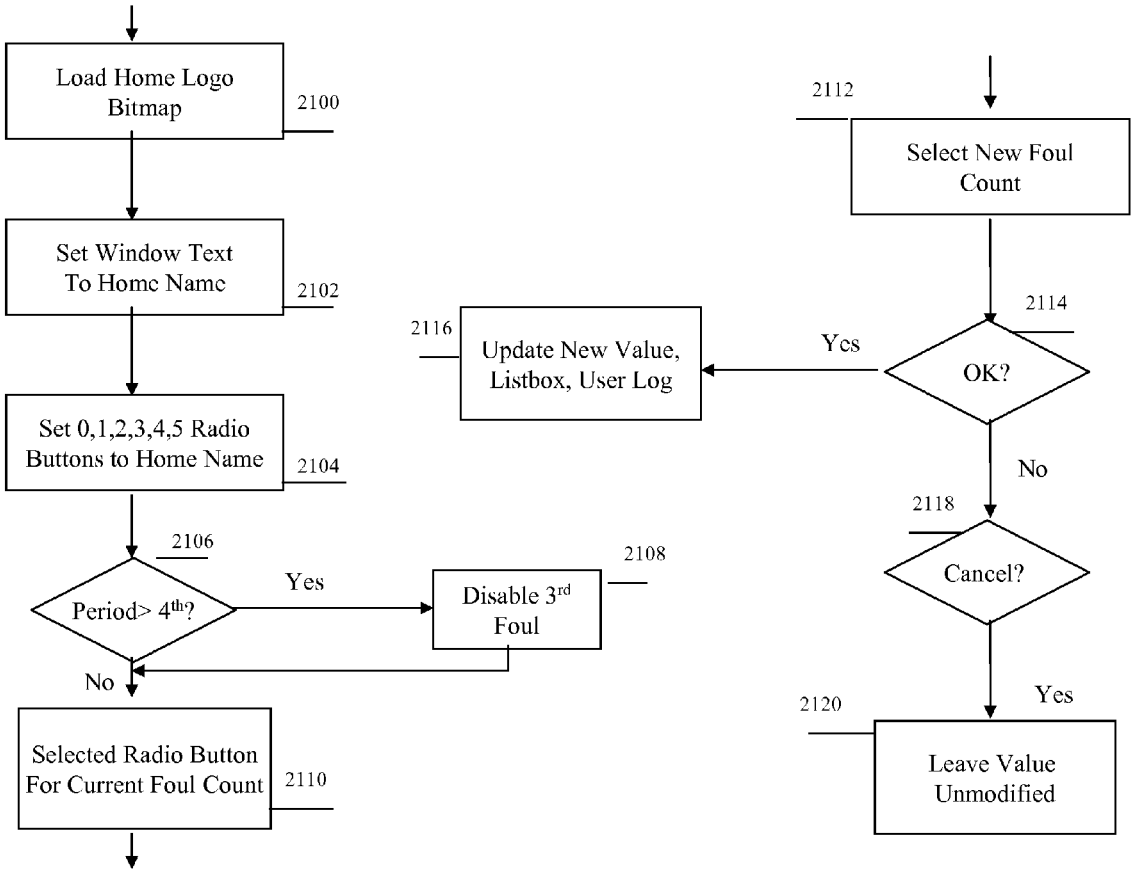

FIG. 20 illustrates the home foul edit process called from module 312, FIG. 3. The process starts with module 2000 by calling the home foul edit dialog (as depicted in FIG. 21). Upon return from the home foul dialog, the process checks to see if home fouls are less than 4 home fouls in module 2002 and if so, module 2004 hides the 'last 2:00' message and sets the button equal to the home team name only. The process then checks to see if the time is less than 2 minutes in module 2006 and if so, then module 2008 hides the 'last 2:00' message and changes the button by adding '->4' after the home team name to signify that the next home foul will be the $4^{th}$. The process then checks to see if the fouls equal to 3 and its overtime in module 2010. If true, the module 2012 sets the home fouls to 4 and updates ops aware listbox. The process then checks to see if home fouls are equal to 4 and its less than 2 minutes in module 2014, and if so, module 2016 sets the $1^{st}$ in last 2 minutes and button is set to the home team name only.

FIG. 21 illustrates the home foul edit dialog process called in module 2000 in FIG. 20. First, module 2100 loads the home logo bitmap and then sets the window text to home name in module 2102. The 0, 1, 2, 3, 4 and 5 radio buttons are set to the home name in module 2104. Module 2106 then checks to see if the period is greater than the $4^{th}$ and if so, the $3^{rd}$ foul is disabled in module 2108. Either way, module 2110 sets the selected radio button for the current home foul count. Module 2112 then allows the user to select the new foul count while module 2114 then checks to see if the OK button was pressed. If so, module 2116 updates the foul with the new value, updates the listbox and user log. Module 2118 checks to see if the cancel button was pressed while module 2120 leaves the value unmodified if the cancel button was pressed.

Figure 22:
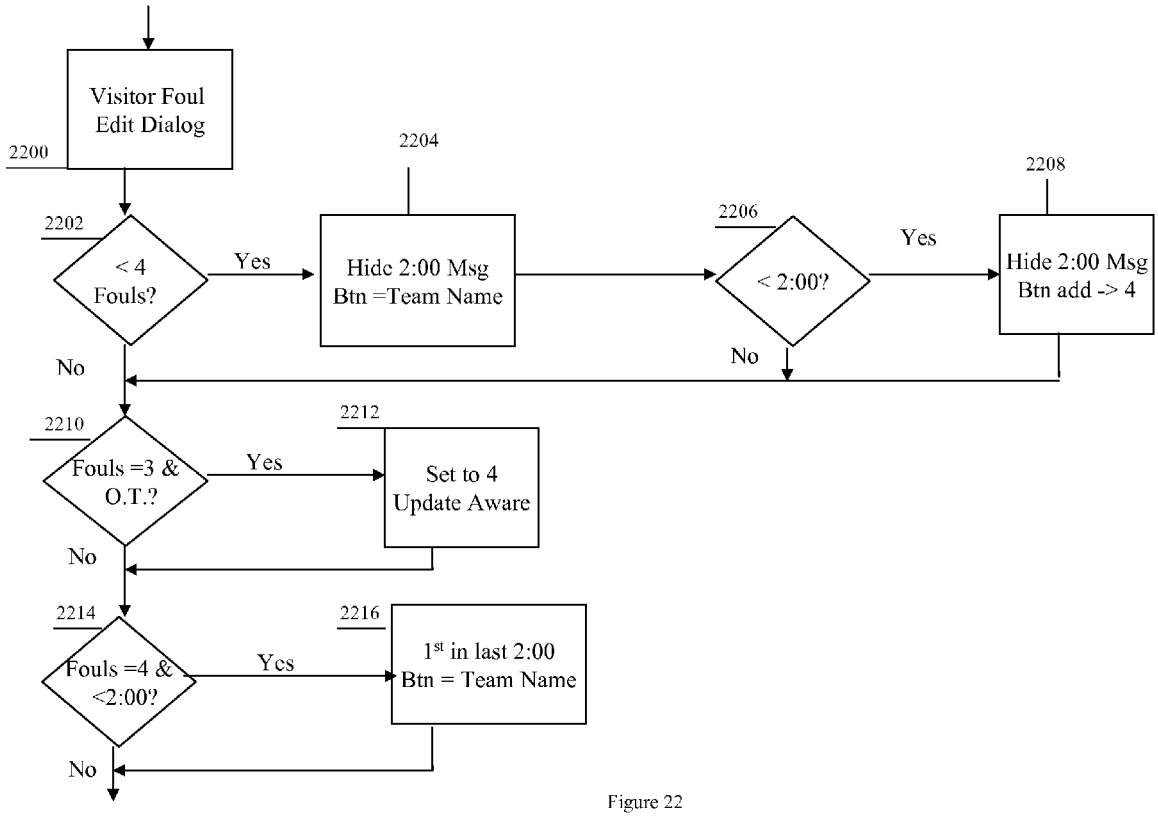

FIG. 22 illustrates the visitor foul edit process called from module 314 illustrated in FIG. 3. The process starts with module 2200 by calling the visitor foul edit dialog (depicted in FIG. 23). Upon return from dialog, the process then checks to see if less than 4 visitor fouls have been committed in module 2202 and if so, module 2204 hides the 'last 2:00' message and sets the button equal to the visitor team name only. The process then checks to see if the time is less than 2 minutes in module 2206 and if so, then module 2208 hides the 'last 2:00' message and changes the button by adding '->4' after the visitor team name to signify that the next visitor foul will be the $4^{th}$. The process then checks to see if the visitor fouls equal to 3 and it's overtime in module 2210. Then module 2212 sets the visitor fouls to 4 and updates ops aware listbox, if true. The process then checks to see if visitor fouls are equal to 4 and its less than 2 minutes in module 2214, and if so, module 2216 sets the $1^{st}$ in last 2 minutes and button is set to visitor team name only.

Figure 23:
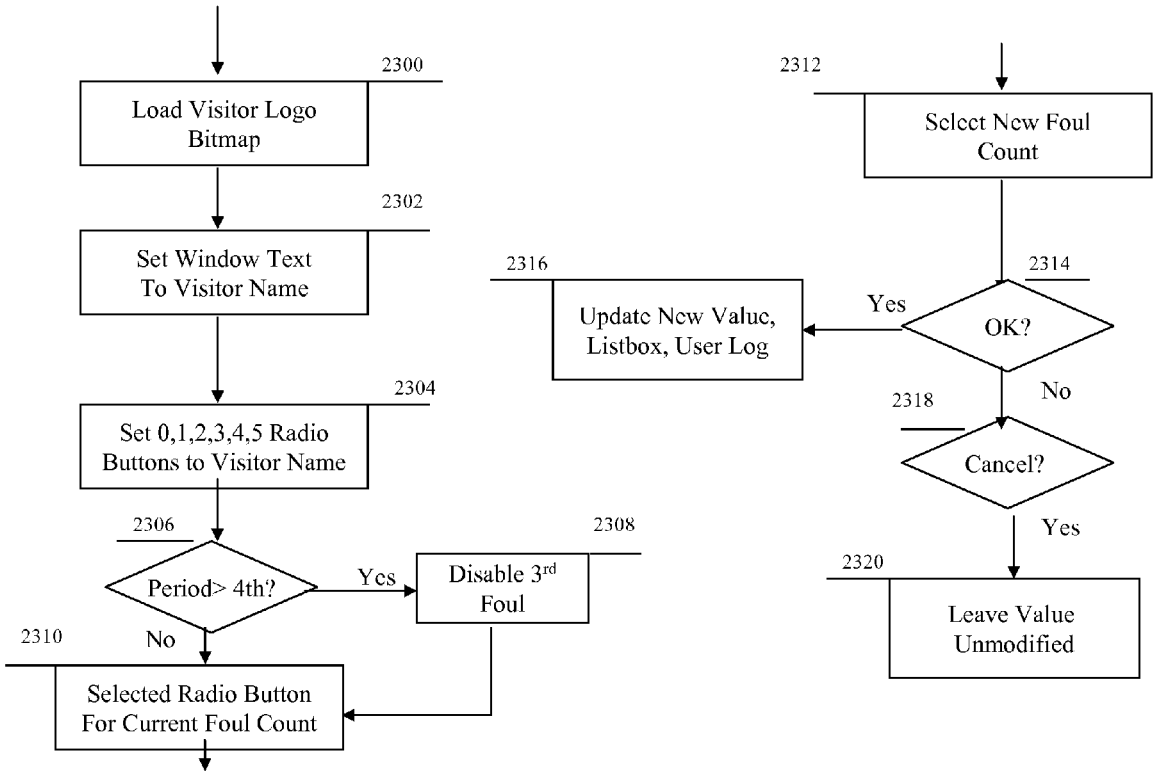

FIG. 23 illustrates the visitor foul edit dialog process called in module 2200 in FIG. 22. First, module 2300 loads the visitor logo bitmap and then sets the window text to the visitor name in module 2302. The 0, 1, 2, 3, 4 and 5 radio buttons are set to visitor name in module 2304. Module 2306 then checks to see if the period is greater than the $4^{th}$ and if so, the $3^{rd}$ foul is disabled in module 2308. Either way, module 2310 sets the selected radio button for the current visitor foul count. Module 2312 then allows the user to select the new foul count while module 2314 then checks to see if the OK button was pressed. If so, module 2316 updates the foul with the new value, updates the listbox and user log. Module 2318 also checks to see if the cancel button was pressed while module 2320 leaves the value unmodified if the cancel button was pressed.

Figure 24:
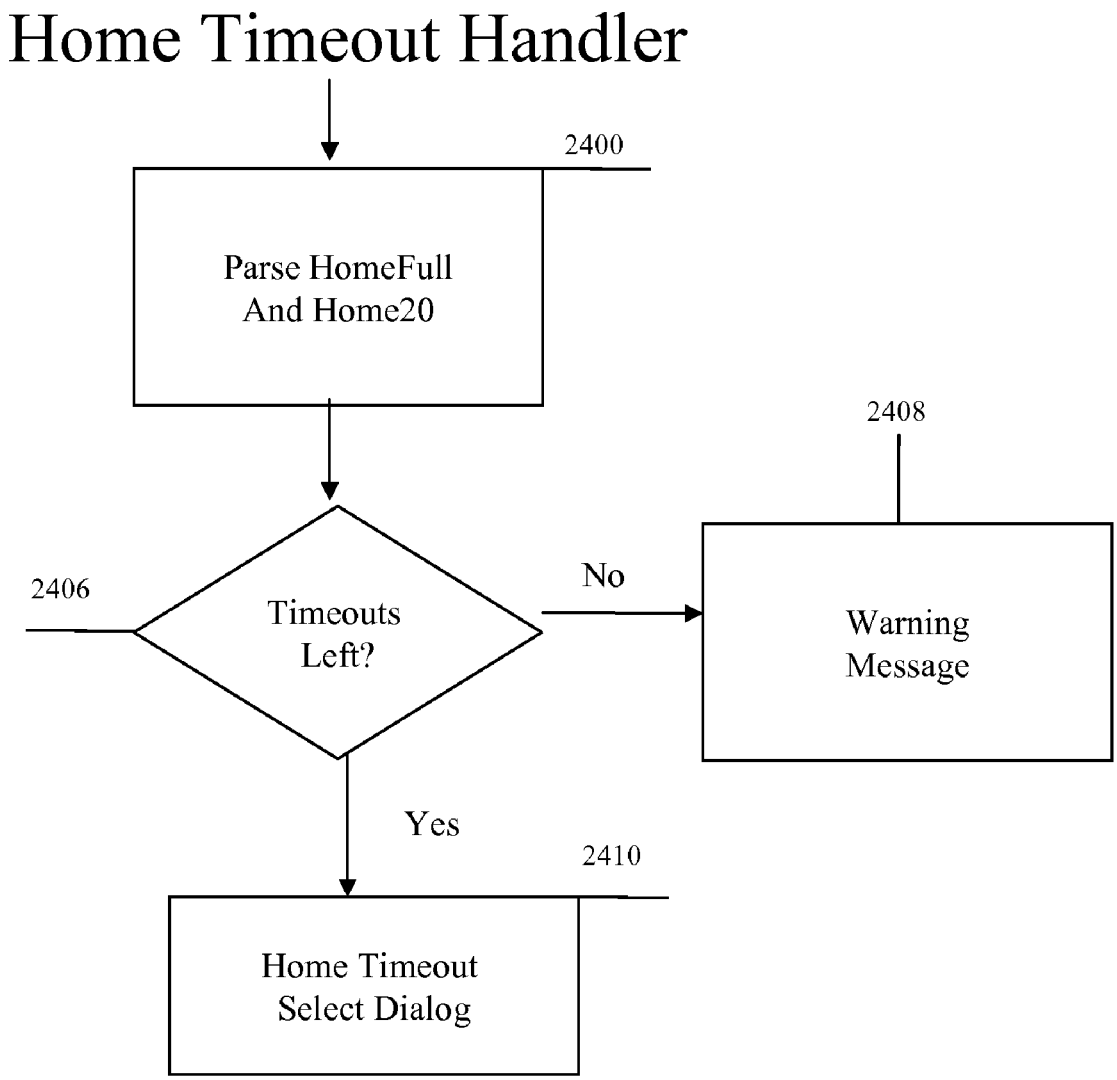

FIG. 24 illustrates the home timeout handler process called from module 316 in FIG. 3. The process first starts with module 2400 parsing homefull and home 20. The process then proceeds to check if there are any home timeouts left in module 2406 and if not, module 2408 displays a warning message and exits. If there are timeouts left, module 2410 calls the home timeout select dialog in FIG. 25.

Figure 25:
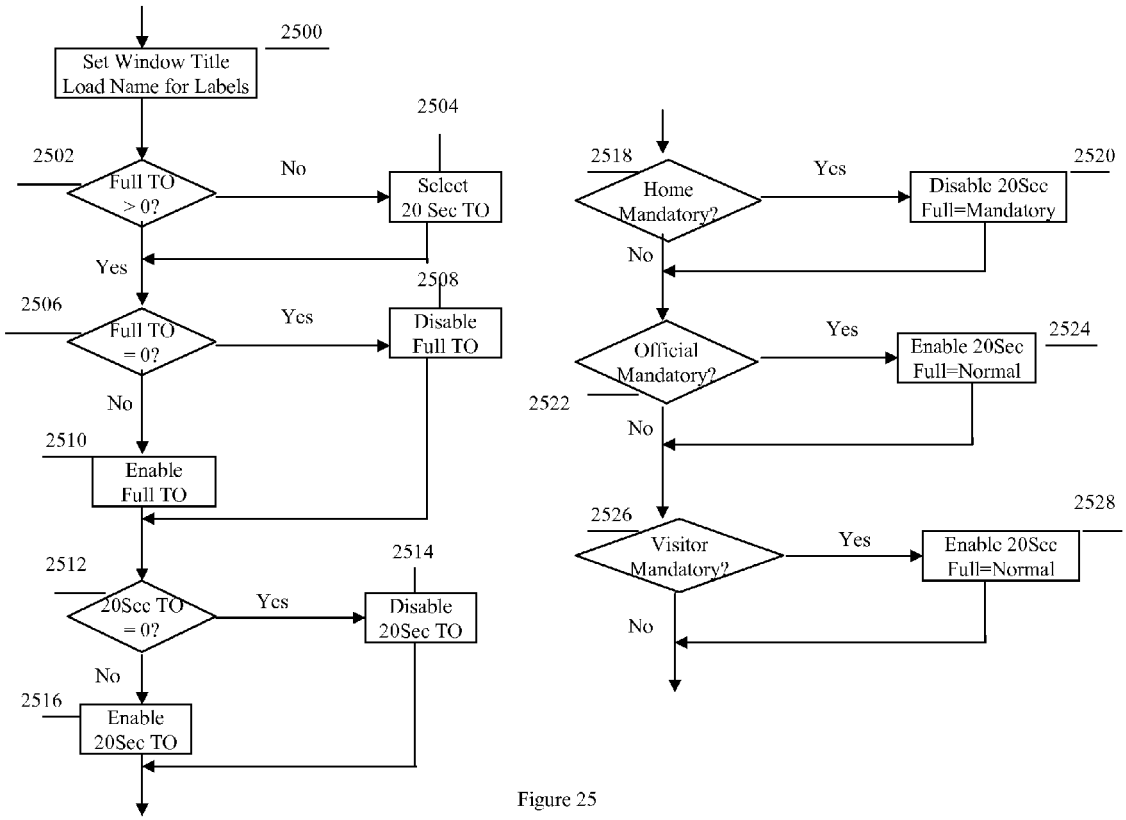

FIG. 25 illustrates details for the home timeout select dialog process called in 2410 of FIG. 24. The process first starts with module 2500 setting window title to home team name, load home team name for labels. Module 2502 then checks to see if the home full timeouts are greater than 0 and if not, module 2504 selects a 20 second timeout. Module 2506 then checks to see if the home full timeouts equals 0 and if so, module 2508 disables home full timeouts. Otherwise, module 2510 then enables home full timeouts while module 2512 checks to see if the home 20 second timeout is equal to 0. If so, module 2514 disables the home 20 second timeout, otherwise module 2516 enables the home 20 second timeout. Module 2518 then checks to see the home team is required to call a mandatory timeout and if so, module 2520 disables the home 20 second timeout and marks the home full timeout as mandatory. The process then checks for a mandatory official timeout in module 2522 and if so, module 2524 enables the home 20 second timeout and allows the home full timeout. The process then checks to see if the visitor team requires a mandatory timeout in module 2526, and if so, module 2528 enables the home 20 second timeout and allows the home full timeout.

Figure 26:
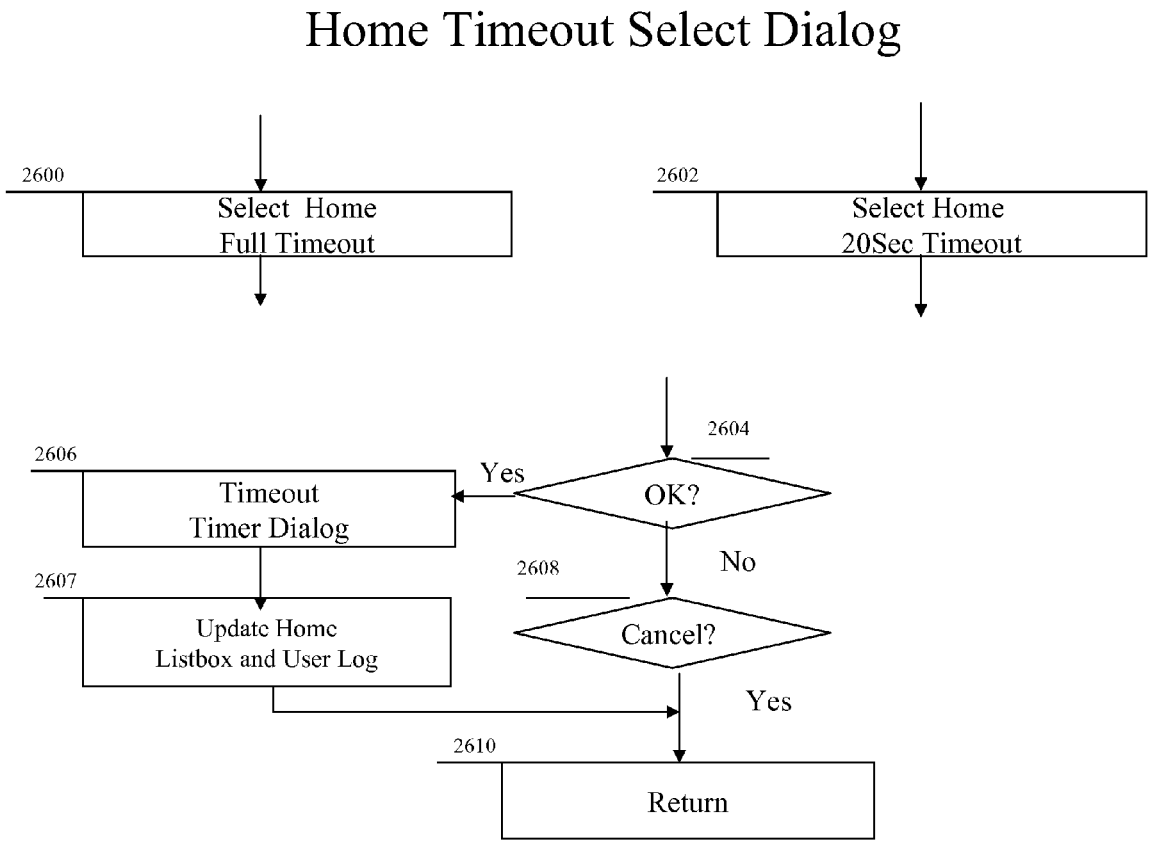

FIG. 26 continues to illustrate the home timeout select dialog process from FIG. 25. The user can either select a home full timeout as indicated by module 2600 or a home 20 second timeout as indicated by module 2602. The process then checks to see if the OK button is pressed in module 2604 and if so, the timeout timer dialog (depicted in FIG. 28) is called in module 2606 and upon returning from the dialog box, the home timeout listbox and user log are updated in module 2607. The process also checks to see if the cancel button was pressed in module 2608 and if so, module 2610 returns out of this dialog.

Figure 27:
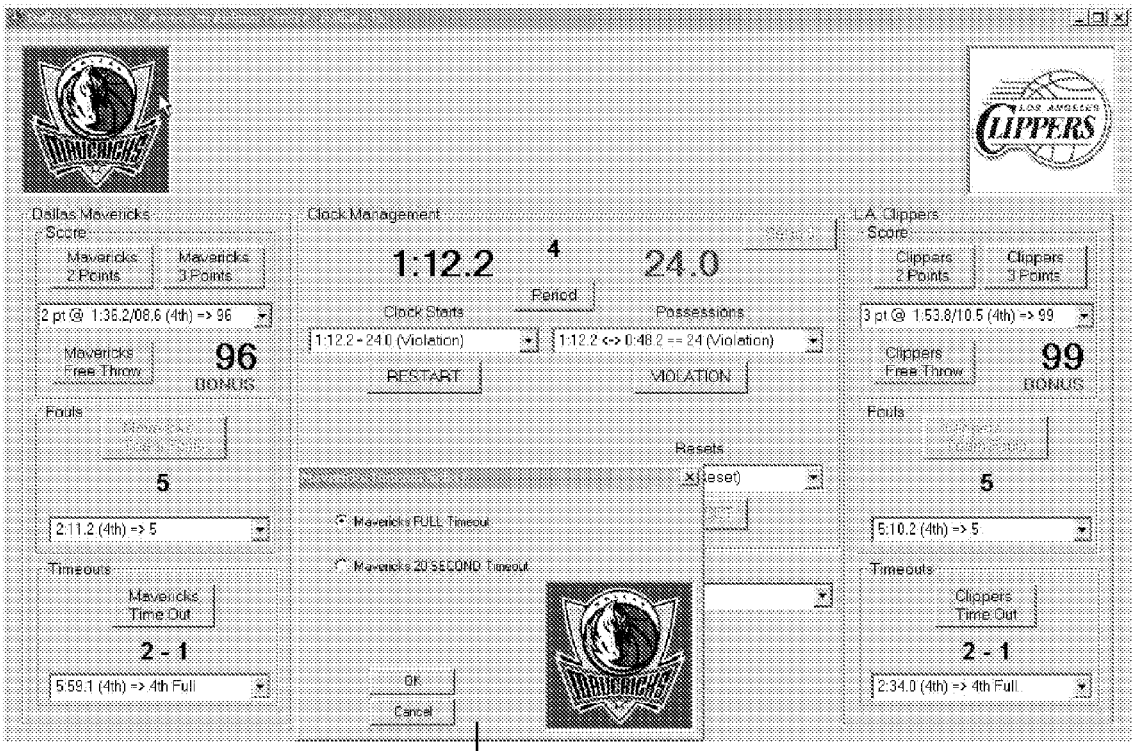
FIG. 27 is another example of a graphical user interface according to at least one aspect of the invention.

FIG. 27 shows an example of the home timeout select dialog box 2700.

Figure 28:
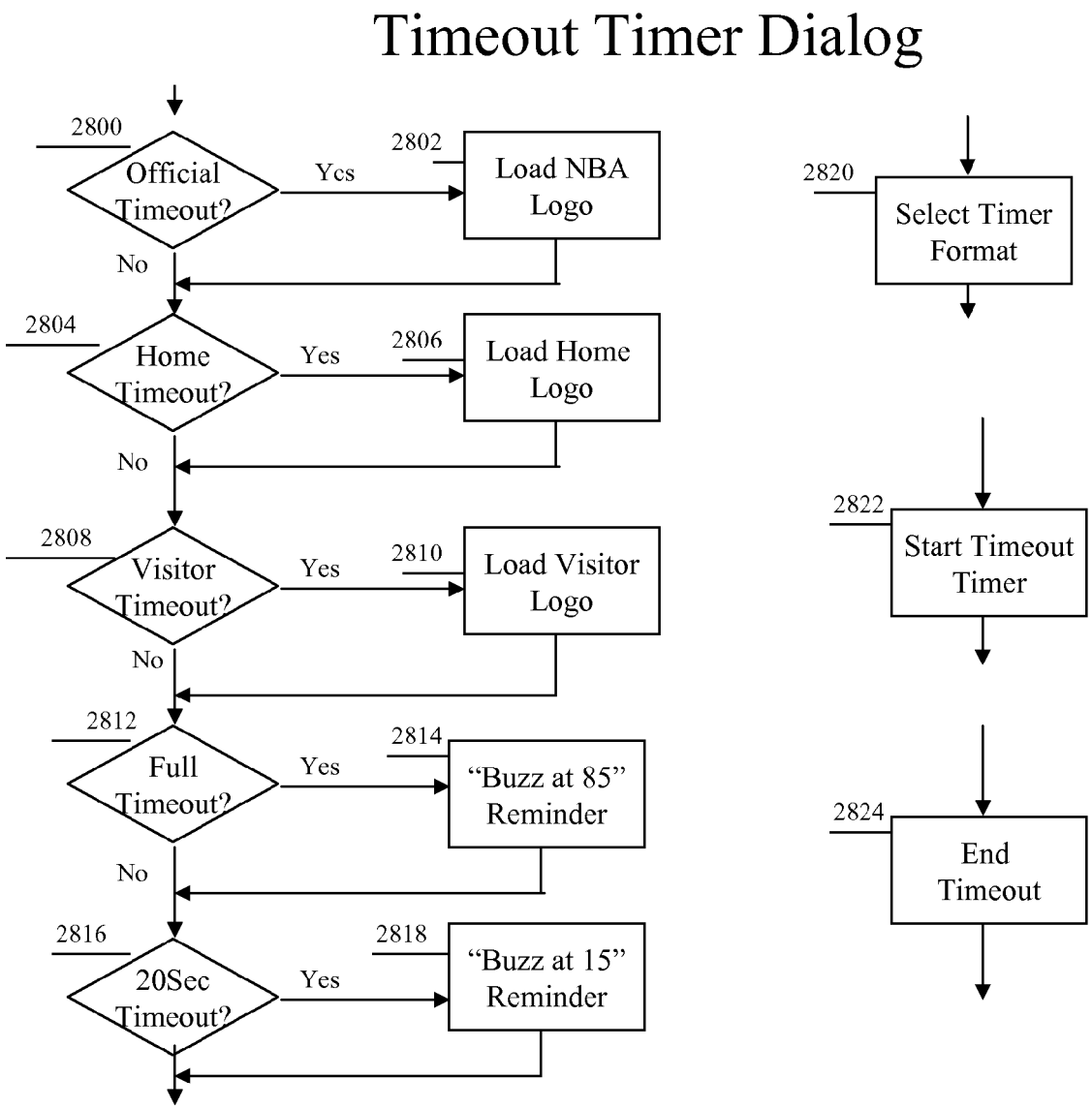
FIG. 28 is a flow chart of the preferred embodiment.
Figure 32:
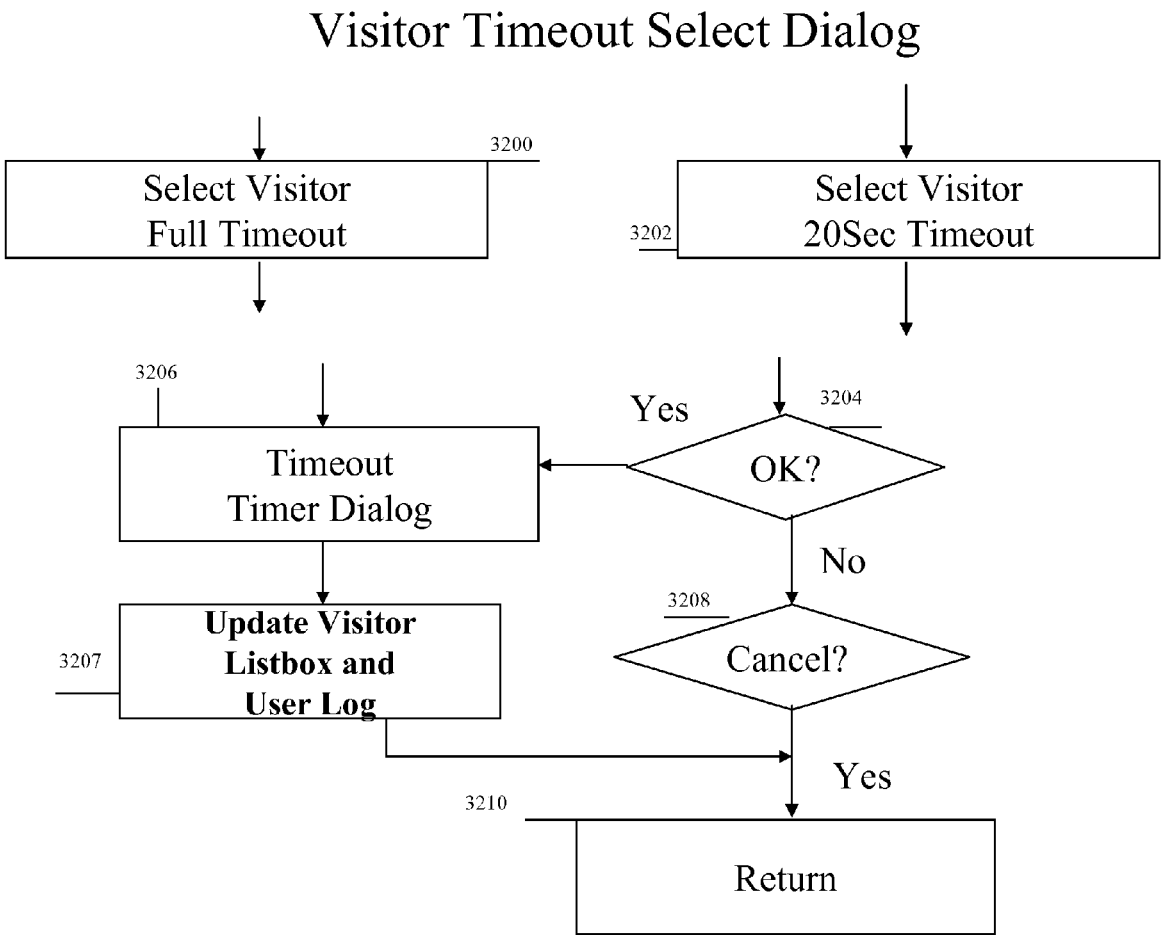

FIG. 28 illustrates details of the timeout timer dialog process called in modules 2606 and 3206 in FIGS. 26 and 32, respectively. The process begins by module 2800 checking to see if it's an official timeout and if so, module 2802 loads the NBA logo. Module 2804 then checks to see if it's a home timeout and if so, module 2806 loads the home logo. Module 2808 then checks to see if it's a visitor timeout and if so, module 2810 loads the visitor logo. The process then continues by checking to see if it's a full timeout in module 2812 and if so, module 2814 sets a 'buzz at 85 seconds' reminder. Module 2816 then checks to see if a 20 second timeout is called and if so, module 2818 sets a 'buzz at 15 seconds' reminder. The process then continues with module 2820 which allows the user to choose a timer format and module 2822 allows the user to start the timeout timer. The process then ends with module 2824 ending the timeout and closing the dialog.

Figure 29:
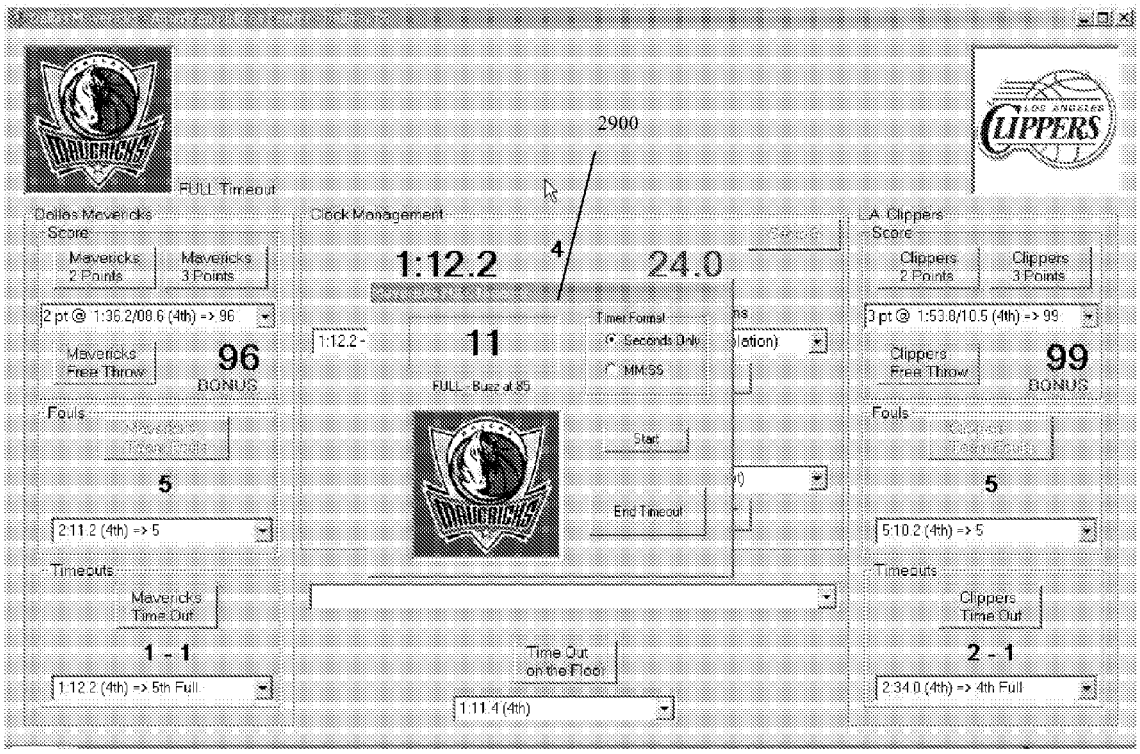
FIG. 29 is another example of a graphical user interface according to at least one aspect of the invention.

FIG. 29 illustrates an example of a timer dialog box, 2900, during a home full timeout.

Figure 30:
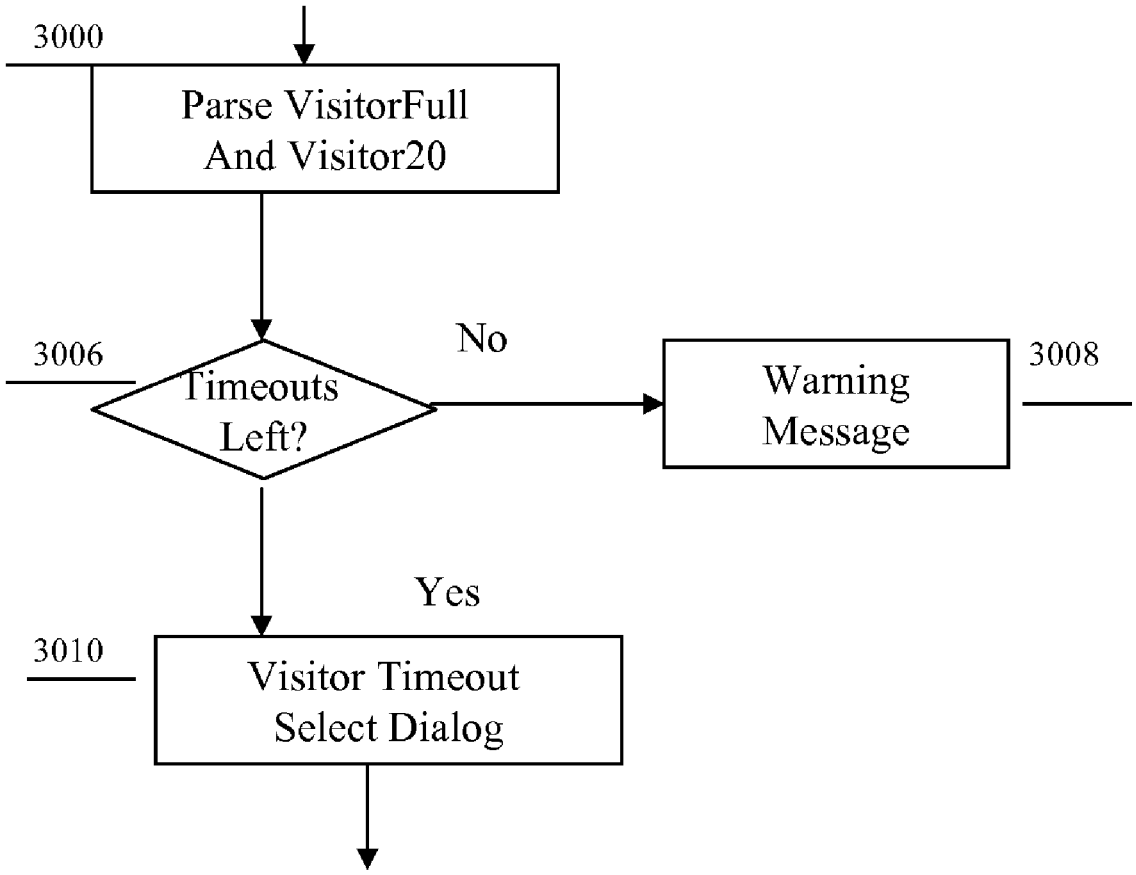
FIGS. 30-78 are flow charts of the preferred embodiment.

FIG. 30 illustrates the visitor timeout handler process called in module 318 in FIG. 3. The process first starts with module 3000 parsing visitor full and visitor 20. The process then proceeds to check if there are any visitor timeouts left in module 3006 and if not, module 3008 displays a warning message and exits. If there are timeouts left, module 3010 calls the visitor timeout select dialog (as depicted FIG. 31).

Figure 31:
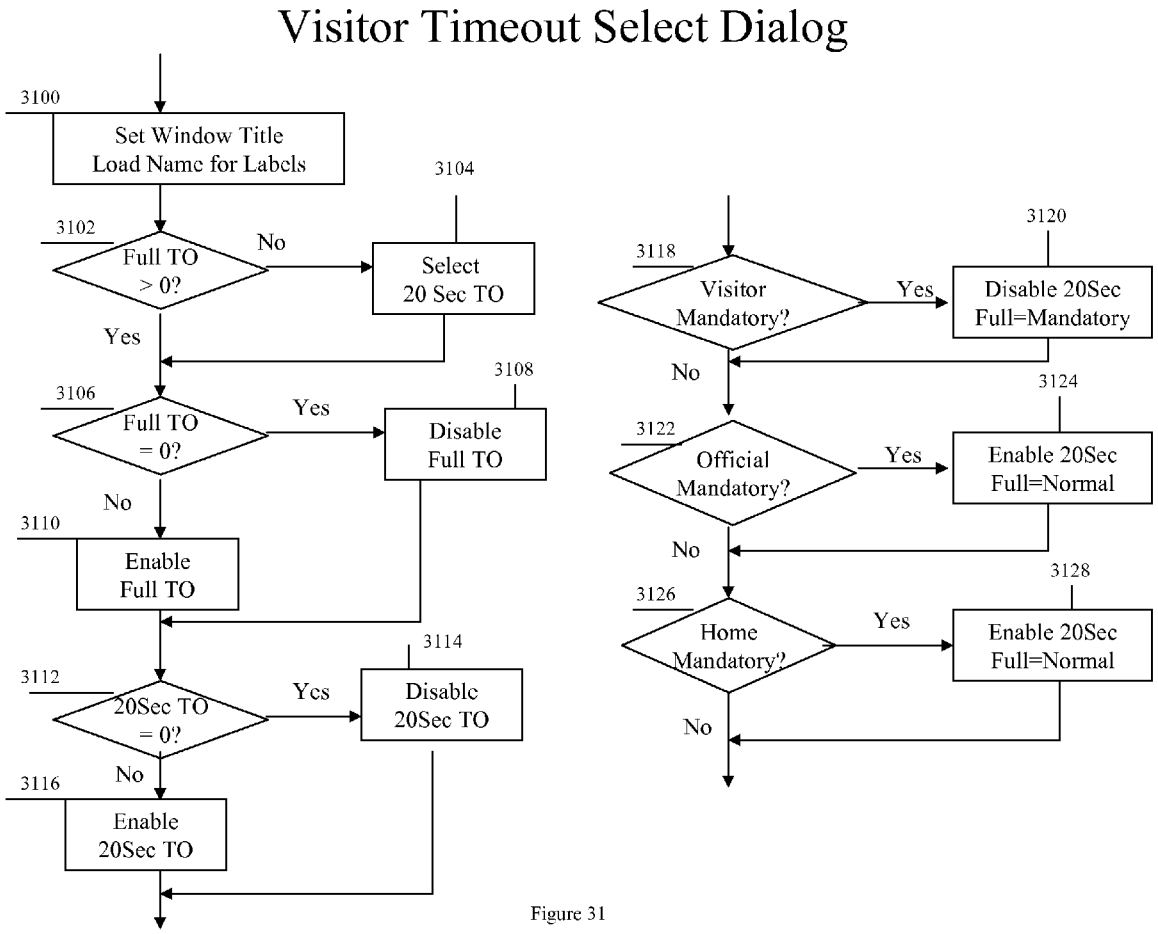

FIG. 31 illustrates details for the visitor timeout select dialog process called in module 3010 in FIG. 30. The process first starts with module 3100 setting window title to visitor team name and load visitor name for labels. Module 3102 then checks to see if the visitor full timeouts are greater than 0 and if not, module 3104 selects a visitor 20 second timeout. Module 3106 then checks to see if the visitor full timeouts equals 0 and if so, module 3108 disables visitor full timeouts. If full timeouts don't equal 0, module 3110 enables visitor full timeouts, while module 3112 checks to see if the visitor 20 second timeout is equal to 0. If so, module 3114 disables the visitor 20 second timeout. If visitor 20 second timeout does not equal 0, module 3116 enables the visitor 20 second timeout. Module 3118 then checks to see if the visitor team requires a mandatory timeout and if so, module 3120 disables the visitor 20 second timeout and makes the full timeout mandatory. The process then checks to see if an official timeout is required in module 3122 and if so, module 3124 enables the visitor 20 second timeout and enables the visitor full timeout. The process then checks to see if the home team requires a mandatory timeout in module 3126, and if so module 3128 enables the visitor 20 second timeout and enables the visitor full timeout.

FIG. 32 illustrates continued details of the visitor timeout select dialog process from FIG. 31. The user can either select a visitor full timeout as indicated by module 3200 or a visitor 20 second timeout as indicated by module 3202. The process then checks to see if the OK button is pressed in module 3204 and if so, the timeout timer dialog (depicted in FIG. 28) is called in module 3206 and upon returning from the dialog box, the visitor timeout listbox and user log are updated in module 3207. The process also checks to see if the cancel button was pressed in module 3208 and if so, module 3210 returns out of this dialog.

Figure 33:
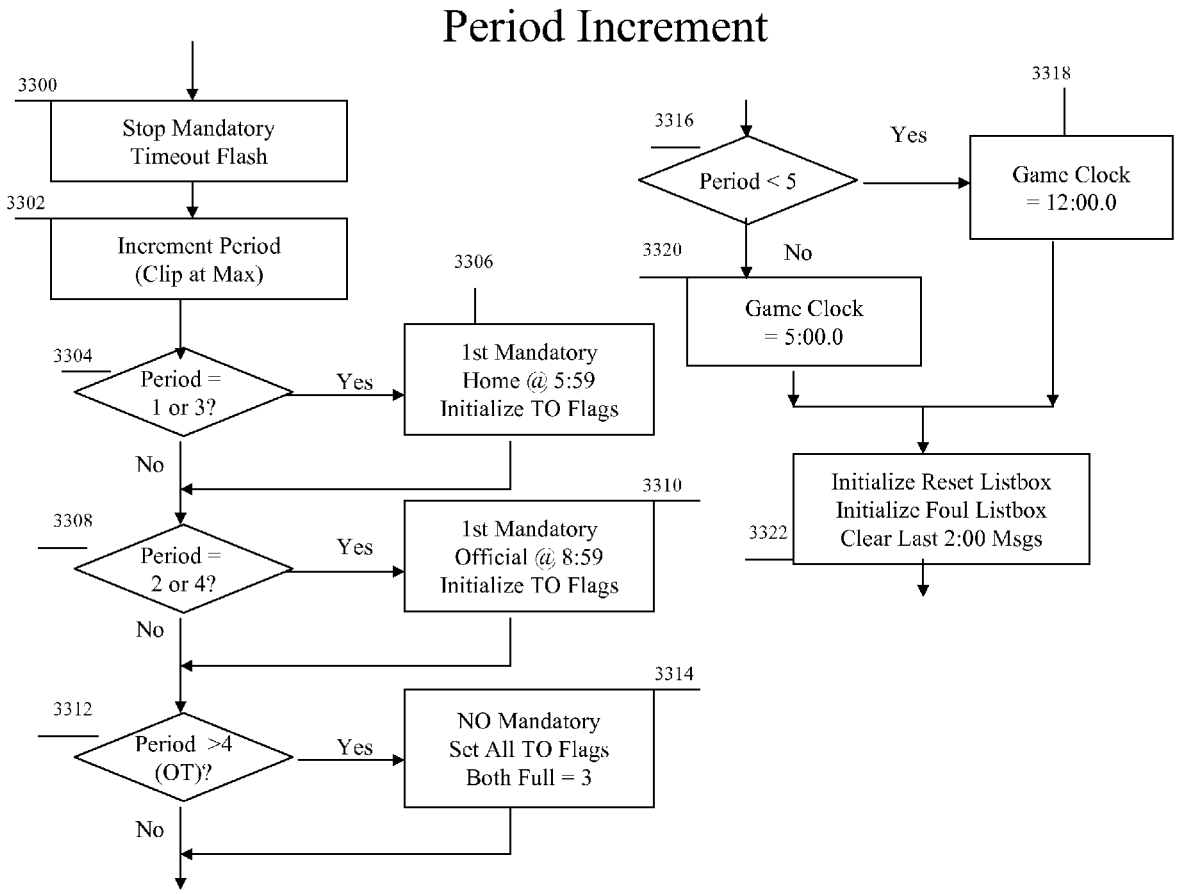

FIG. 33 illustrates the period increment process called from module 404 in FIG. 4. The process begins with module 3300 stopping the mandatory timeout flash and increments the period (clipping to maximum) in module 3302. Module 3304 then checks to see if the period is 1 or 3 and if so, module 3306 sets the 1$^{st}$ mandatory timeout to home at 5:59 and initializes the timeout flags. Module 3308 then checks to see if the period is 2 or 4 and if so, set the 1$^{st}$ mandatory timeout to official at 8:59 and initializes timeout flags in module 3310. Module 3312 checks to see if the period is greater than 4 (overtime) and if so, module 3314 sets timeout flags for no mandatory timeouts and sets both team full timeouts to 3. Module 3316 then checks to see if the period is less than 5, and if so, module 3318 sets the game clock to 12:00.0. If the period is equal to or greater than 5, module 3320 sets the game clock to 5:00.0. Module 3322 then initializes the reset listbox, the team foul listboxes, bad reset listbox, restart listbox and clears the 'last 2:00' messages.

Figure 34:
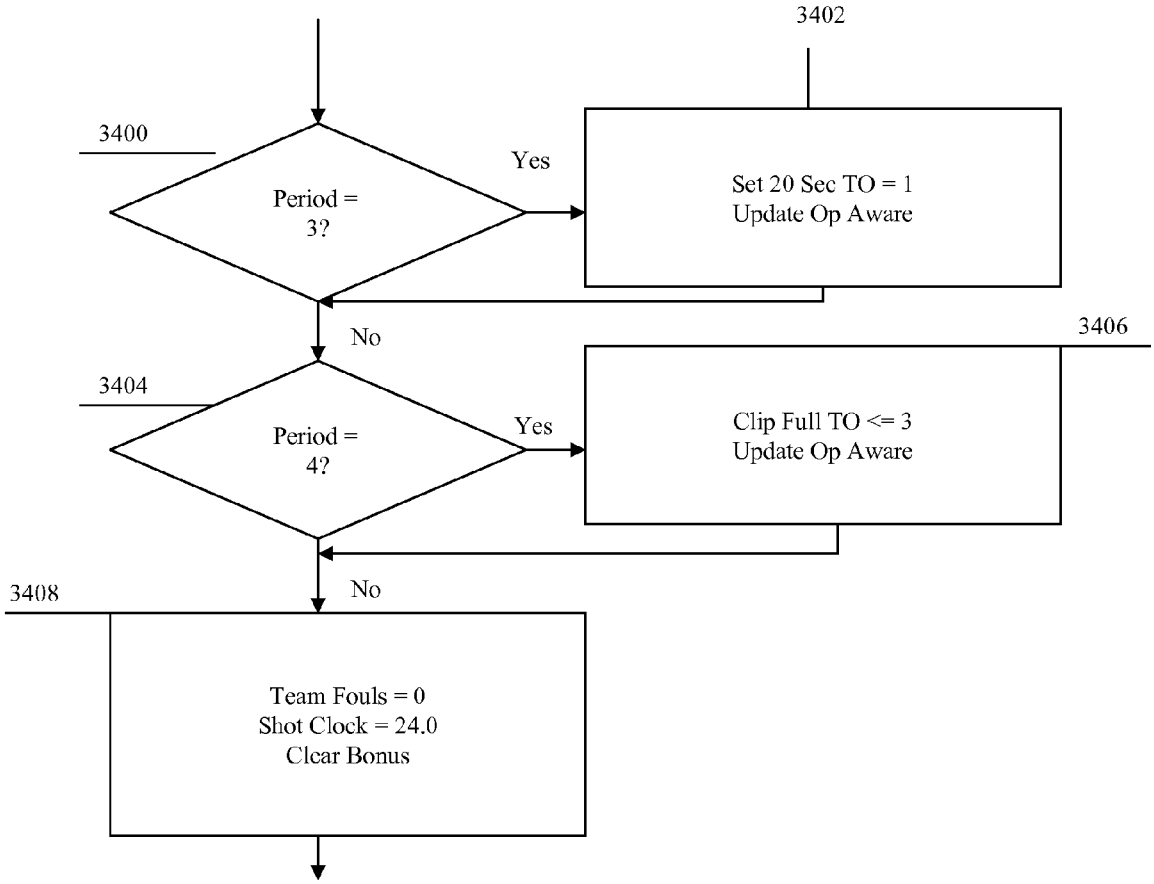

FIG. 34 continues with the illustration of the period increment started in FIG. 33. The process continues with module 3400 checking to see if the period is 3 and if so, module 3402 sets both team 20 second timeouts to 1 and updates ops aware listbox. Module 3404 then checks to see if the period is 4 and if so, module 3406 clips both team's full timeouts to less than or equal to 3 and updates ops aware listbox. Module 3408 then sets the both team's fouls equal to 0, sets the shot clock at 24.0 and clear both team's bonus.

Figure 35:
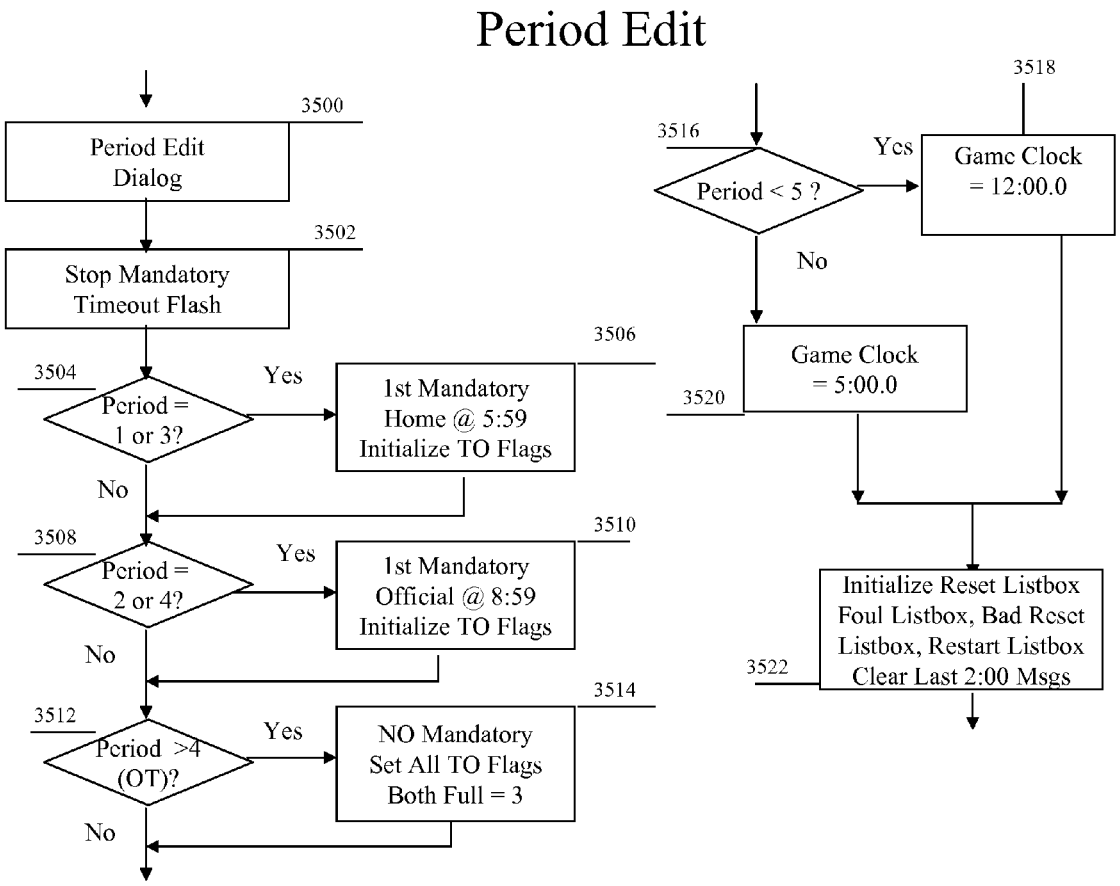

FIG. 35 illustrates the period edit process called in module 406 in FIG. 4. The process begins with module 3500, which calls the Period edit dialog (as depicted FIG. 37). Upon return from period edit dialog, module 3502 stops the mandatory timeout flash. Module 3504 then checks to see if the period is 1 or 3 and if so, module 3506 sets the 1$^{st}$ mandatory timeout to home at 5:59 and initializes the timeout flags. Module 3508 then checks to see if the period is 2 or 4 and if so, module 3510 sets the 1$^{st}$ mandatory timeout to official at 8:59 and initializes timeout flags. Module 3512 checks to see if the period is greater than 4 (overtime) and if so, module 3514 sets timeout flags to no mandatory and both team's full timeouts to 3. Module 3516 then checks to see if the period is less than 5, and if so, module 3518 sets the game clock to 12:00.0. If the period is equal to or greater than 5, module 3520 sets the game clock to 5:00.0. Module 3522 then initializes the reset listbox, the foul listbox, bad reset listbox, restart listbox and clears the 'last 2:00' messages.

Figure 36:
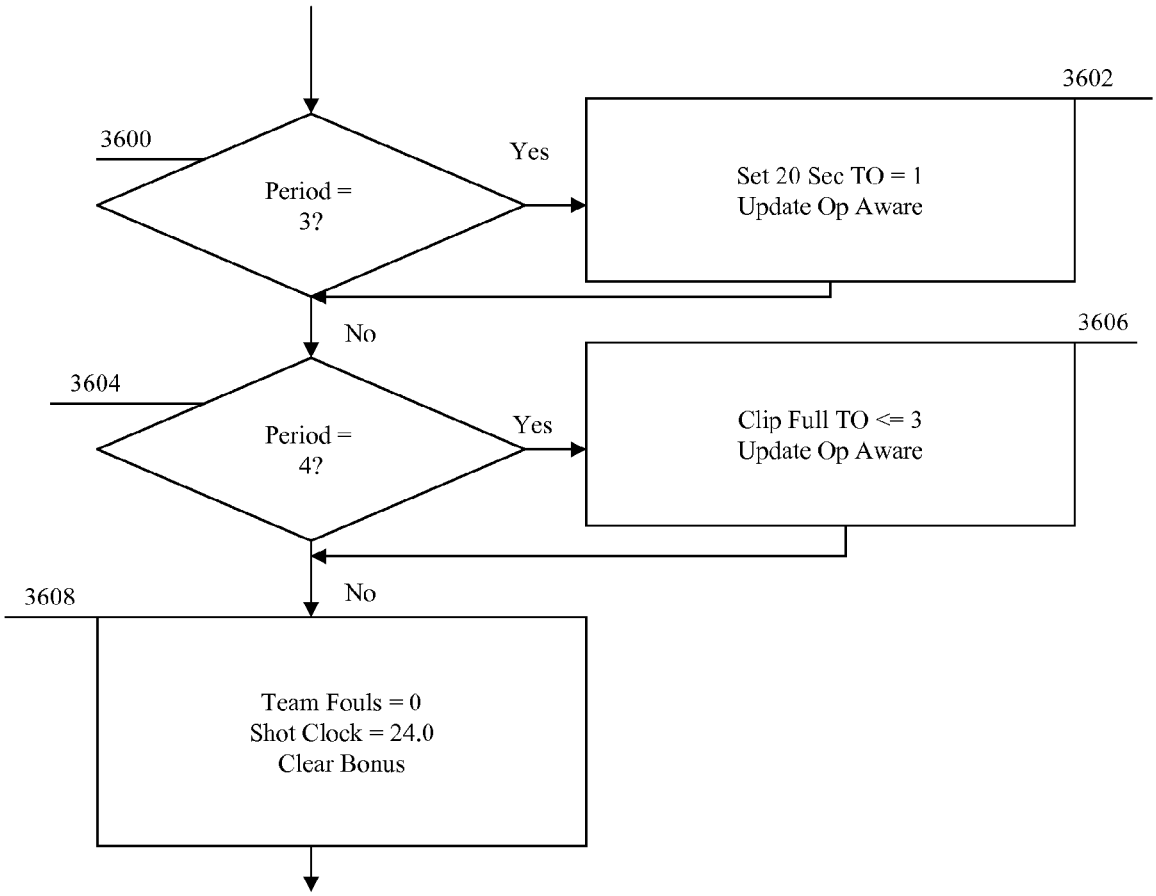

FIG. 36 continues with the illustration of the period edit process started in FIG. 35. The process continues with module 3600 checking to see if the period is 3 and if so, module 3602 sets both teams' 20 second timeout equal to 1 and updates ops aware listbox. Module 3604 then checks to see if the period is 4 and if so, module 3606 sets both team's full timeouts to less than or equal to 3 and updates ops aware listbox. Module 3608 then sets the both team's fouls equal to 0, sets the shot clock at 24.0 and clear both team's bonus.

Figure 37:
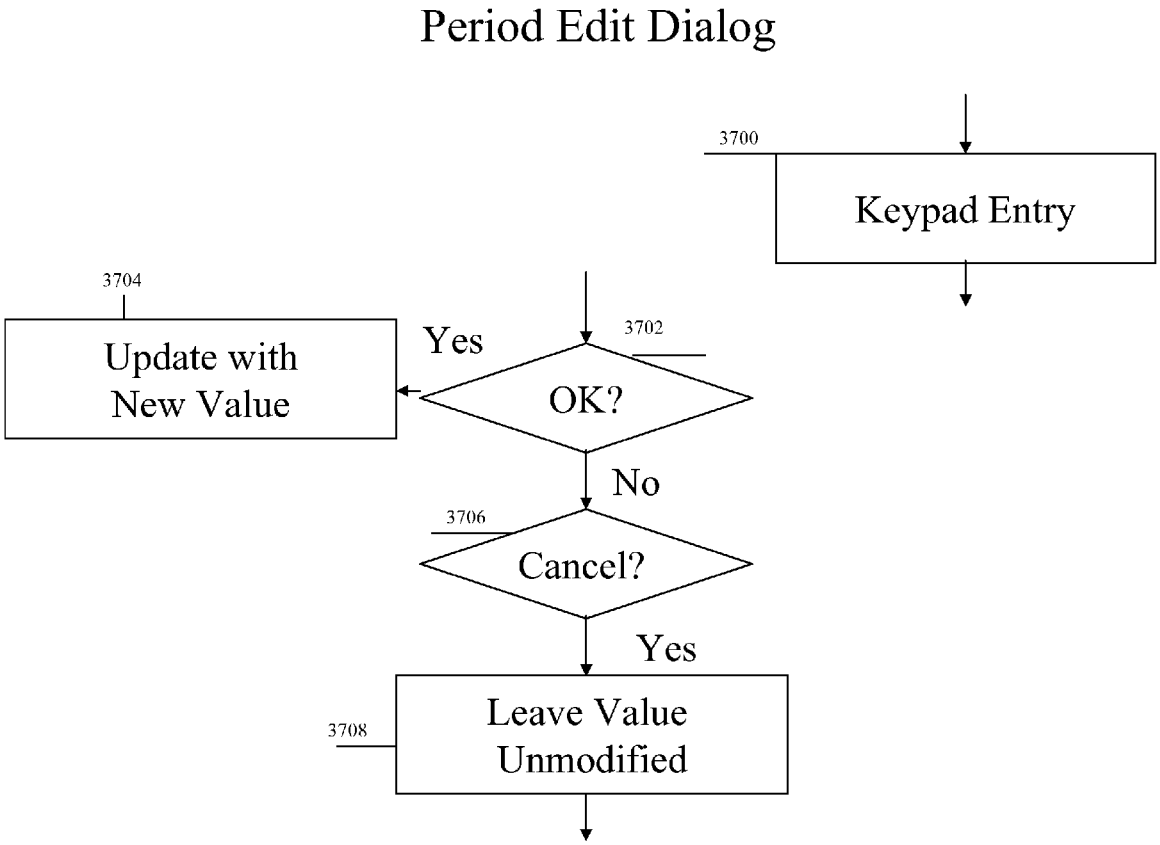

FIG. 37 illustrates the period edit dialog called in module 3500 in FIG. 35. Module 3700 allows for keypad entries while module 3702 checks to see if the OK button has been pressed. If so, module 3704 updates the period with the new value. Module 3706 checks to see if the cancel button has been pressed and if so, module 3708 leaves all the values unmodified and returns to the main routine.

Figure 38:
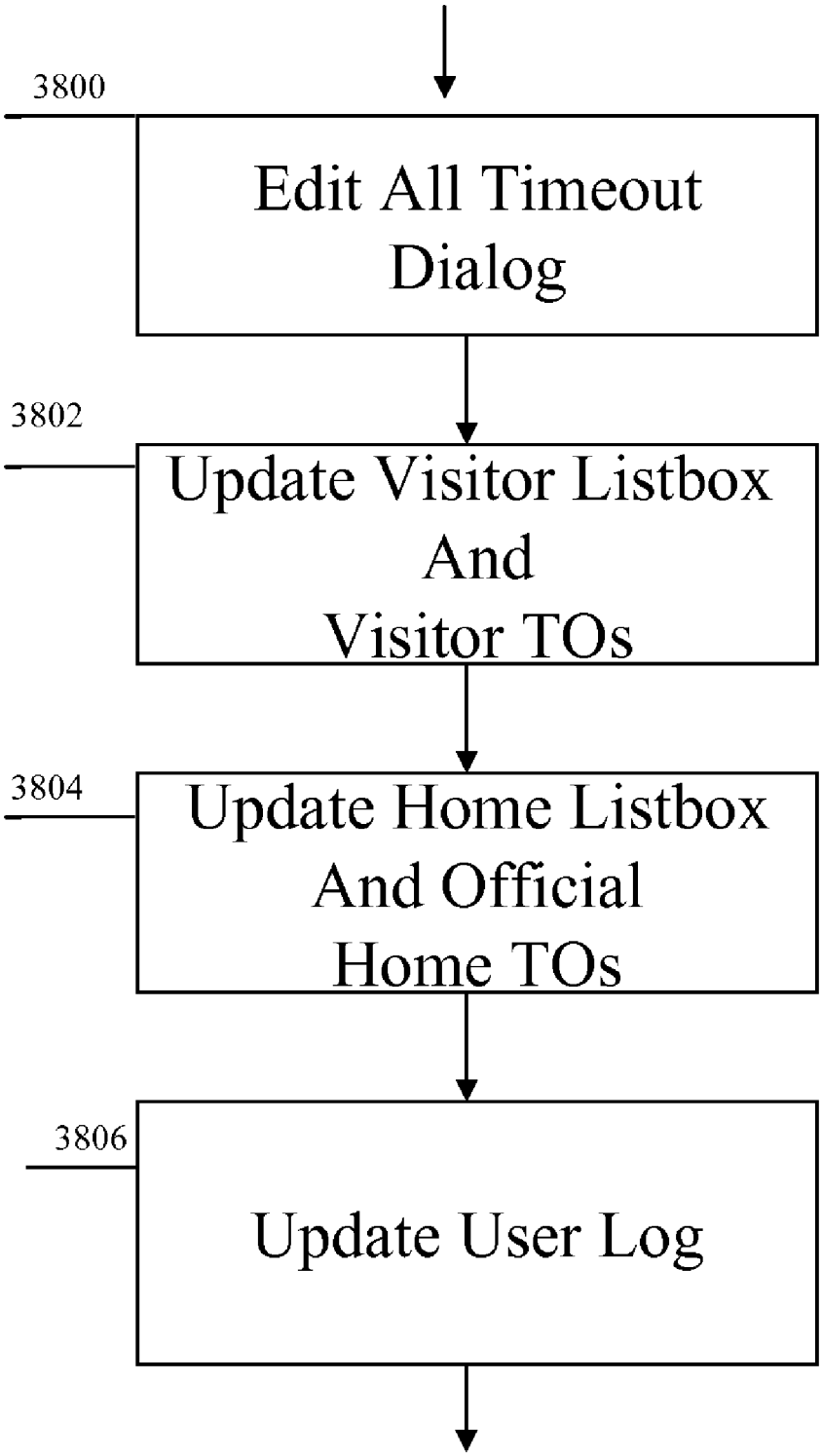
Figure 40:
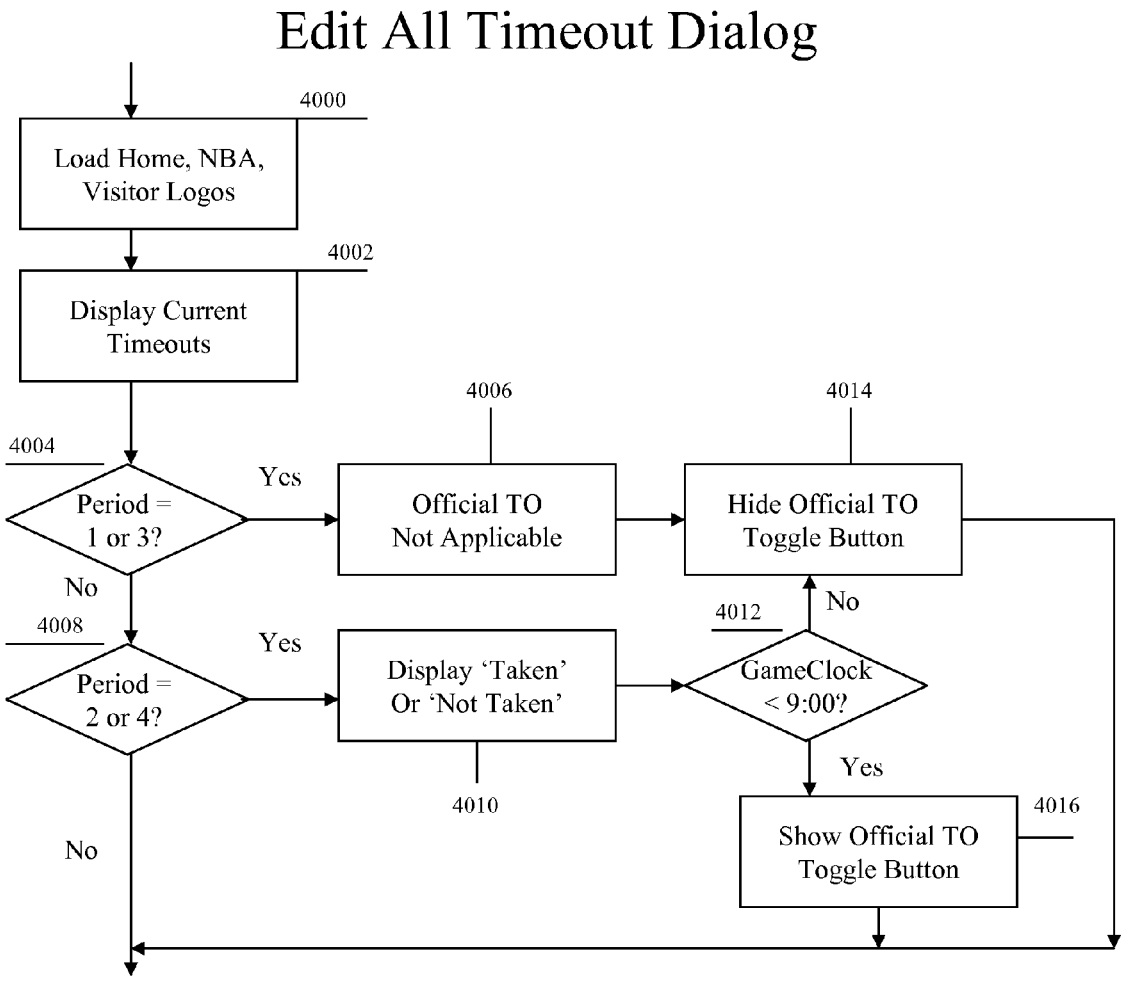

FIG. 38 illustrates the home timeout edit process called in module 400 in FIG. 4. Module 3800 starts by calling the edit all timeout dialog (as depicted in FIG. 40). Upon return, module 3802 updates the visitor timeout listbox and visitor timeouts. Module 3804 updates the home timeout listbox and the home timeouts. Module 3806 updates the user log.

Figure 39:
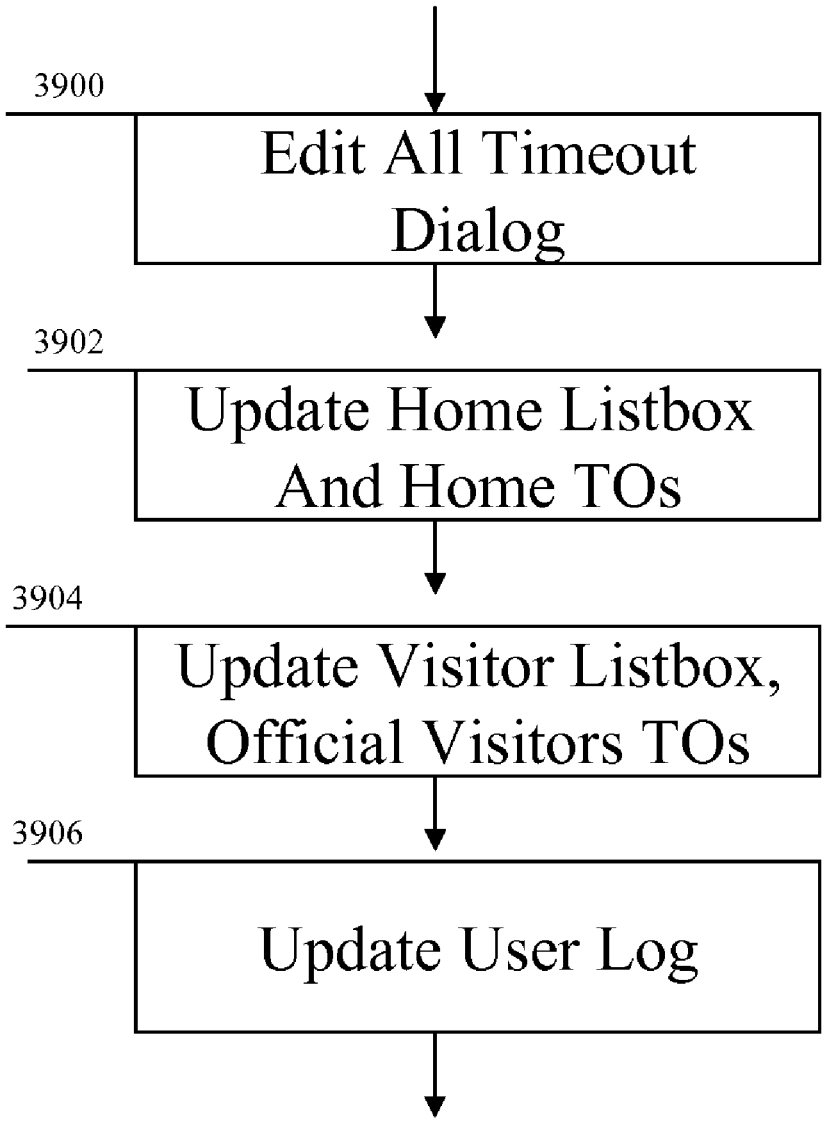

FIG. 39 illustrates the visitor timeout edit process called in module 402 in FIG. 4. Module 3900 starts by calling the edit all timeout dialog (as depicted in FIG. 40). Upon return from the dialog, module 3902 updates the home timeout listbox and home timeouts. Module 3904 updates the visitor timeout listbox and the visitor timeouts. Module 3906 updates the user log.

FIG. 40 illustrates the all timeout edit dialog called from modules 3800 and 3900 in FIGS. 38 and 39, respectively. Module 4000 loads the home, visitor and NBA logos. Module 4002 then displays the current timeouts while module 4004 then checks to see if the period is 1 or 3. If so, module 4006 determines that official timeout is not applicable and hides the official timeout button in module 4014. Module 4008 then checks to see if the period is 2 or 4. If so, module 4010 displays official timeout taken or not taken. Module 4012 then checks to see if the game clock is less than 9 minutes and if so, module 4014 hides the official timeout toggle button. If the game clock is equal to or more than 9 minutes, module 4016 shows the official timeout toggle button.

Figure 41:
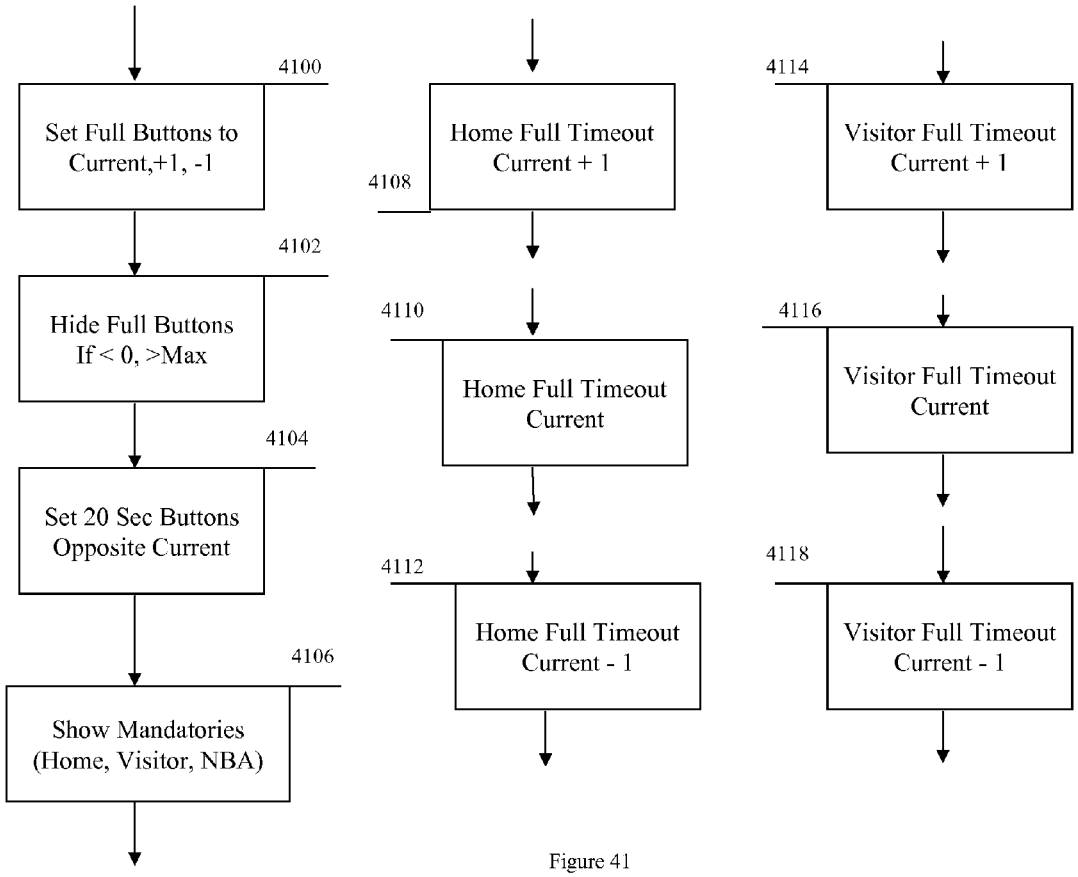

FIG. 41 continues the all timeout edit dialog from FIG. 40. Module 4100 sets both team's full timeout buttons to current timeouts plus 1, current timeouts minus 1 or current timeout. Module 4102 then hides full timeout buttons that calculate to less 0 or greater than maximum. Module 4104 then sets both teams'20 second timeout buttons to opposite current value. Module 4106 then shows mandatory timeouts for the home, visitor and NBA. Module 4108 allows the user to set the home full timeout to current plus 1, while module 4110 allows the user to set the home full timeout to current. Similarly, module 4112 allows the user to set the home full timeout to current minus 1. Similarly, module 4114 allows the user to set the visitor full timeout to current plus 1. While module 4116 sets the visitor full timeout to current depending on what the user indicates. Similarly, module 4118 allows the user to set the visitor full timeout to current minus 1.

Figure 42:
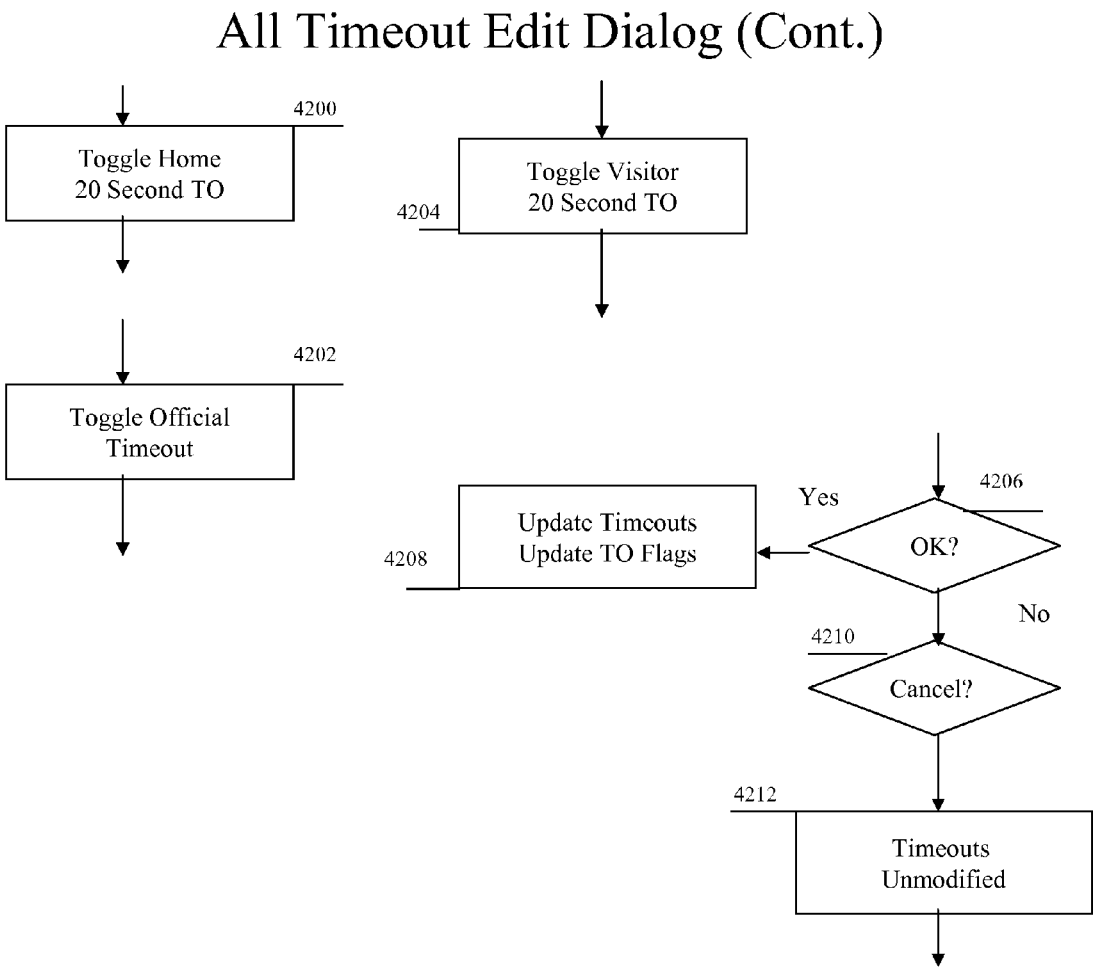

FIG. 42 continues the all timeout edit dialog from FIGS. 40 and 41. Module 4200 allows the user to toggle the home 20 second timeout while module 4202 allows the user to toggle the official timeout and module 4204 allows the user to toggle the visitor 20 second timeout. Module 4206 then checks to see if the user presses the OK button and if so, module 4208 updates the timeouts and timeout flags. Module 4210 also checks to see if the user presses the cancel button and if so, module 4212 leaves the timeouts and flags unmodified and exits to the main routine.

Figure 43:
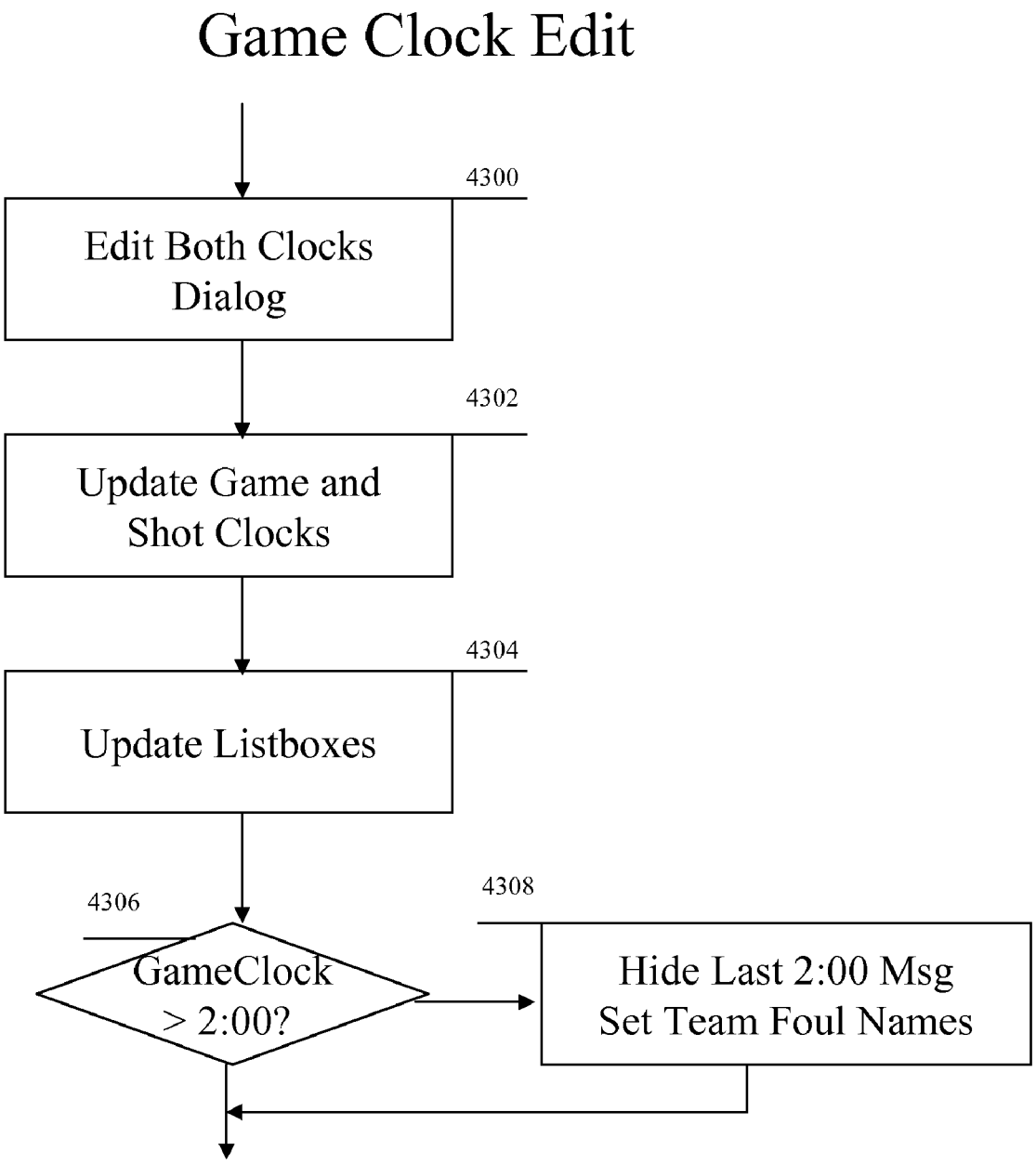

FIG. 43 illustrates the game clock edit process called in module 408 in FIG. 4. Module 4300 calls the edit both clocks dialog (depicted in FIG. 73). Upon return from the dialog, module 4302 updates the game and shot clocks. Module 4304 updates the listboxes for possessions, resets, and bad reset. Module 4306 checks to see if the game clock is greater than 2 minutes and if so, module 4308 hides the 'last 2:00' message and sets team foul buttons to team names only.

Figure 44:
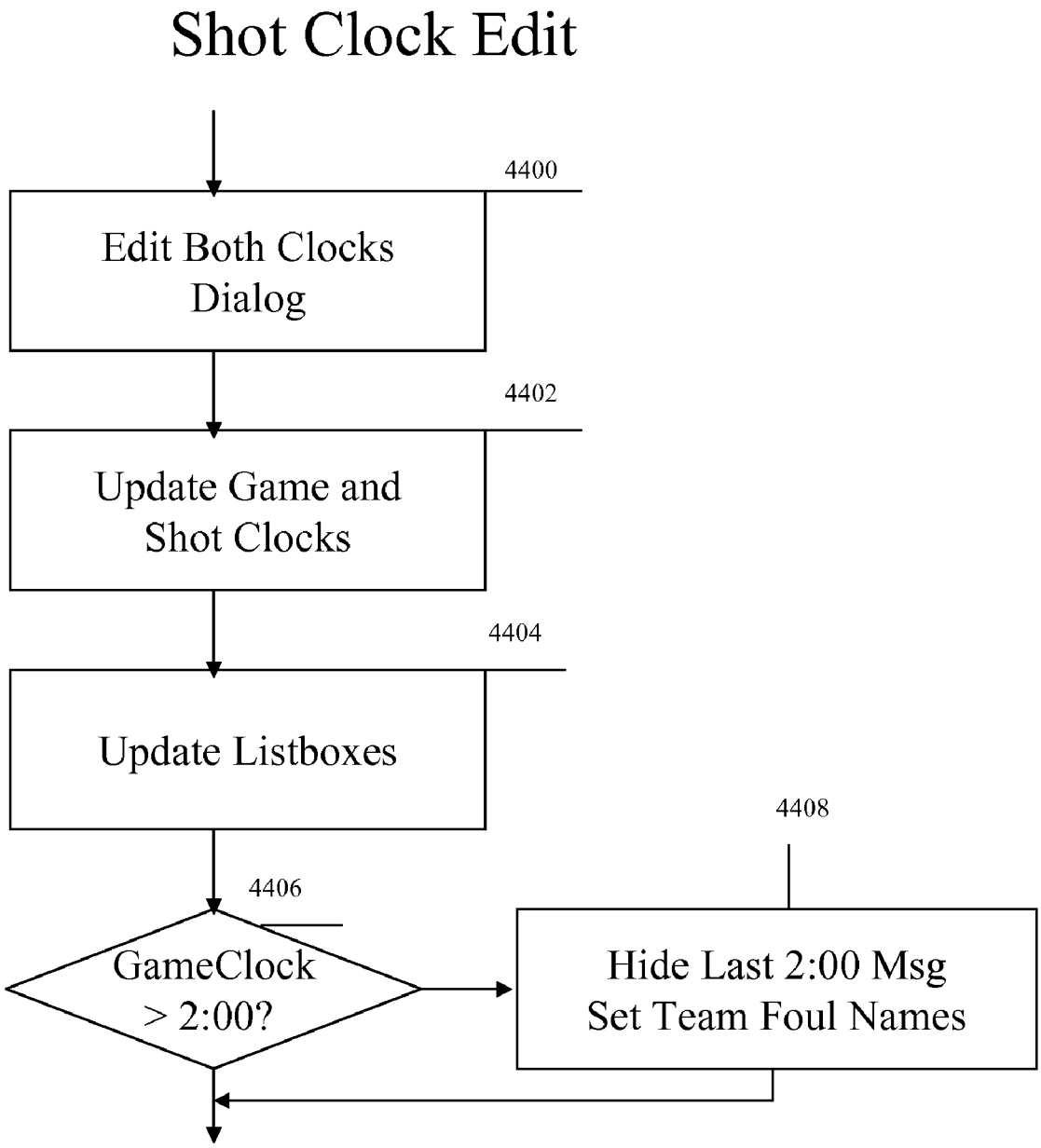

FIG. 44 illustrates the shot clock edit process called in module 410 in FIG. 4. Module 4400 calls the edit both clocks dialog (depicted in FIG. 73). Upon return from the dialog, module 4402 updates the game and shot clocks. Module 4404 updates the listboxes for possessions, resets, and bad reset. Module 4406 checks to see if the game clock is greater than 2 minutes and if so, module 4408 hides the 'last 2:00' message and sets team foul buttons to team names only.

Figure 45:
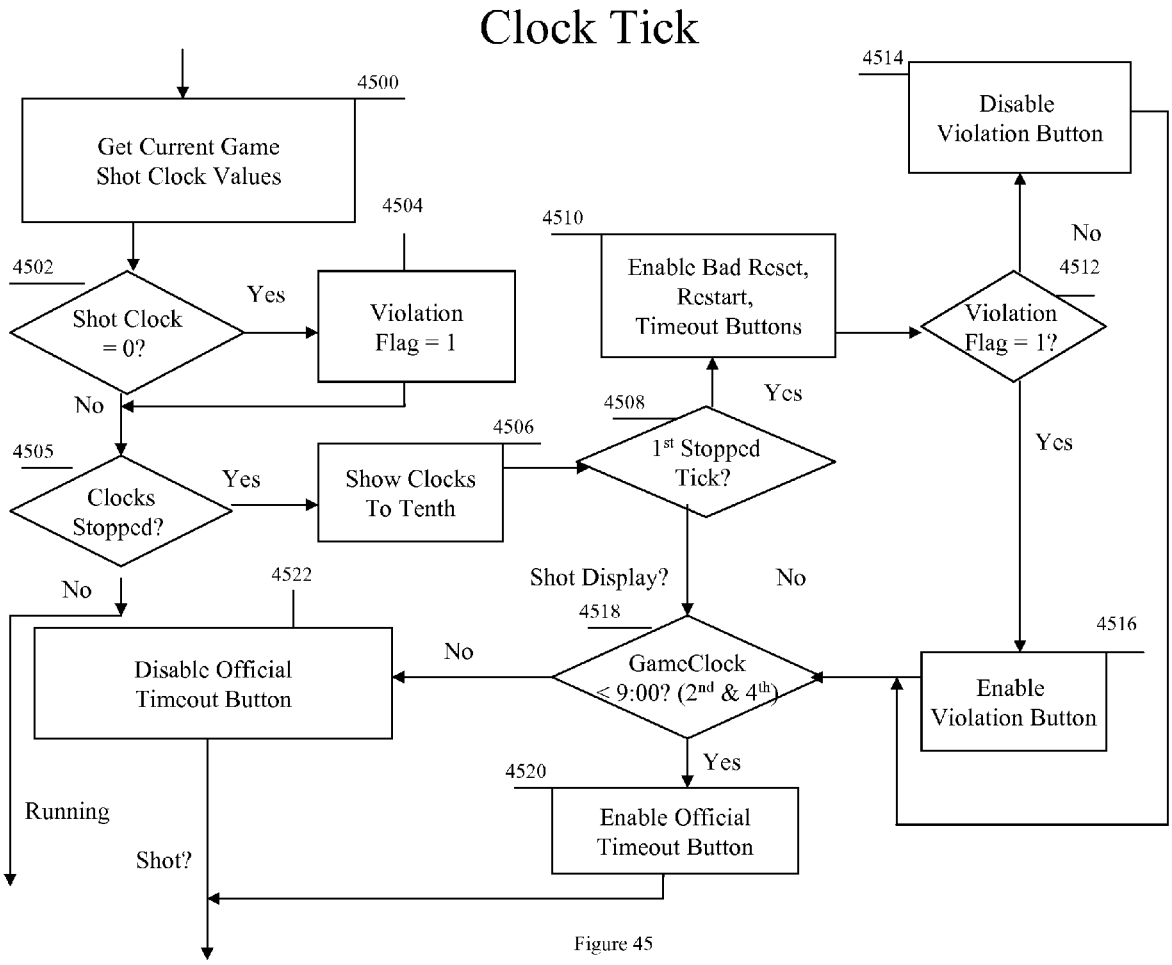

FIG. 45 illustrates the clock tick process initiated in module 412 in FIG. 4. Module 4500 gets the current game and shot clock values while module 4502 checks to see if the shot clock is equal to 0. If it is, module 4504 sets the violation flag to 1. Module 4505 then checks to see if the clocks have stopped. If so, module 4506 displays clocks to the tenth of a second on the local display. Module 4508 then checks to see if this is the 1st tick of a stopped clock. If so, module 4510 enables the bad reset, restart, and timeout buttons. Module 4512 then checks to see if the violation flag is equal to 1 and if not, module 4514 disables violation button. If violation flag is set, module 4516 then enables the violation button while module 4518 checks to see if the game clock is less than 9 minutes of the $2^{nd}$ or $4^{th}$ period. If so, module 4520 enables the official timeout button. If not, module 4522 disables the official timeout button.

Figure 46:
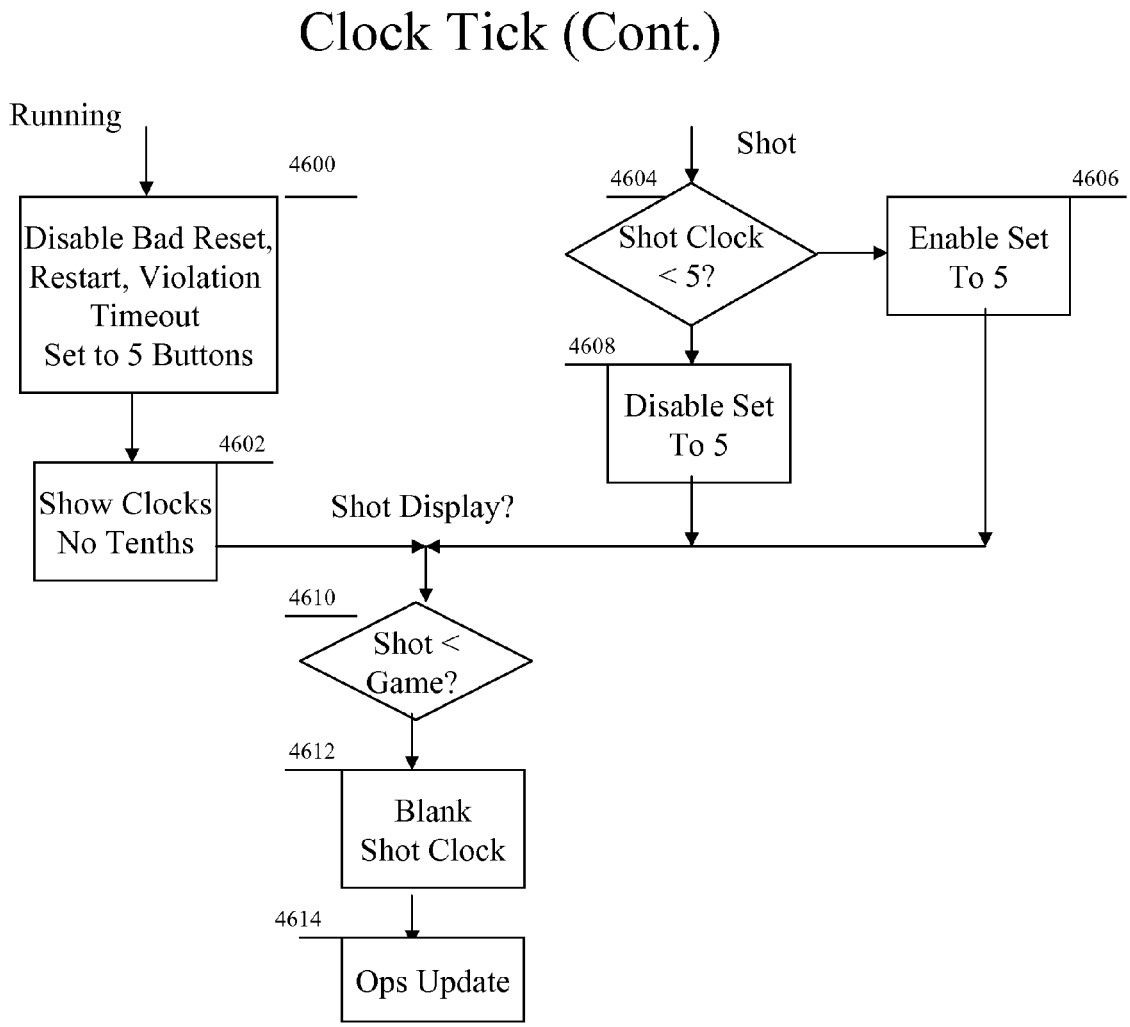
Figure 55:
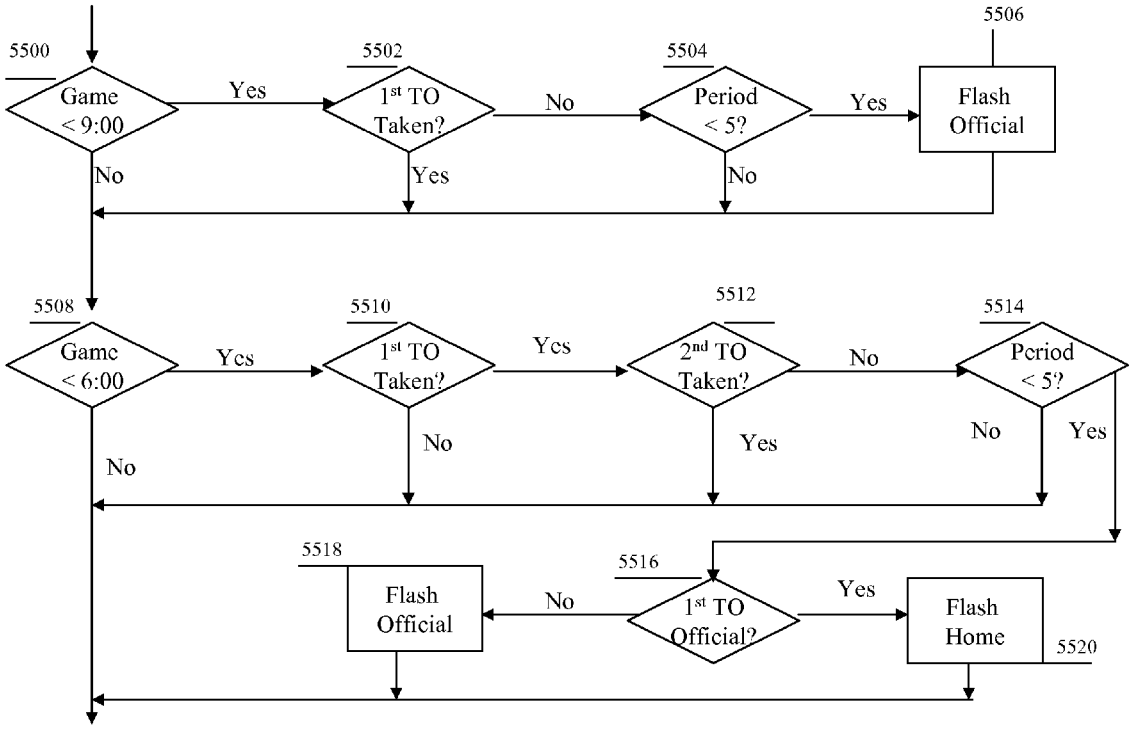

FIG. 46 continues with the clock tick process from FIG. 45. Module 4600 disables the bad reset, the restart, violation, timeouts and 'set to 5' buttons, if the clocks are running. Module 4602 then removes tenths of a second from the local clock display. Module 4604 checks to see if the shot clock is less than 5 seconds with the clock stopped and if so, module 4606 enables the 'set to 5' button. Module 4608 disables the set to 5 if the shot clock is greater than or equal to 5 or the clock is running. The process then continues with module 4610 checking to see if the shot clock is less than the game clock and if so, module 4612 blanks the shot clock. Module 4614 sends ops update message received as illustrated in FIG. 55.

Figure 47:
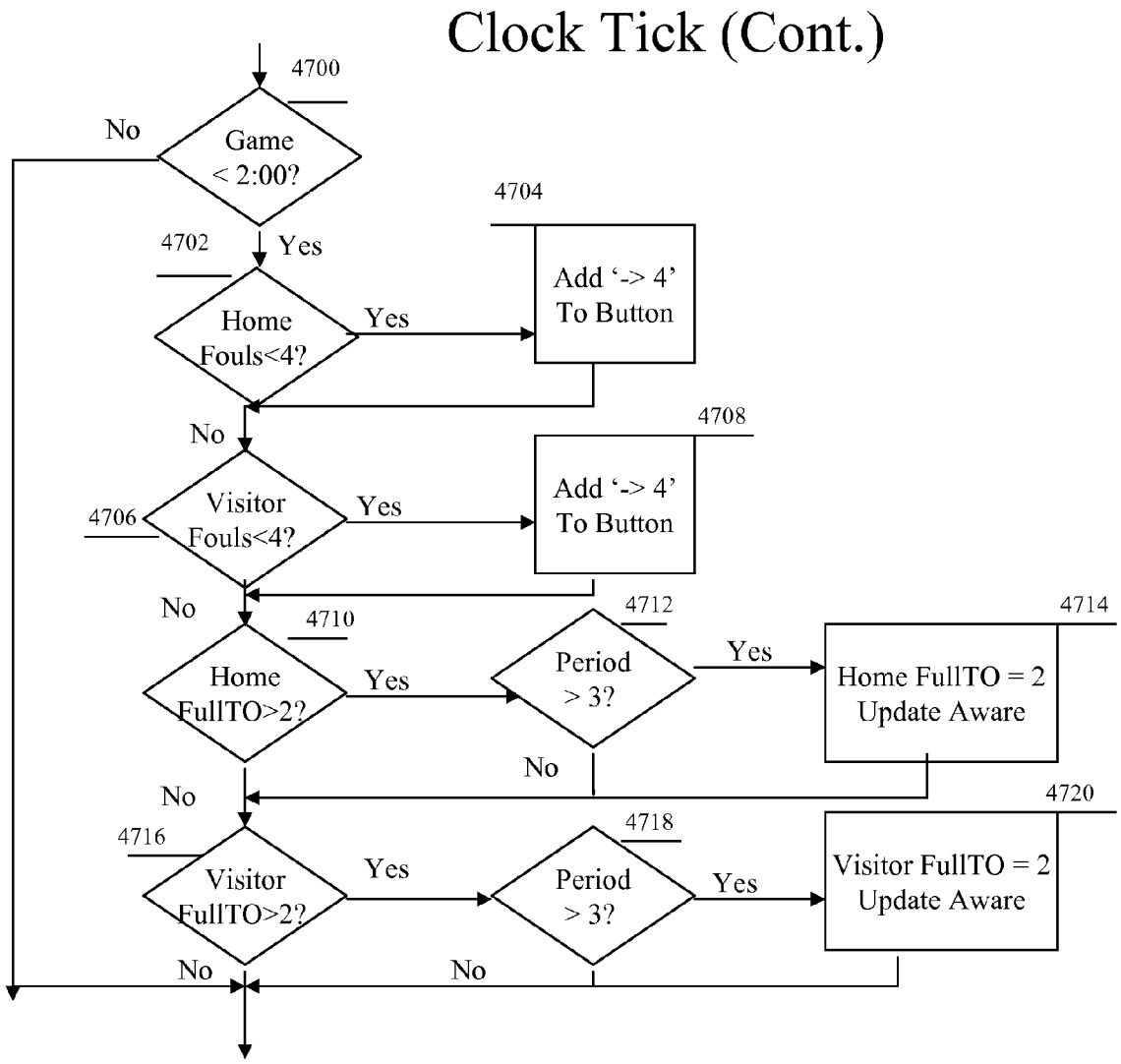

FIG. 47 continues with the clock tick process from FIGS. 45 and 46. Module 4700 checks to see if the game clock is less than 2 minutes. If so, module 4702 checks to see if the home fouls are less than 4. If so, module 4704 then adds a "->4" to the home team foul button to signify that the next home team foul will be the 4th. Module 4706 then checks to see if the visitor fouls are less than 4. If so, module 4708 adds a "->4" to the visitor team foul button to signify that the next visitor team foul will be the 4th. Module 4710 then checks to see if home full timeouts is greater than 2, and if so, module 4712 checks to see if the period is greater than 3. If so, module 4714 sets the home full timeout to 2 and updates "ops aware". Module 4716 then checks to see if the visitor full timeouts is greater than 2, and if so, module 4718 checks to see if the period is greater than 3. If so, module 4720 sets the visitor full timeout to 2 and updates the "ops aware".

Figure 48:
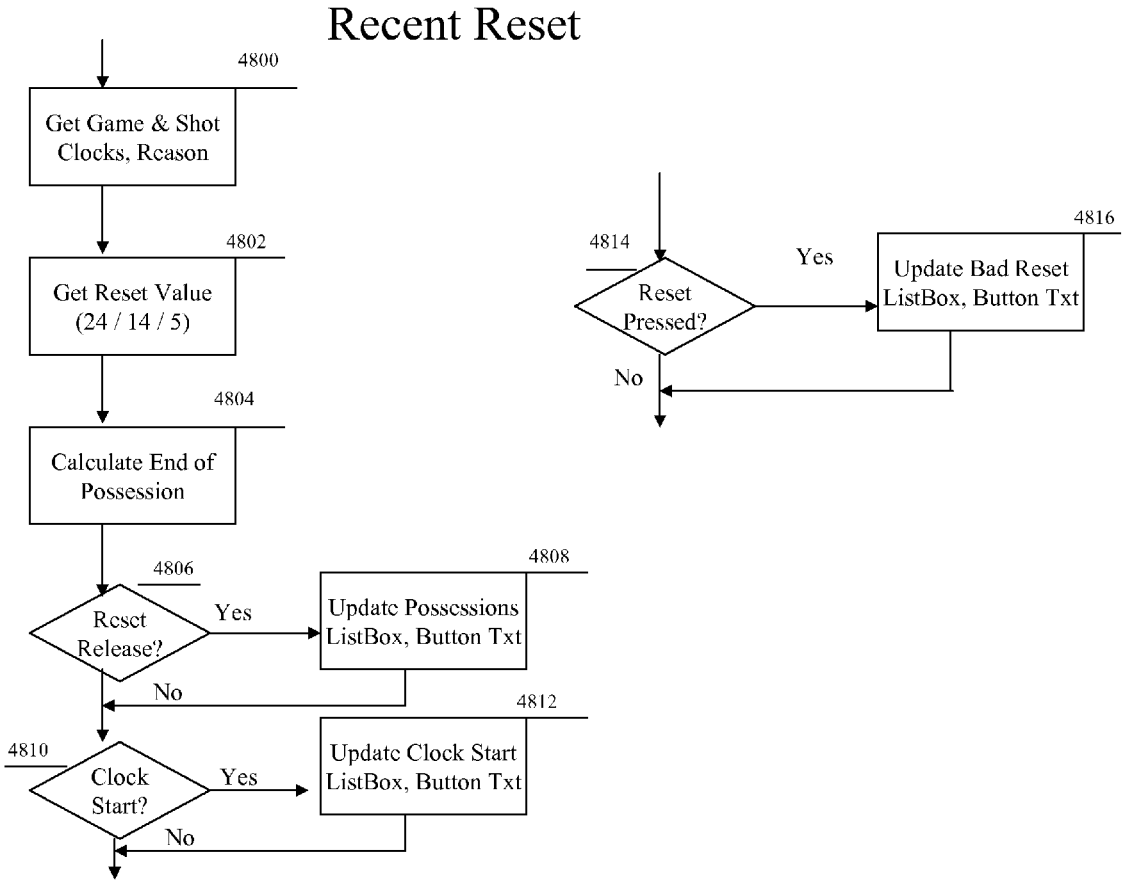

FIG. 48 illustrates the recent reset process. Module 4800 gets the game and shot clocks and the reason for the change in the value of the shot clock. Module 4802 then gets the reset value while module 4804 calculates the end of the possession, based on the current game clock time and the reset value. Module 4806 checks to see if the reset is released and if so, module 4808 updates the possessions listbox and violation button text. Module 4810 then checks to see if the clock has started and if so, module 4812 updates the clock start listbox and the restart button text. Module 4814 then checks to see if the reset is pressed. If so, module 4816 then updates a bad reset listbox and the bad reset button text.

Figure 49:
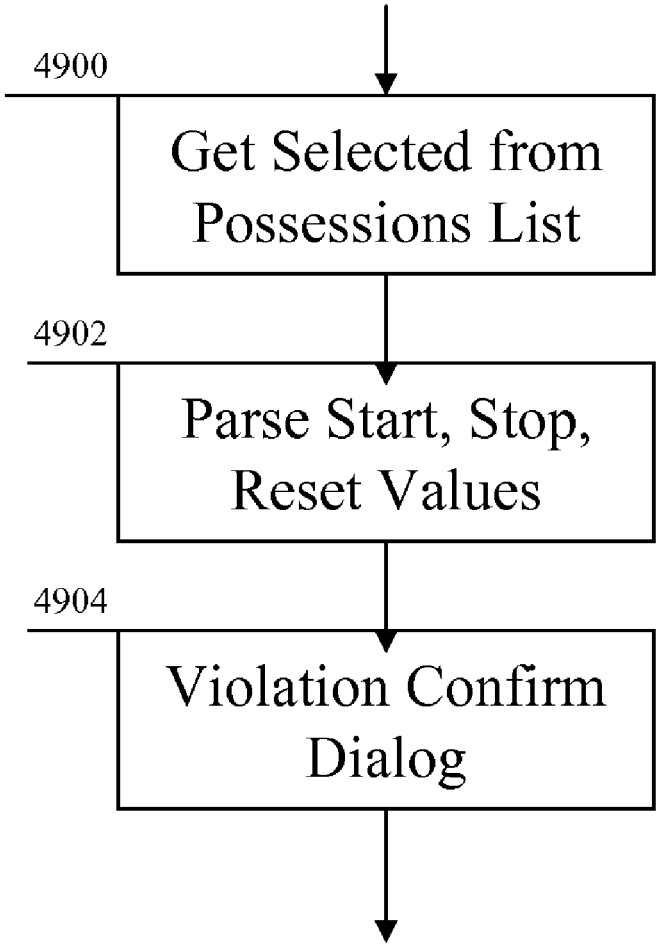

FIG. 49 illustrates the violation recall process called by the violation recall handler in module 416 at FIG. 4. Module 4900 gets the selected possession from the possession list. Module 4902 then parses the start, stop and reset values while module 4904 then calls the violation recall confirm dialog in FIG. 50.

Figure 50:
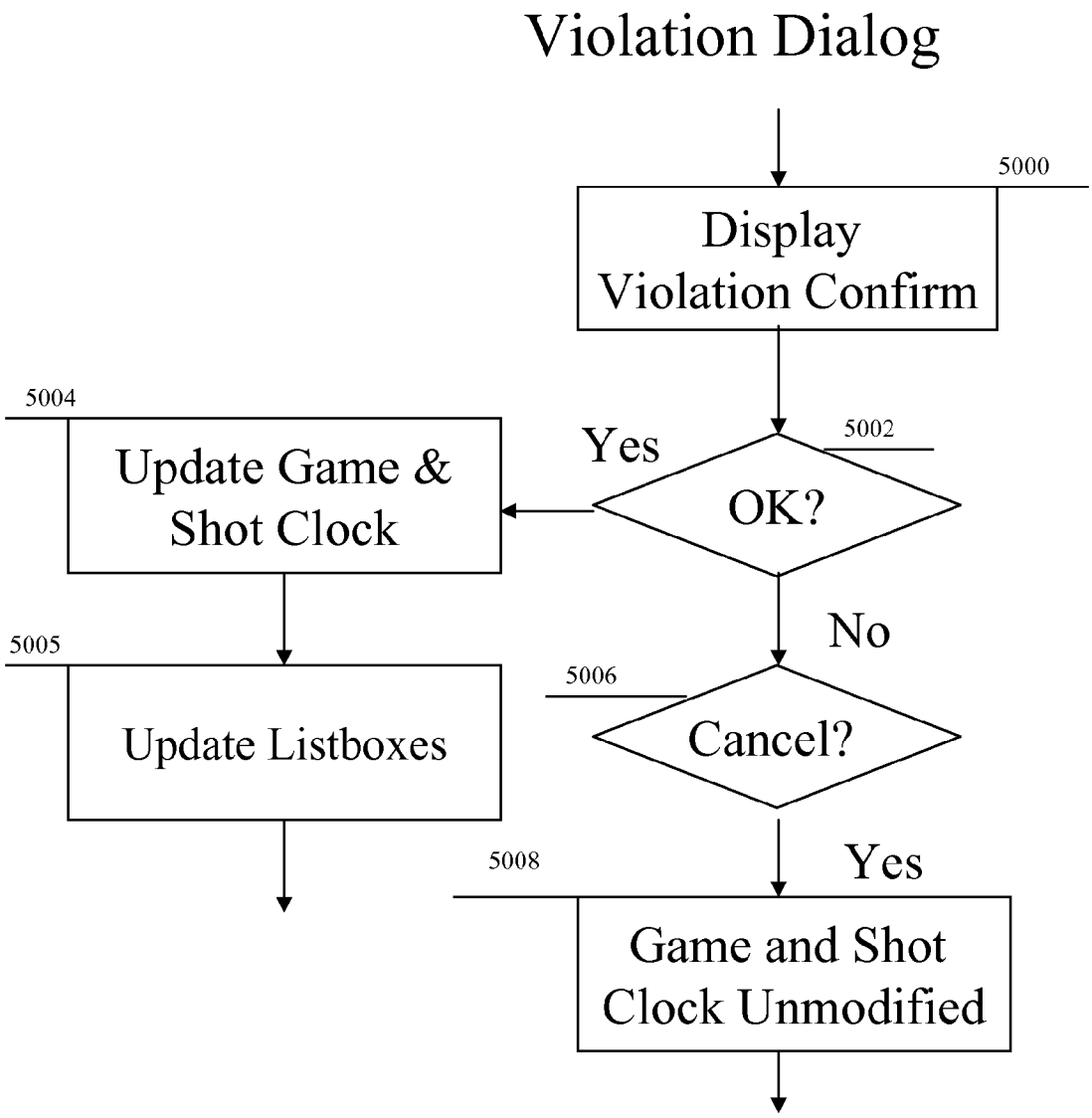

FIG. 50 illustrates the violation confirm dialog process called in module 4904 in FIG. 49. Module 5000 first displays the new values for shot and game clocks, while module 5002 checks to see if the OK button is pressed. If so, then module 5004 then updates the game and shot clock. Module 5005 updates the restart, possessions and bad rest listboxes. Module 5006 then checks to see if the cancel button is pressed and if so, module 5008 leaves the game and shot clock unmodified.

Figure 51:
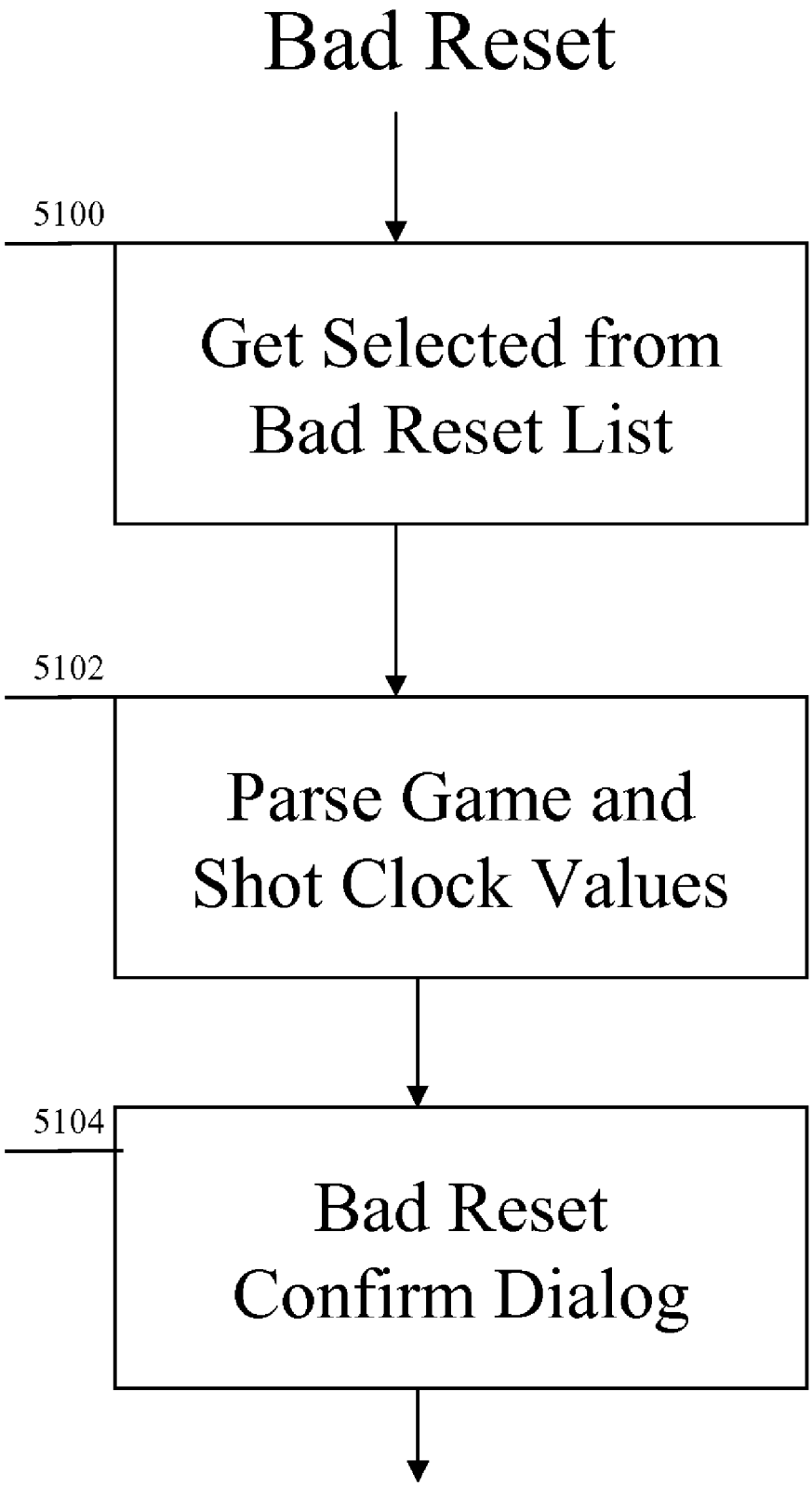

FIG. 51 illustrates bad reset recall process called in module 418 of FIG. 4. Module 5100 gets the selected shot and game values from the bad reset list. Module 5102 then parses the game and shot clock values. Module 5104 then initiates the bad reset confirm dialog in FIG. 52.

Figure 52:
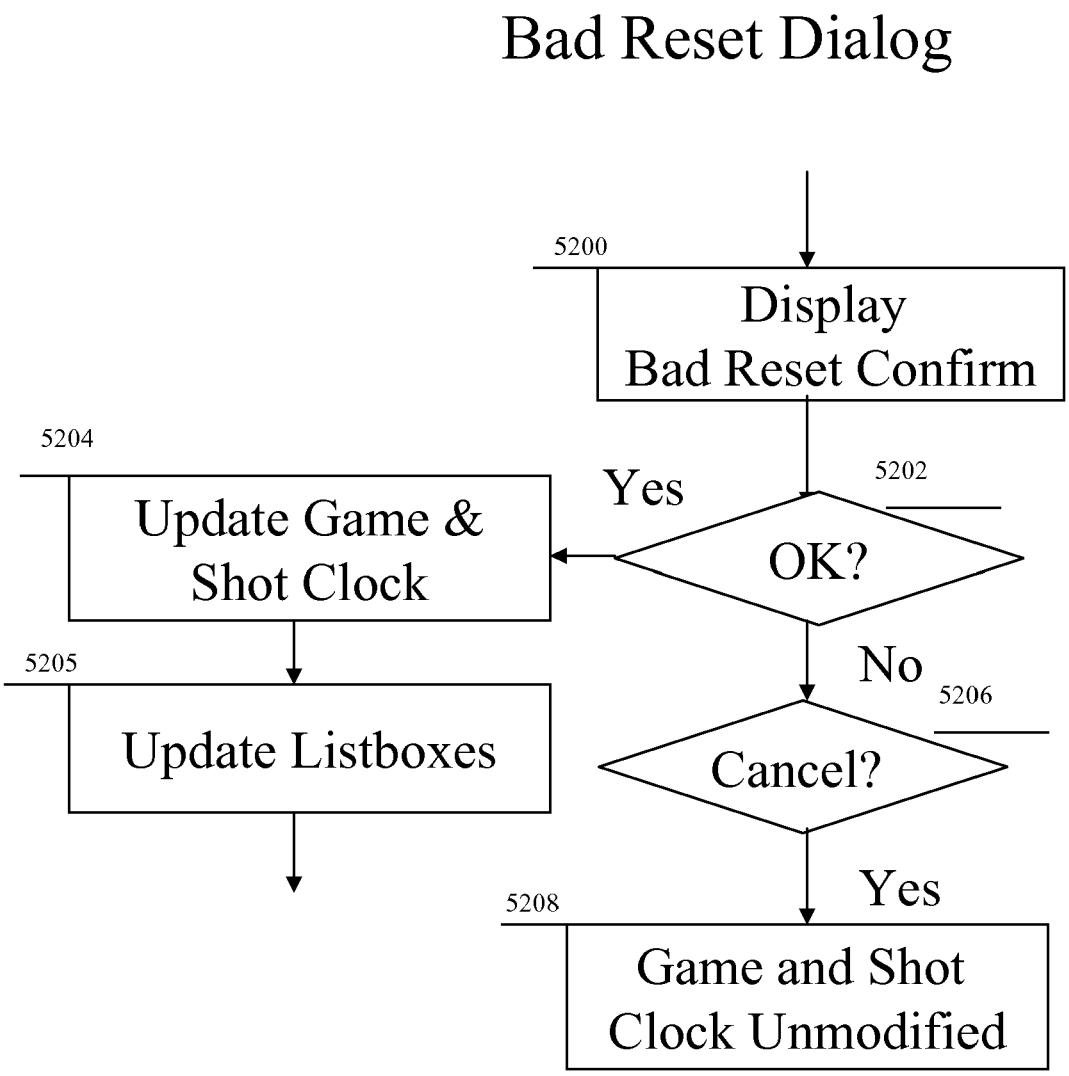

FIG. 52 illustrates the bad reset confirm dialog called module 5104 in FIG. 51. Module 5200 first displays recalled value for shot and game clocks. Module 5202 then checks to see if the OK button was pressed. If so, then module 5204 then updates the game and shot clocks. Module 5205 updates the restart, possessions, and bad reset listboxes. Module 5206 then checks to see if the cancel button was pressed. If so, then the game and shot clock are left unmodified in module 5208.

Figure 53:
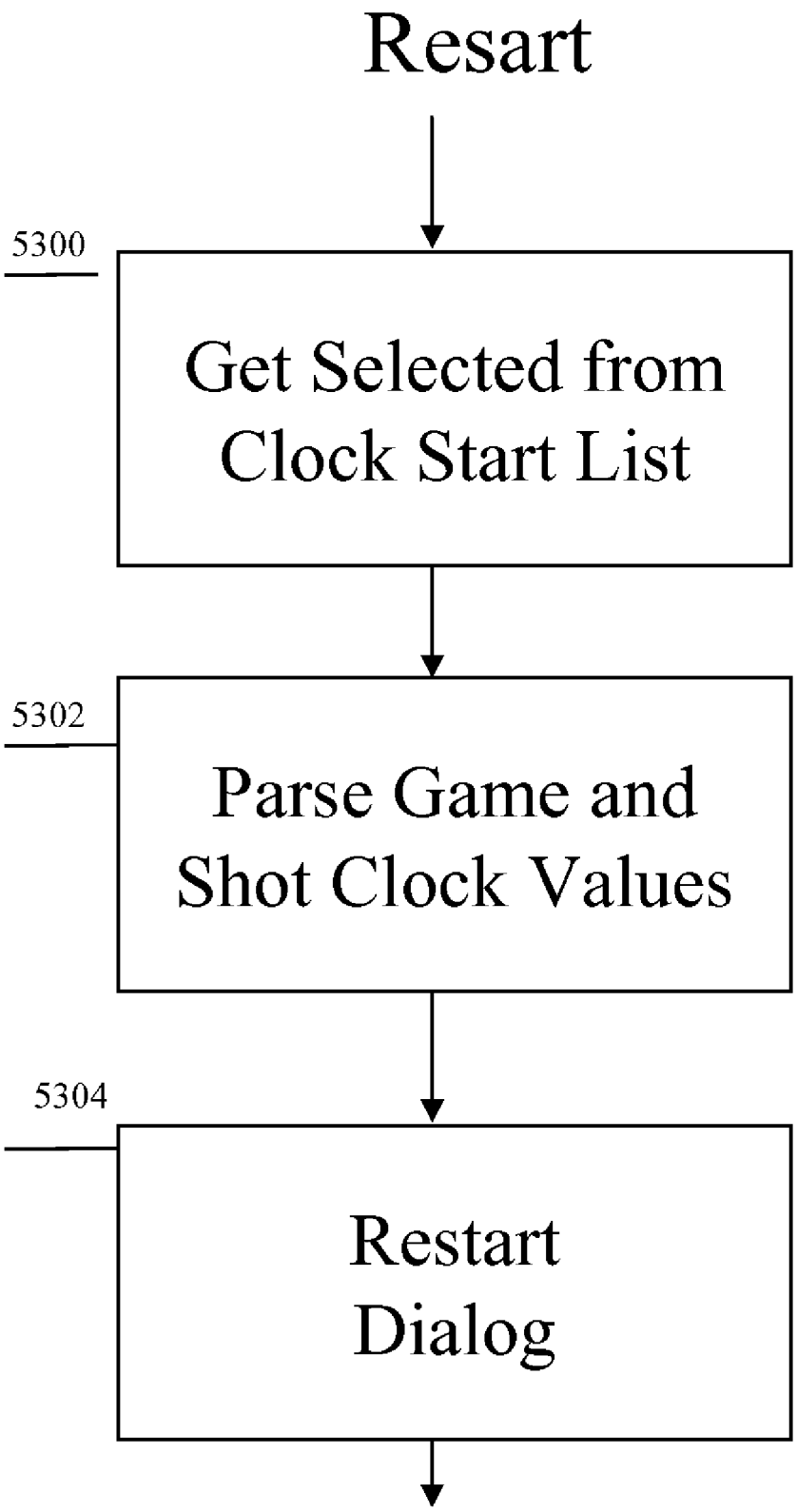

FIG. 53 illustrates the possession restart process in module 420 in FIG. 4. Module 5300 gets the selected values for shot and game clock from the start list while module 5302 parse the game and shot clock values. Module 5304 calls the restart confirm dialog illustrated in FIG. 54.

Figure 54:
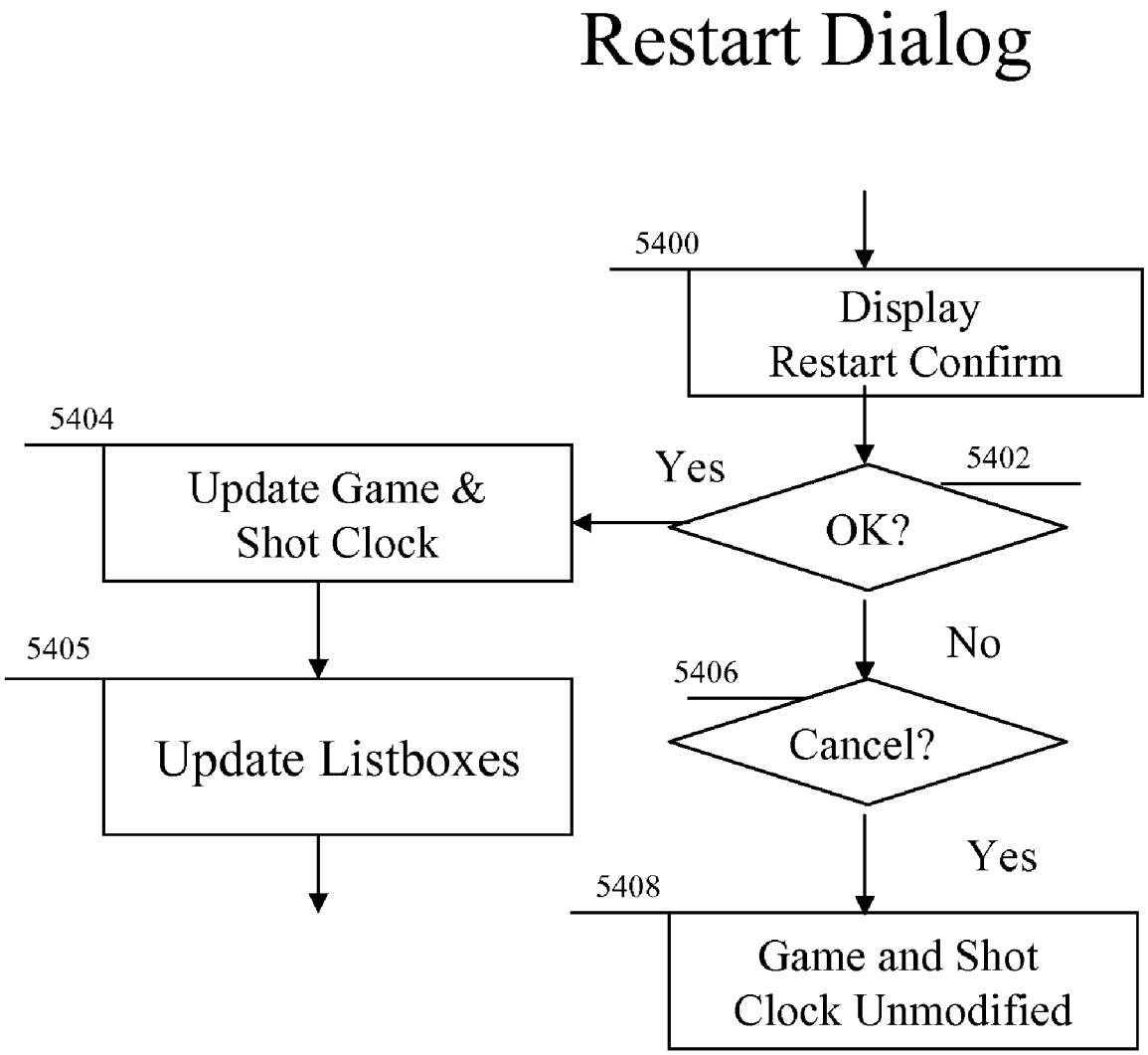

FIG. 54 illustrates the restart confirm dialog called in module 5304 of FIG. 53. Module 5400 displays the new values for the shot and game clock while module 5402 checks to see if the OK button was pressed. If so, module 5404 updates the game and shot clocks. Module 5405 updates the restart, possessions, and bad resets listboxes. Module 5406 then checks to see if the cancel button is pressed. If so, module 5408 leaves the game and shot clock unmodified.

FIG. 55 illustrates the ops update process created by a sent message in module 4614 of FIG. 46. Module 5500 checks to see if the game clock is less than 9 minutes. If so, module 5502 checks to see if the $1^{st}$ timeout was taken. If it was not, module 5504 checks to see if the period is less than 5. If the period is less than 5, module 5506 flashes the mandatory official timeout reminder. Module 5508 then checks to see if the game clock is less then 6 minutes. If so, module 5510 then checks to see if the $1^{st}$ timeout was taken. If so, module 5512 then checks to see if the $2^{nd}$ timeout was taken, and if not, module 5514 checks to see if the period is less than 5. If the period is less than 5, module 5516 then checks to see if $1^{st}$ timeout was an official timeout. If it was, module 5520 flashes mandatory home timeout reminder, while module 5518 flashes mandatory official timeout reminder, if not.

Figure 56:
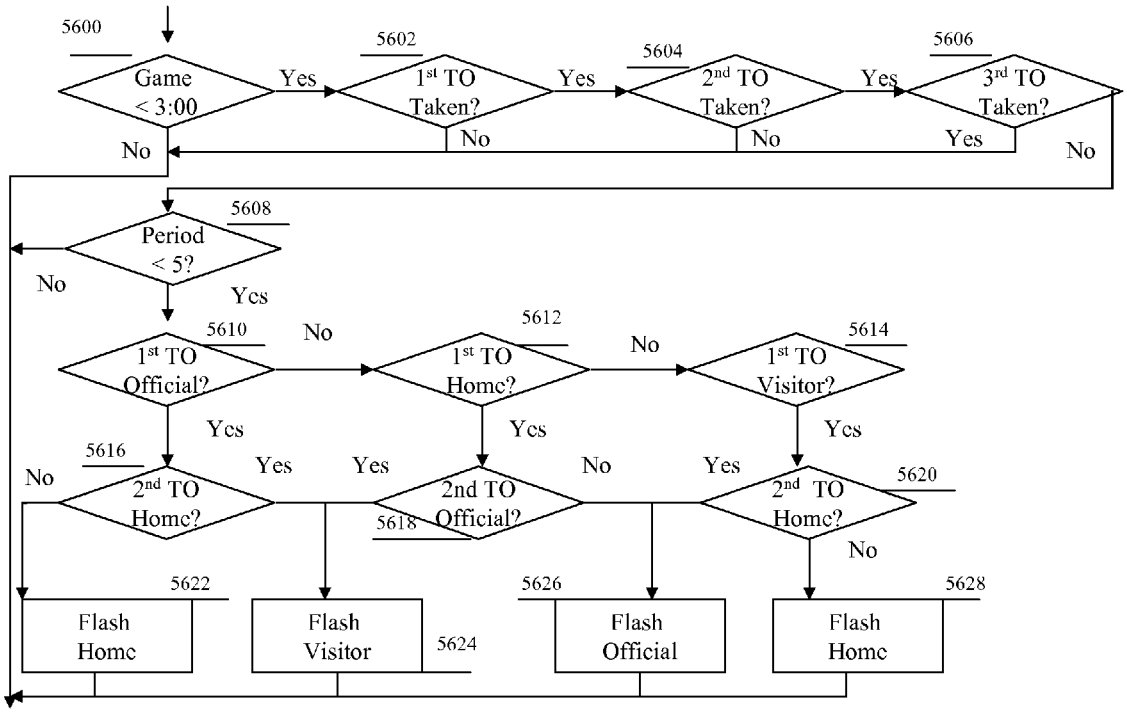

FIG. 56 continues to illustrate the ops update process from FIG. 55. Module 5600 checks to see if the game clock is less than 3 minutes. If so, module 5602 then checks to see if the $1^{st}$ timeout was taken. If so, module 5604 then checks to see if the $2^{nd}$ timeout was taken. If so, module 5606 then checks to see if a $3^{rd}$ timeout was taken. If a $3^{rd}$ timeout was not taken, module 5608 then checks to see if the period is less than 5. If all three timeouts have been taken the process is completed. If the first two timeouts have been taken but the third has not but the period is not less than 5, the process is completed. However if the first two timeouts are taken and the third is not and the period is less than 5, module 5610 checks to see if the $1^{st}$ timeout was an official timeout. If the $1^{st}$ timeout was not an official timeout, module 5612 then checks to see if the $1^{st}$ timeout was a home timeout. If the $1^{st}$ timeout was not a home timeout or official timeout, module 5614 then checks to see if the $1^{st}$ timeout was a visitor timeout. If the first timeout was a visitor timeout, module 5620 then checks to see if the $2^{nd}$ timeout was a home timeout. If the first $1^{st}$ timeout was a visitor timeout and the $2^{nd}$ timeout was not a home timeout, module 5628 flashes the mandatory home timeout reminder. If the $1^{st}$ timeout was visitor timeout and the second timeout was a home timeout, module 5626 flashes the mandatory official timeout reminder. If the first timeout was a home timeout, module 5618 then checks to see if the $2^{nd}$ timeout was an official timeout. If the $1^{st}$ timeout was a home timeout and the $2^{nd}$ timeout was not an official timeout, module 5626 flashes the mandatory official timeout reminder. If the $1^{st}$ timeout was a home timeout and the $2^{nd}$ timeout was an official timeout, module 5624 will flash the mandatory visitor timeout reminder. If the $1^{st}$ timeout was an official timeout, module 5616 checks to see if the $2^{nd}$ timeout was a home timeout. If $2^{nd}$ timeout was a home timeout, module 5624 flashes the mandatory visitor timeout reminder. If the $1^{st}$ timeout was an official timeout and the $2^{nd}$ timeout was not a home timeout, module 5622 flashes the mandatory home timeout reminder.

Figure 57:
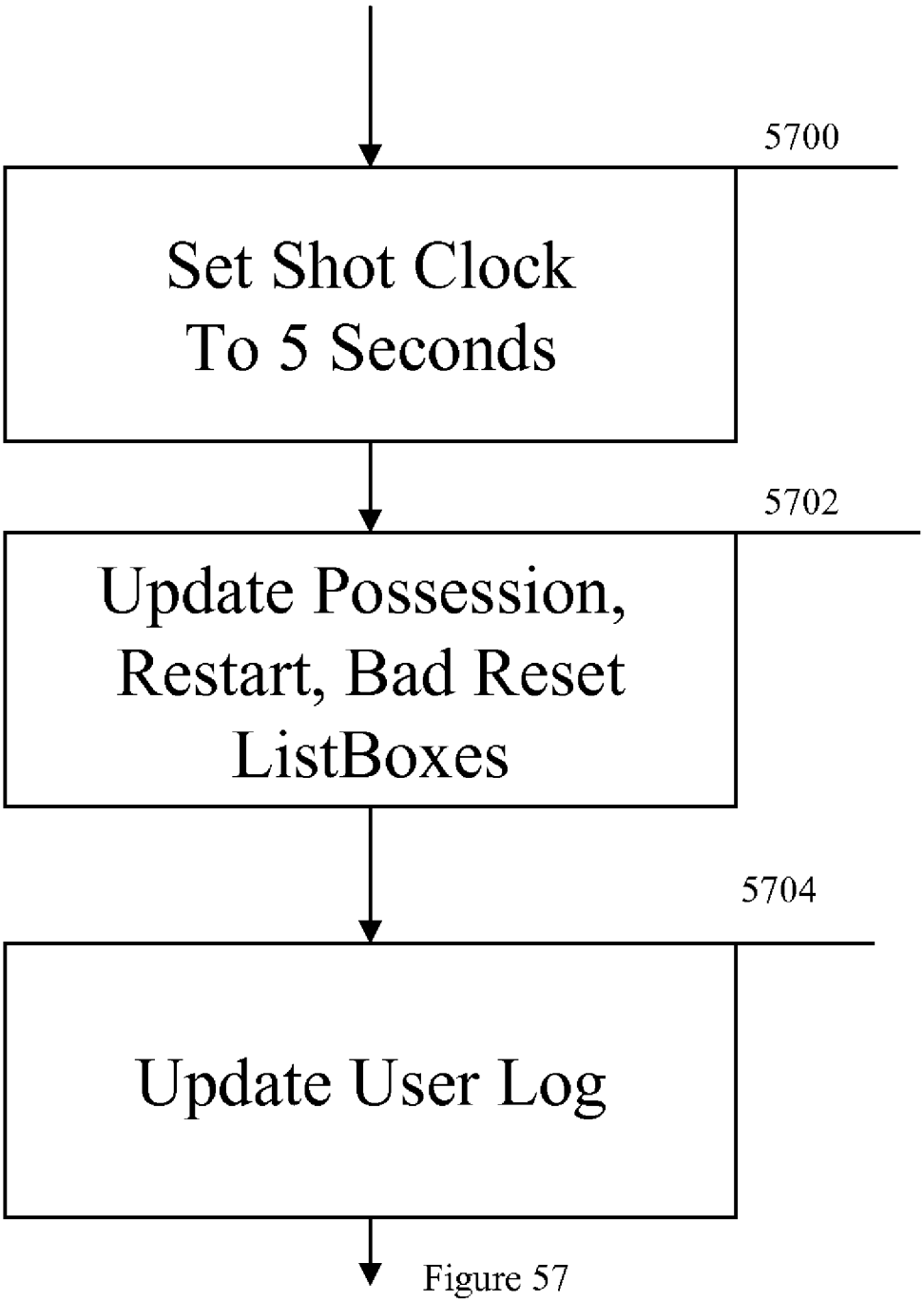

FIG. 57 illustrates the 'set to 5' process called in module 500 of FIG. 5. Module 5700 sets the shot clock to 5 seconds while module 5702 updates the possessions, bad reset, and restart listboxes. Module 5704 updates the user log.

Figure 58:
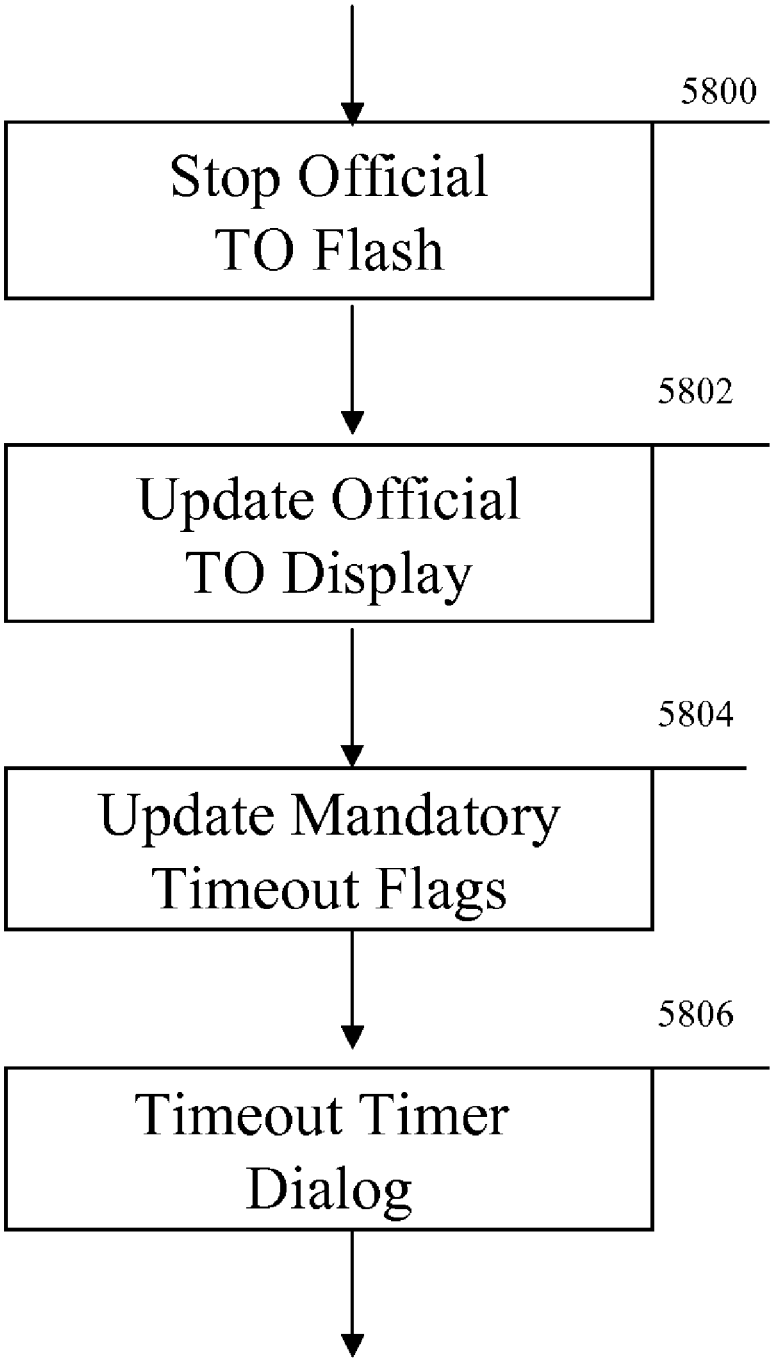

FIG. 58 illustrates the official timeout process called in module 502 in FIG. 5. Module 5800 stops official timeout reminder, while module 5802 updates the official timeout display. Module 5804 then updates mandatory timeout flags while module 5806 then initiates the timeout timer dialog in FIG. 28.

Figure 59:
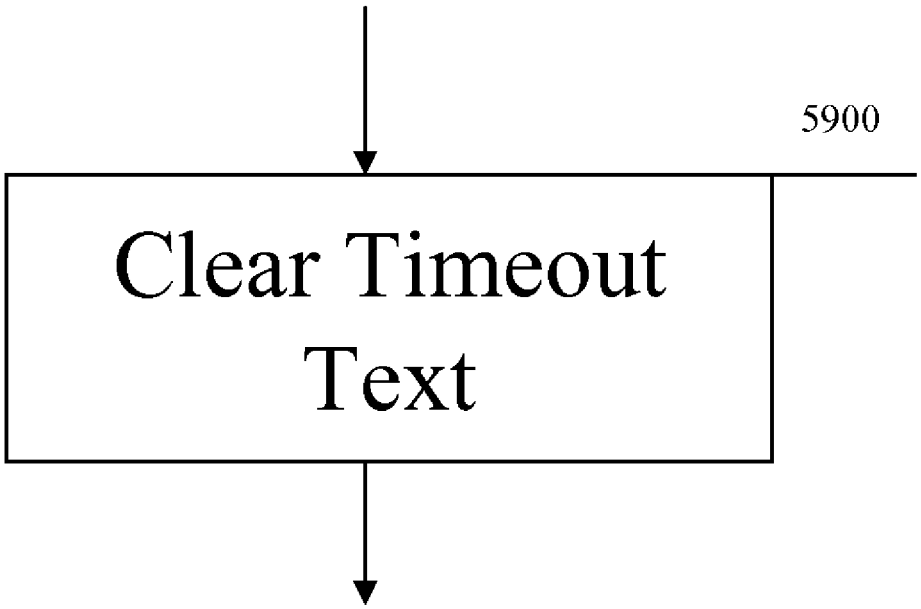

FIG. 59 illustrates the timeout end called in module 504 in FIG. 5. Module 5900 clears the timeout text.

Figure 60:
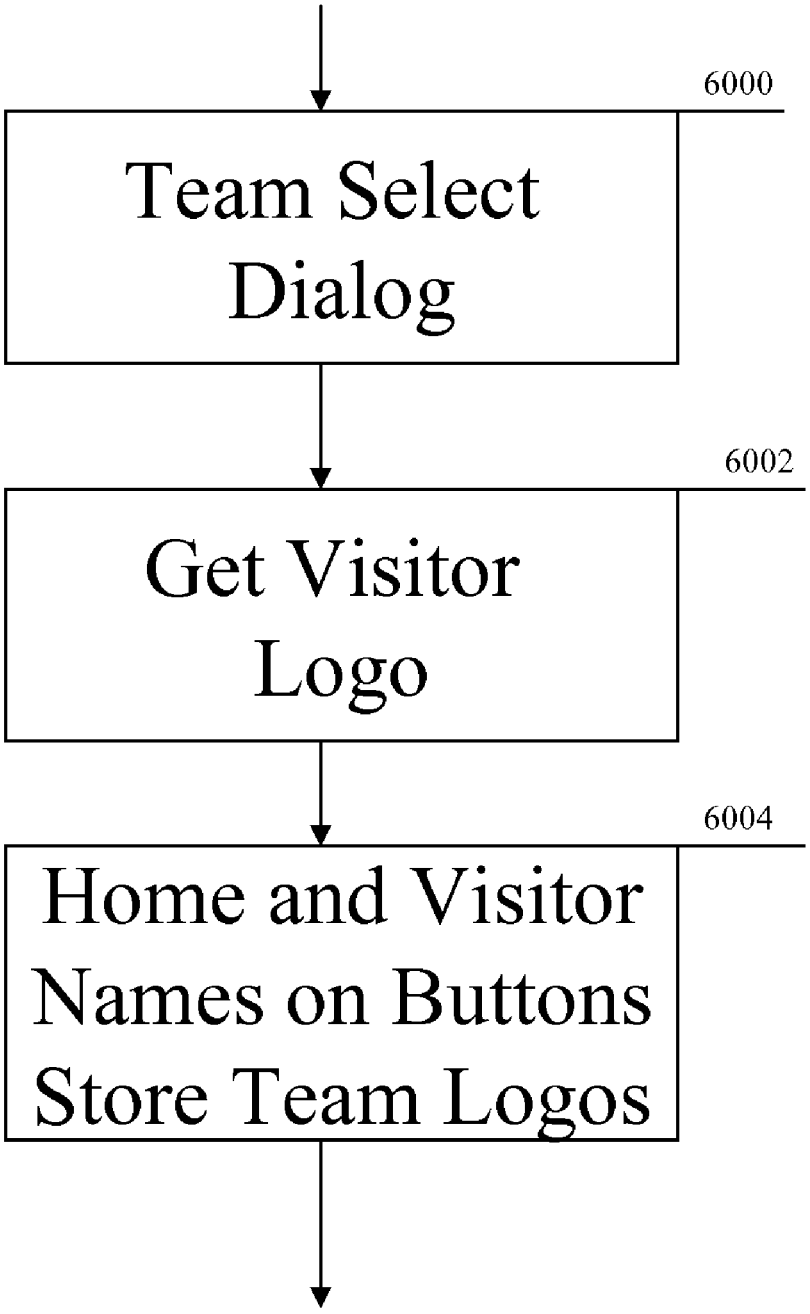

FIG. 60 illustrates the visitor team select process called in module 506 in FIG. 5. Module 6000 calls the team select dialog in FIG. 61, upon return from the dialog module 6002 gets the selected visitor logo. Module 6004 then puts the home and visitor names on the buttons and stores team logos.

Figure 61:
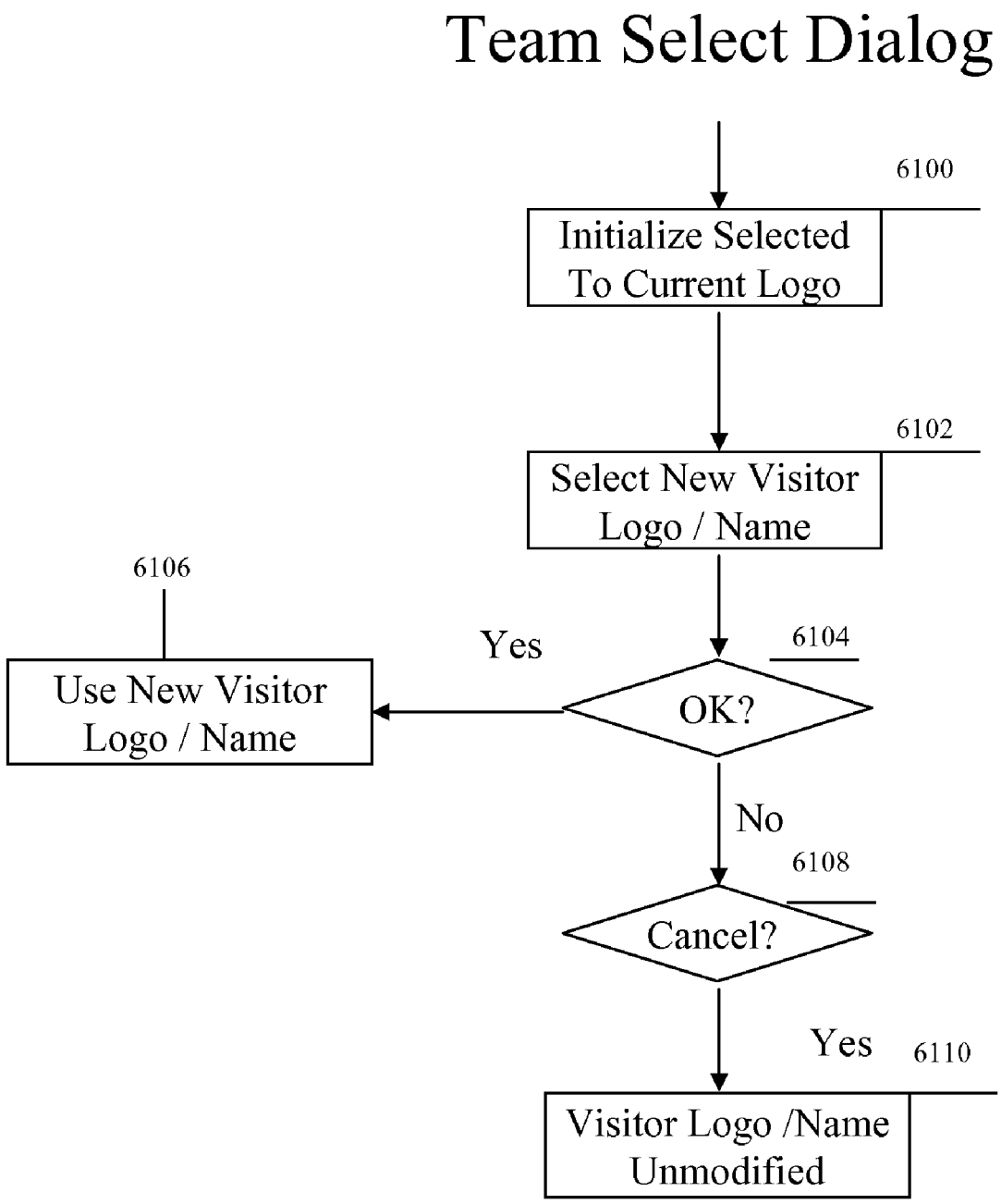

FIG. 61 illustrates the team select dialog called in module 6000 in FIG. 60. Module 6100 initializes the current visitor team to the selected visitor team logo while module 6102 selects new visitor team name to selected name. Module 6104 then checks to see if the user has pressed the OK button and if so, module 6106 then uses the new visitor team logo and name. Module 6108 also checks to see if the user pressed the cancel button and if so, module 6110 leaves the visitor team logo and name unmodified.

Figure 62:
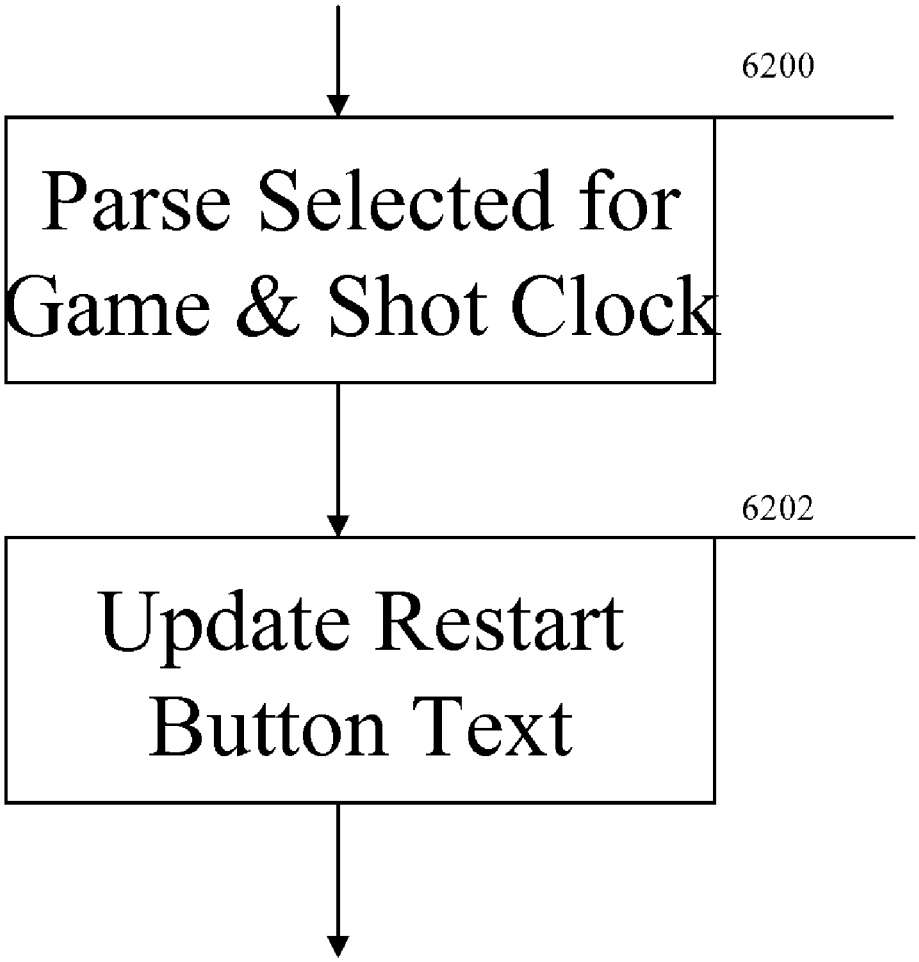

FIG. 62 illustrates the clock starts select change process called in module 508 in FIG. 5. This allows the user to select any entry in the clock starts listbox for modifying the clocks. Module 6200 parses the selected game and shot clock while module 6202 updates the restart button text.

Figure 63:
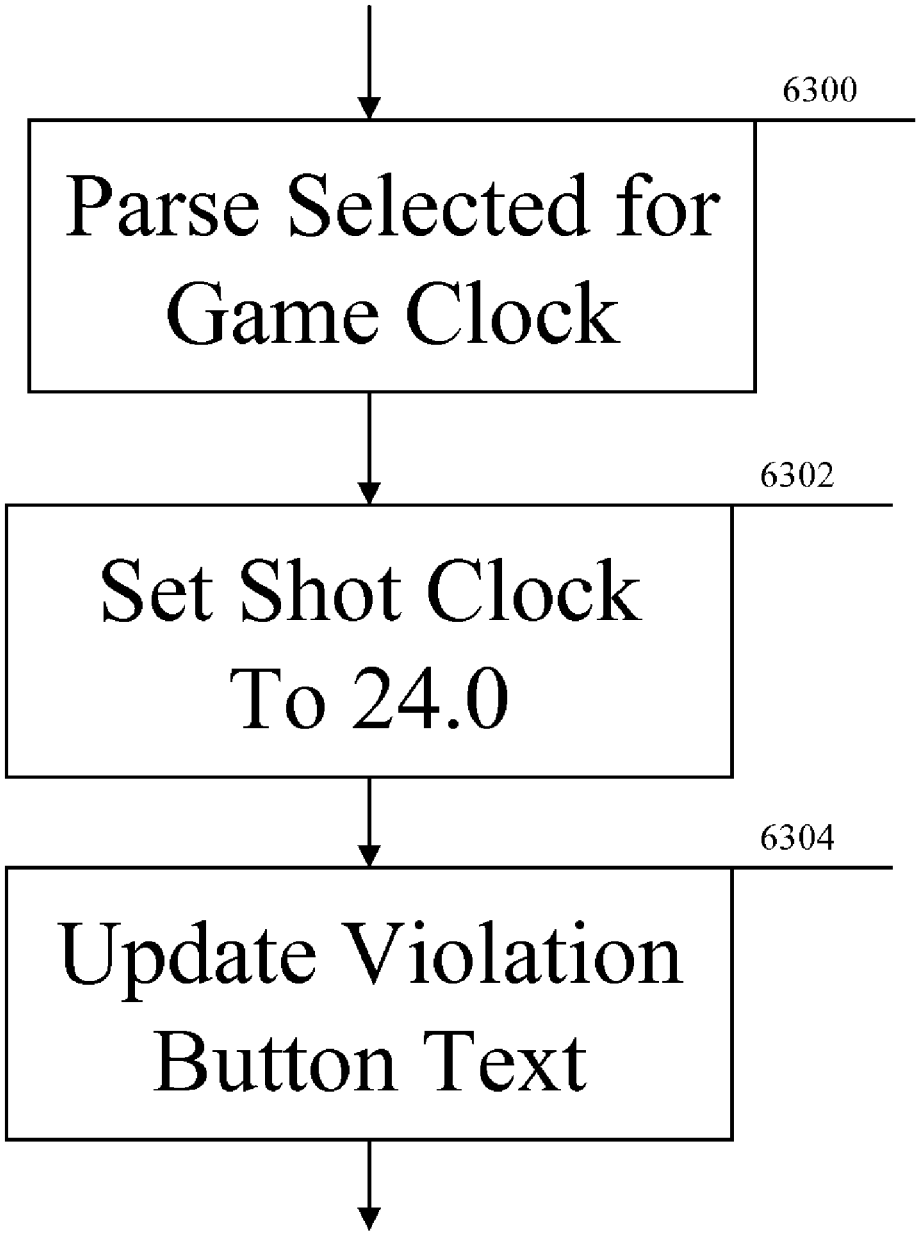

FIG. 63 illustrates the possession select change process in module 510 in FIG. 5. This allows the user to select any entry in the possessions listbox for modifying the clock. Module 6300 parses the selected game clock while module 6302 sets the shot clock to 24.0. Module 6304 then updates the violation button text.

Figure 64:
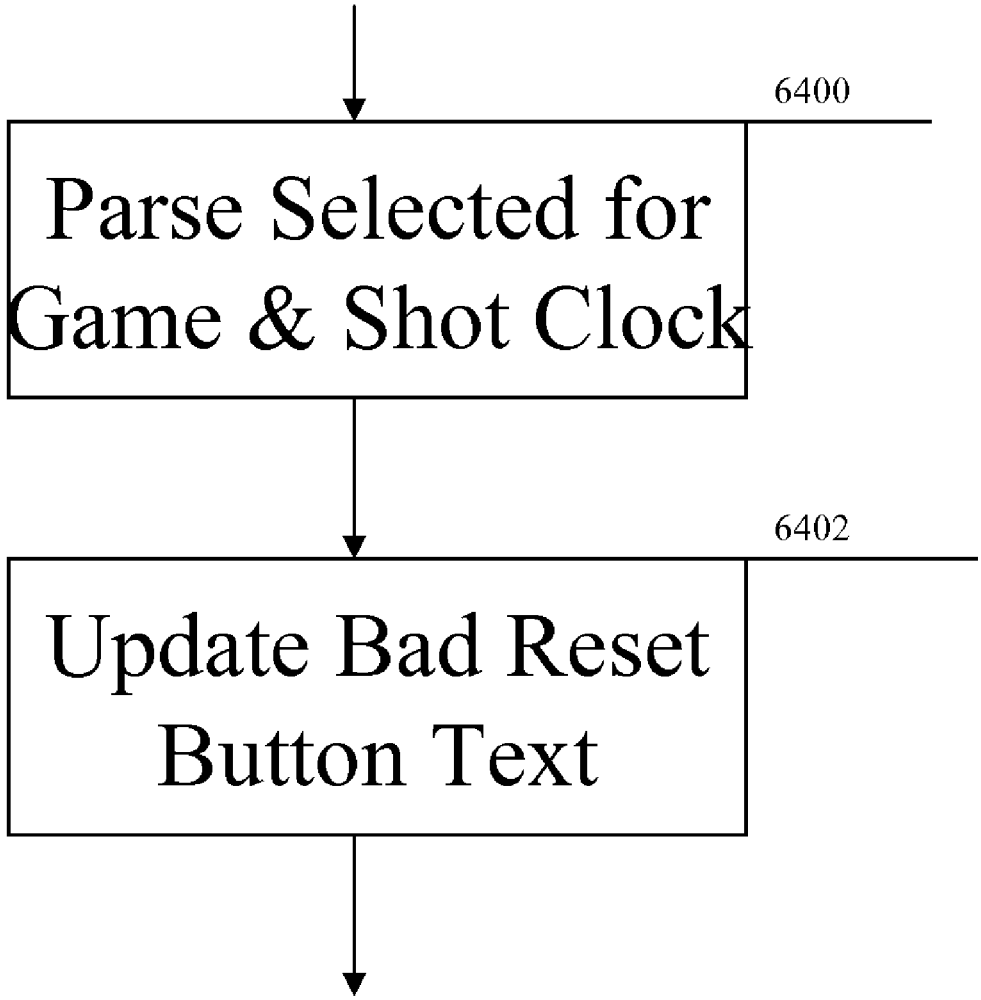

FIG. 64 illustrates the bad reset select change process called in module 512 in FIG. 5. Module 6400 parses the selected for game and shot clock while module 6402 updates the bad reset button text.

Figure 65:
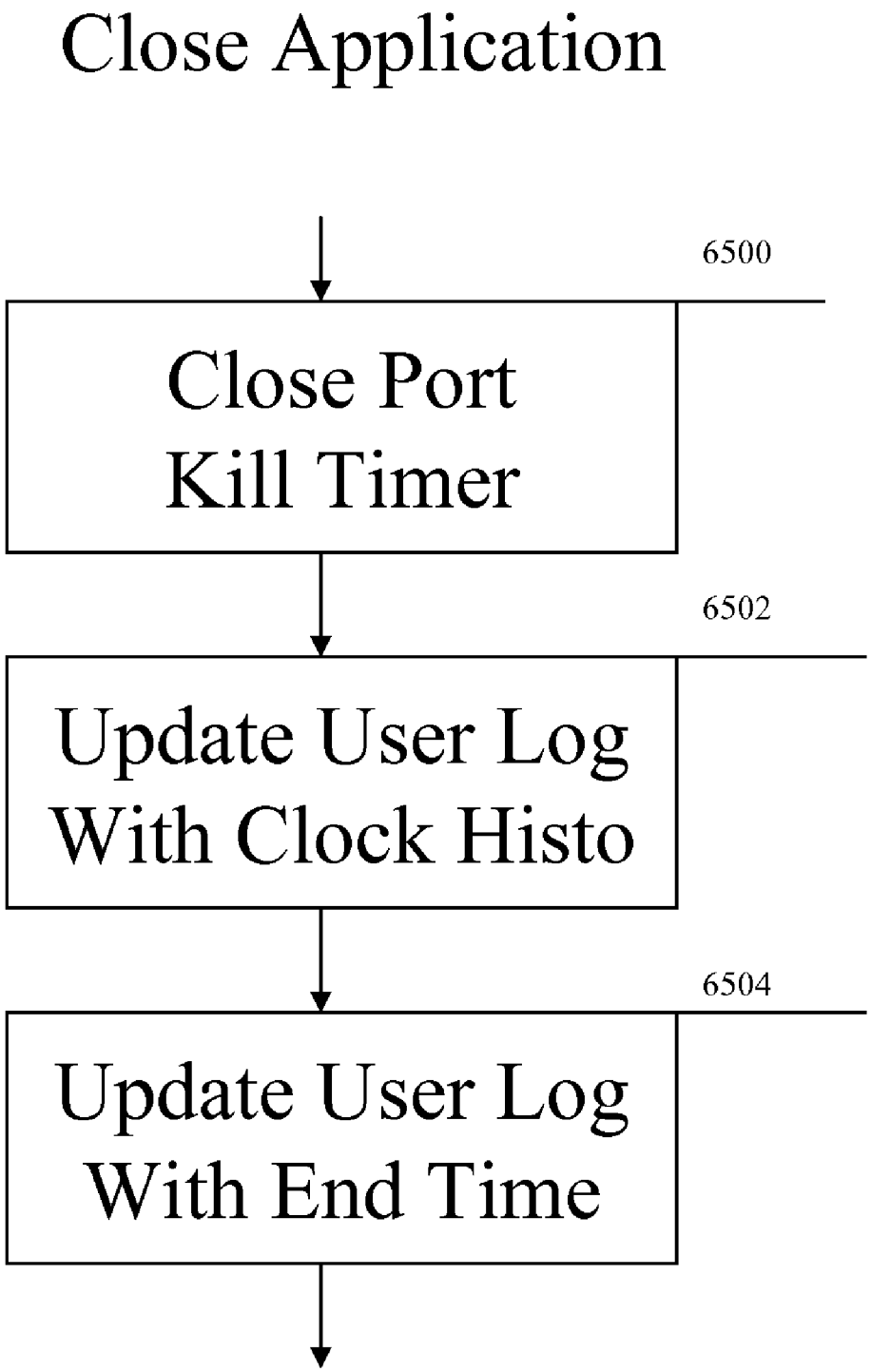

FIG. 65 illustrates the close application process. Module 6500 closes the I/O port and kills the precision timer while module 6502 updates the user log with the clock histogram. Module 6504 then updates the user log with the end time of day.

Figure 66:
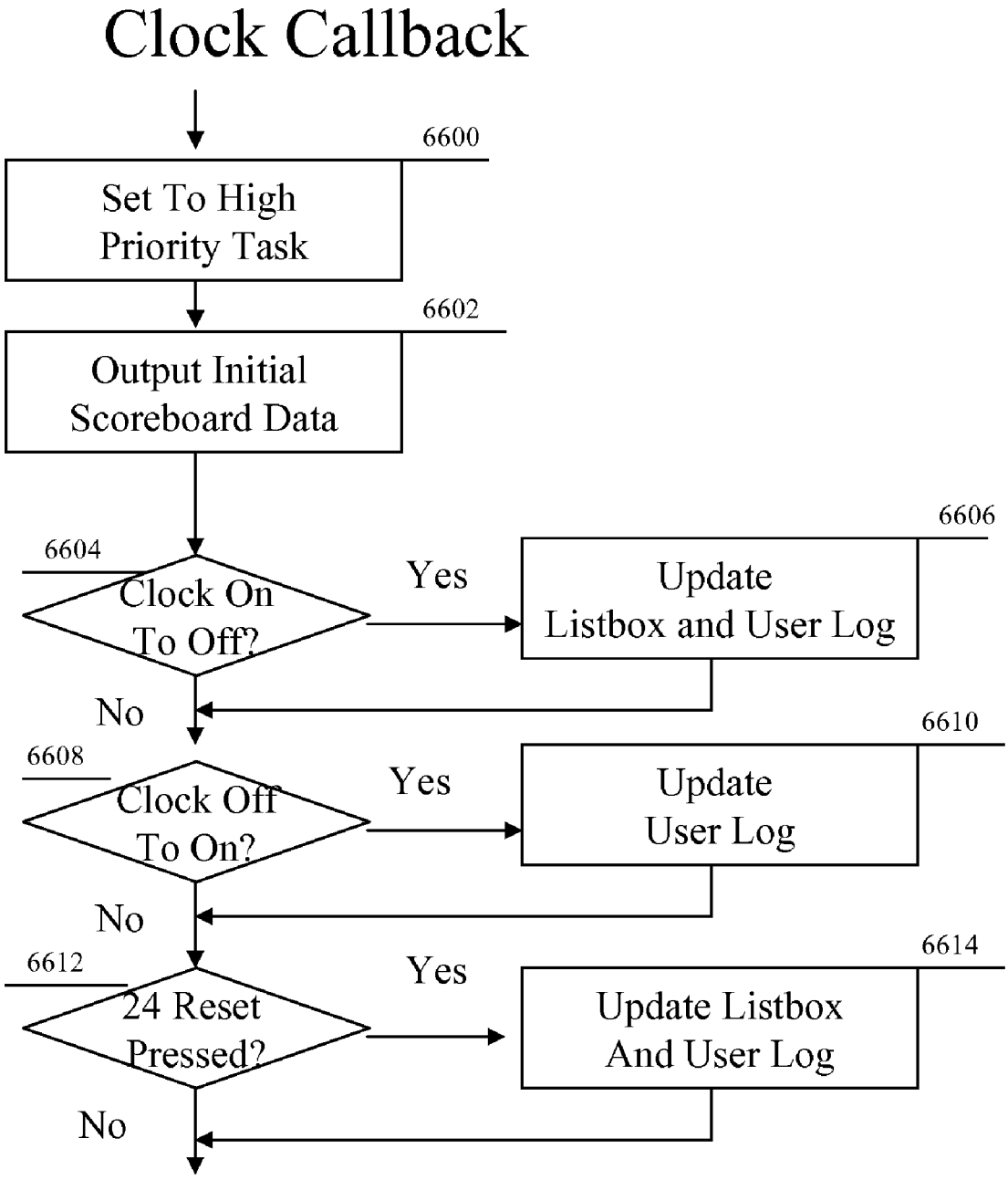

FIG. 66 illustrates the clock callback process created in module 208 in FIG. 2. Module 6600 sets the precision timer task to a high priority system task, while module 6602 outputs the initial data to the scoreboards. Module 6604 then checks to see if the clock is switched from on to off, and if so, module 6606 updates the clock starts listbox and user log. Module 6608 then checks to see if the clock has been switched from off to on and if so, module 6610 updates the user log. Module 6612 then checks to see if the 24 reset is pressed and if so, updates the bad reset listbox and user log in module 6614.

Figure 67:
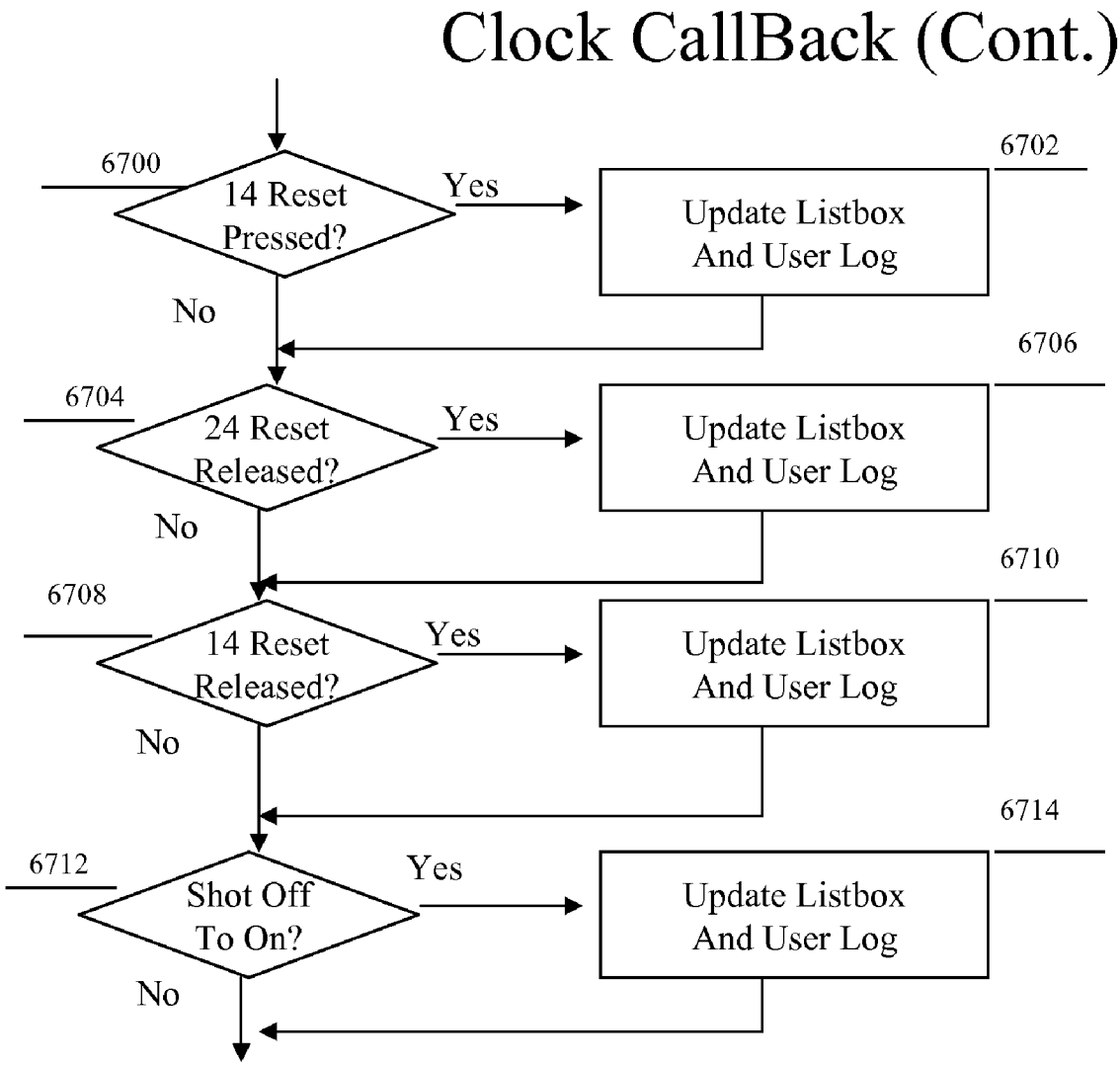

FIG. 67 continues to illustrate the clock callback from FIG. 66. Module 6700 first checks to see if the 14 reset is pressed and if so, module 6702 then updates the bad reset listbox and updates the user log. Module 6704 then checks to see if the 24 reset is released and if so, module 6706 updates the possessions listbox and user log. Module 6708 then checks to see if the 14 reset is released and if so, module 6710 updates the possessions listbox and user log. Module 6712 then checks to see if the shot clock was turned from off to on and if so, module 6714 updates the possession listbox and user log.

Figure 68:
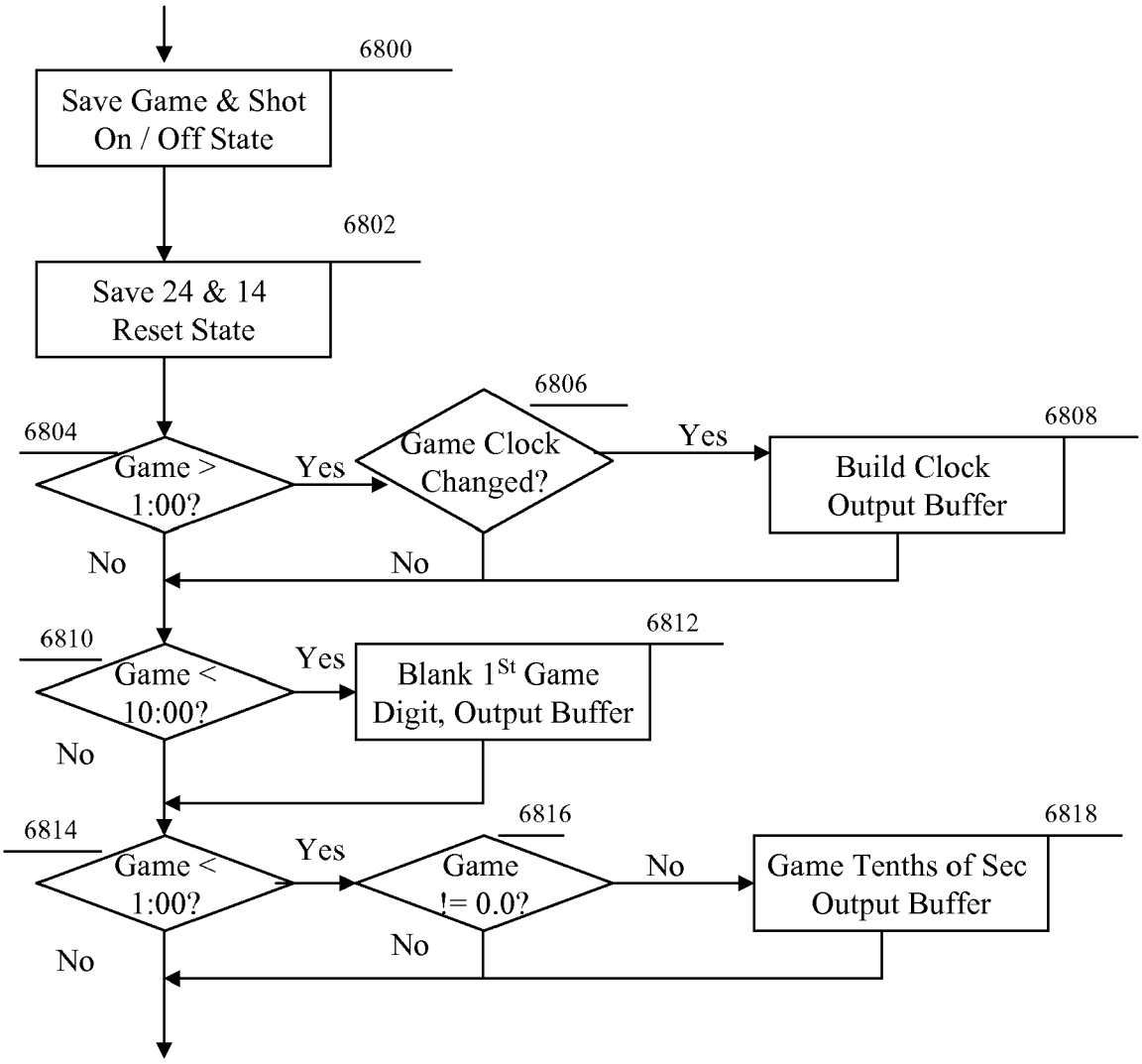

FIG. 68 continues to illustrate the clock callback from FIGS. 66 and 67. Module 6800 saves the game and shot clock on/off state while module 6802 saves the 24 and 14 reset state. Module 6804 then checks to see if the game clock is greater than 1 minute and if so, module 6806 checks to see if the game time changed. If so, module 6808 builds the clock output buffer. Module 6810 then checks to see if the game clock is less than 10 minutes and if so, module 6812 blanks the $1^{st}$ digit of the minutes in the game clock in the output buffer. Module 6814 then checks to see if the game clock is less than 1 minute and if so, module 6816 checks to see if the game clock equals 0.0. If the game clock does not equal 0.0, module 6818 uses tenths of a second in the game clock and builds output buffer.

Figure 69:
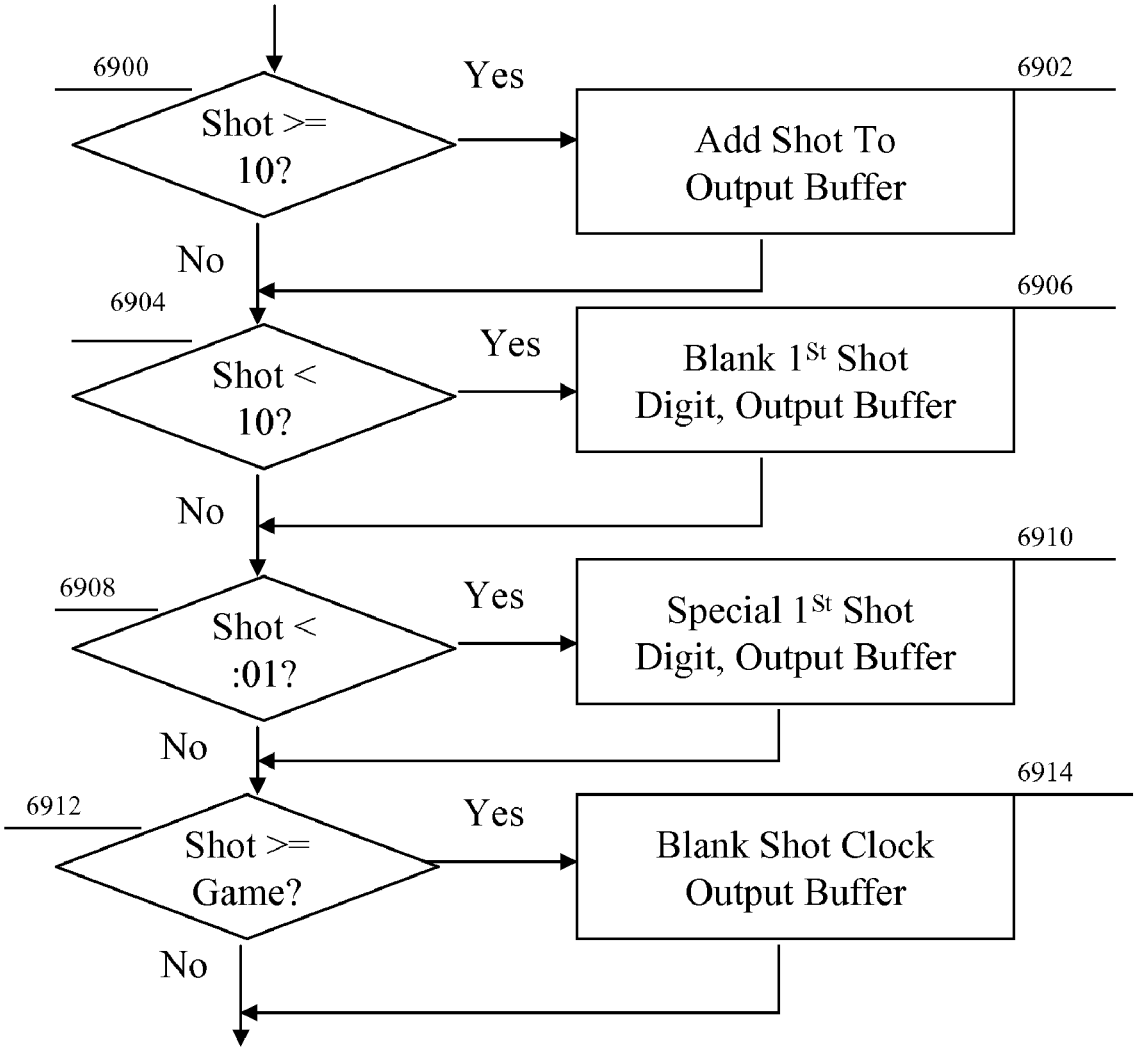

FIG. 69 continues the illustration of the clock callback process from FIGS. 66, 67 and 68. Module 6900 checks to see if the shot clock is greater than or equal to 10, and if so, module 6902 adds the shot clock to the output buffer. Module 6904 then checks to see if the shot clock is less than 10, and if so, module 6906 blanks the 1$^{st}$ shot clock digit in the output buffer. Module 6908 then checks to see if the shot clock is less than 1 second and if so, module 6910 uses a special 1$^{st}$ shot digit (a small 0 made by using only the bottom portion of the 8) in the output buffer, in the case where a third digit to represent tenths of second on the shot clock is not available. If a third digit is available the tenths of a second for the shot clock is displayed in this extra digit. Module 6912 checks to see if the shot clock is greater than or equal to the game clock. If this is true, module 6914 blanks the shot clock in the output buffer.

Figure 70:
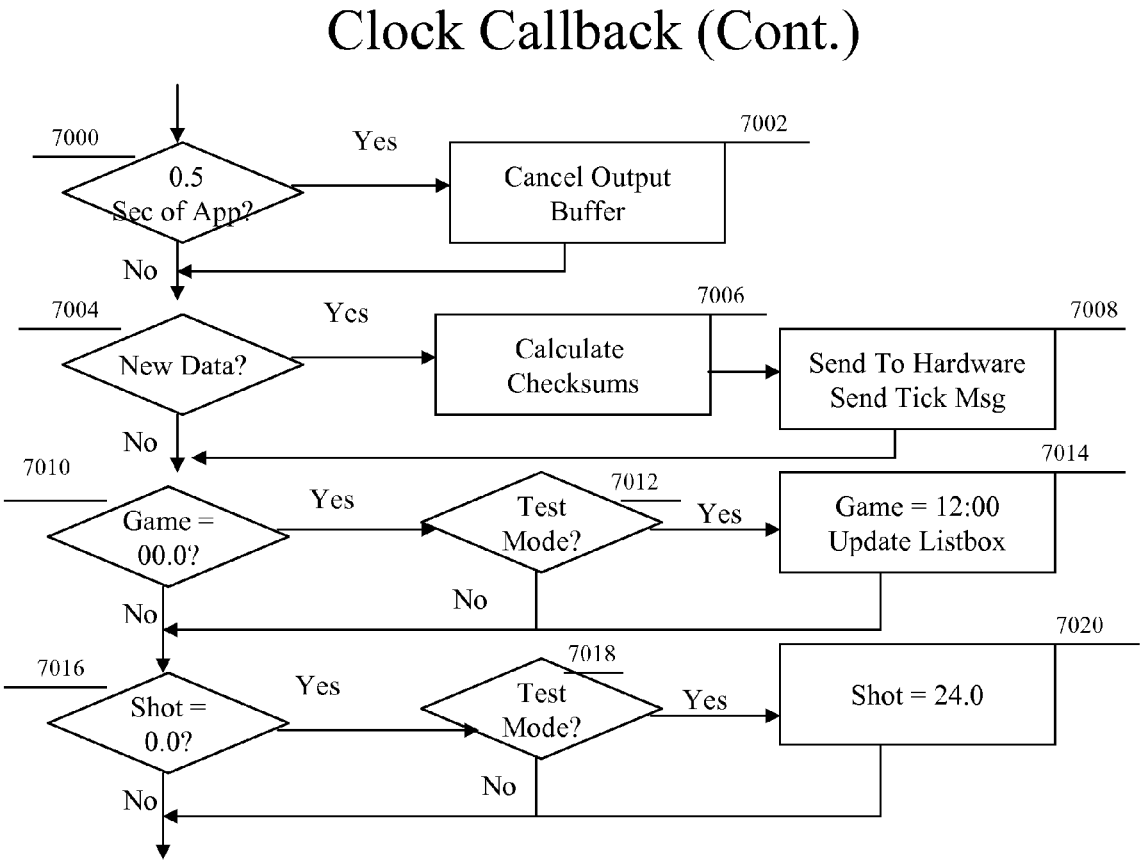

FIG. 70 continues the illustration of the clock callback process from FIGS. 66, 67, 68 and 69. Module 7000 checks to see if it is still the 1st 0.5 second of the application when hardware resets occur, and if so, module 7002 cancels the output buffer. Module 7004 then checks to see if there is new data for the scoreboards, and if so, module 7006 calculates checksums while module 7008 sends it to hardware and sends tick message to the main routine. Module 7010 then checks to see if the game clock equals 00.0 and if so, module 7012 then checks to see if the process is in test mode. If so, module 7014 updates the game to 12 minutes and updates the possessions, clock start and bad reset listboxes. If not in test mode, game clock stops at 00.0. Module 7016 then checks to see if the shot clock equals 0.0 and if so, module 7018 checks to see if the process is in test mode, and if so, module 7020 sets the shot clock to 24.0. If not in test mode, shot clock stops at 0.0.

Figure 71:
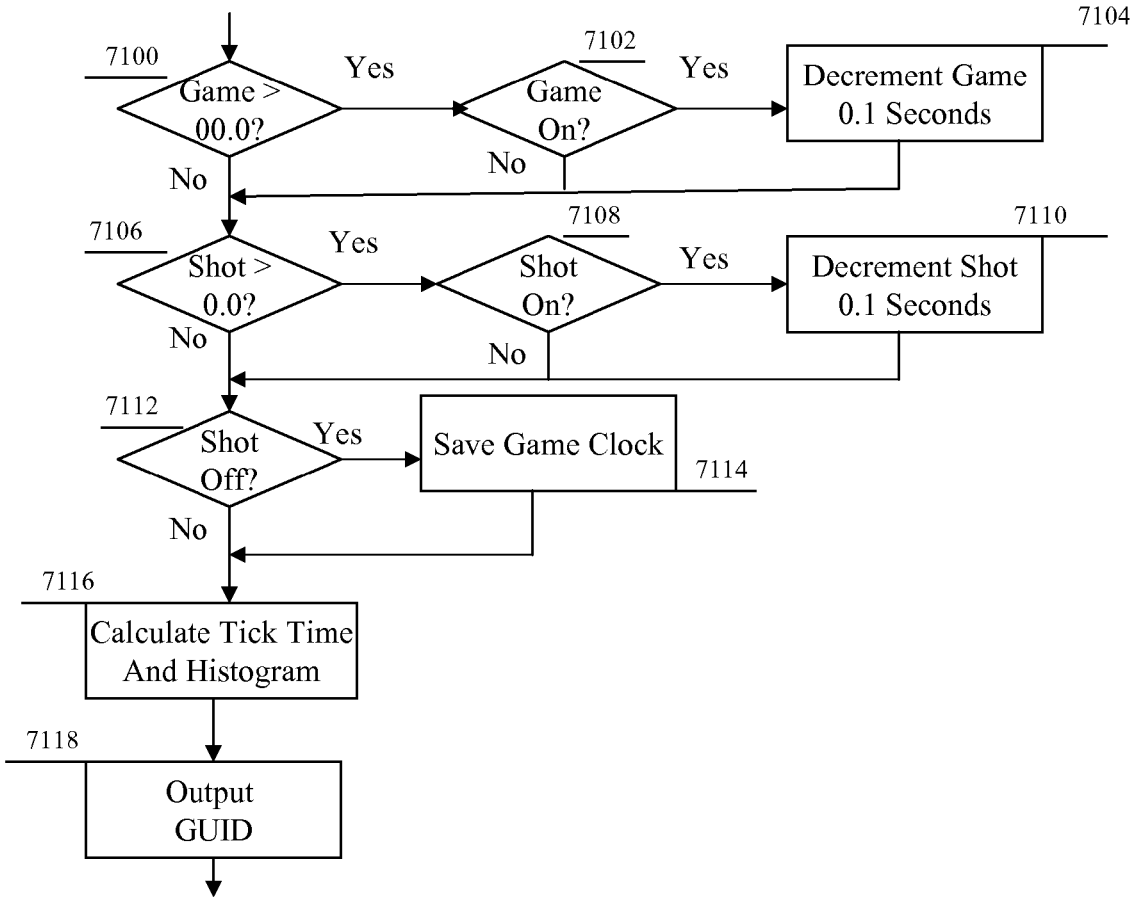

FIG. 71 continues the illustration of the clock callback process from FIGS. 66, 67, 68, 69 and 70. Module 7100 first checks to see if the game clock is greater than 00.0 and if so, module 7102 checks to see if the game clock is on. If the game clock is on, module 7104 decrements the game clock by 0.1 seconds. Module 7106 then checks to see if the shot clock is greater than 0.0 and if so, module 7108 checks to see if the shot clock is on. If the shot clock is on, module 7110 decrements the shot clock by 0.1 seconds. Module 7112 then checks to see if the shot clock is off and if so, save the current game clock in module 7114. Module 7116 then calculates the tick time and adds to the histogram and then module 7118 outputs a Globally Unique Identifier.

Figure 72:
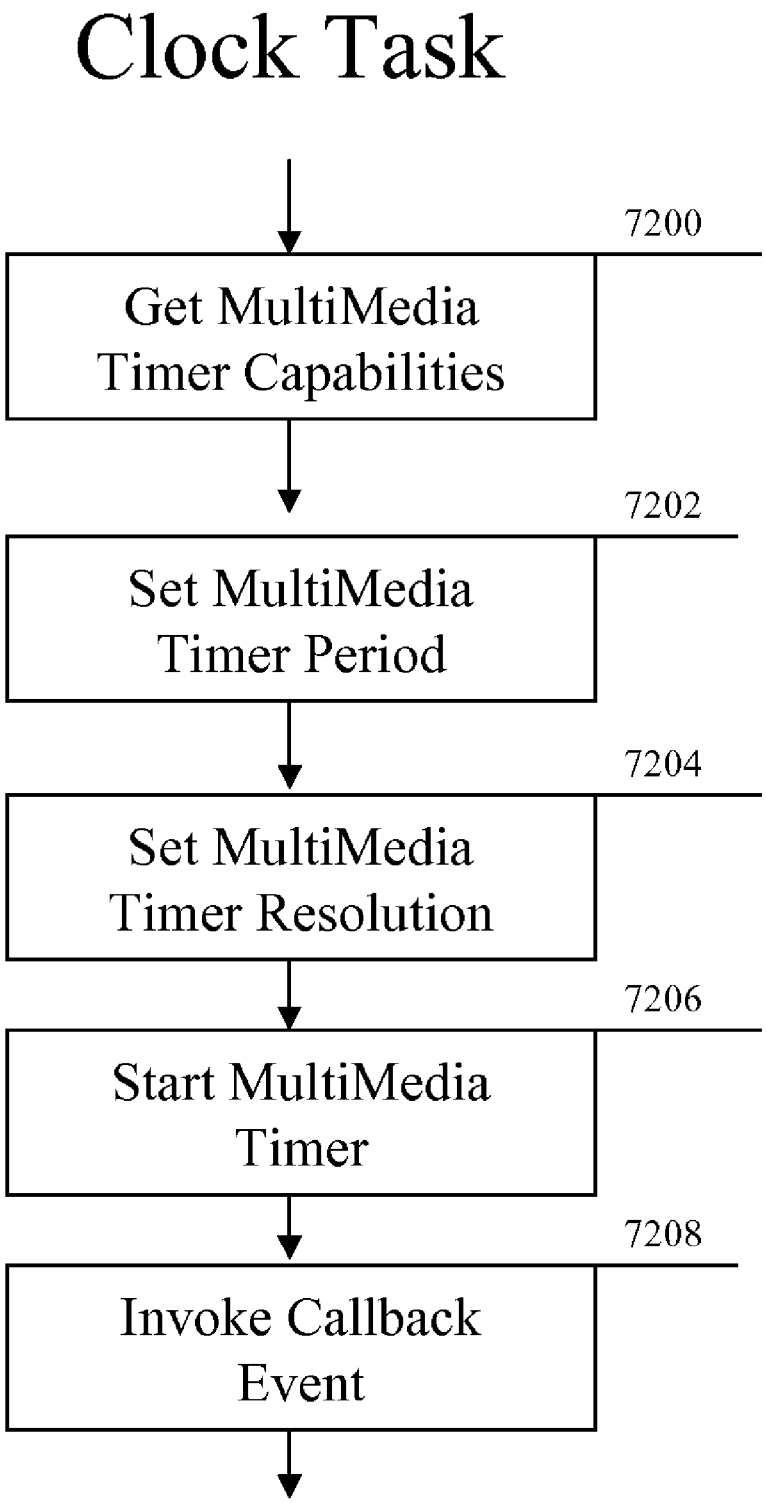

FIG. 72 illustrates the clock task process, created in response to module 208 in FIG. 2. Module 7200 first gets multimedia timer capabilities while module 7202 sets the multimedia timer period. Module 7204 then sets the multimedia timer resolution while module 7206 starts the multimedia timer. Module 7208 then invokes the callback event.

Figure 73:
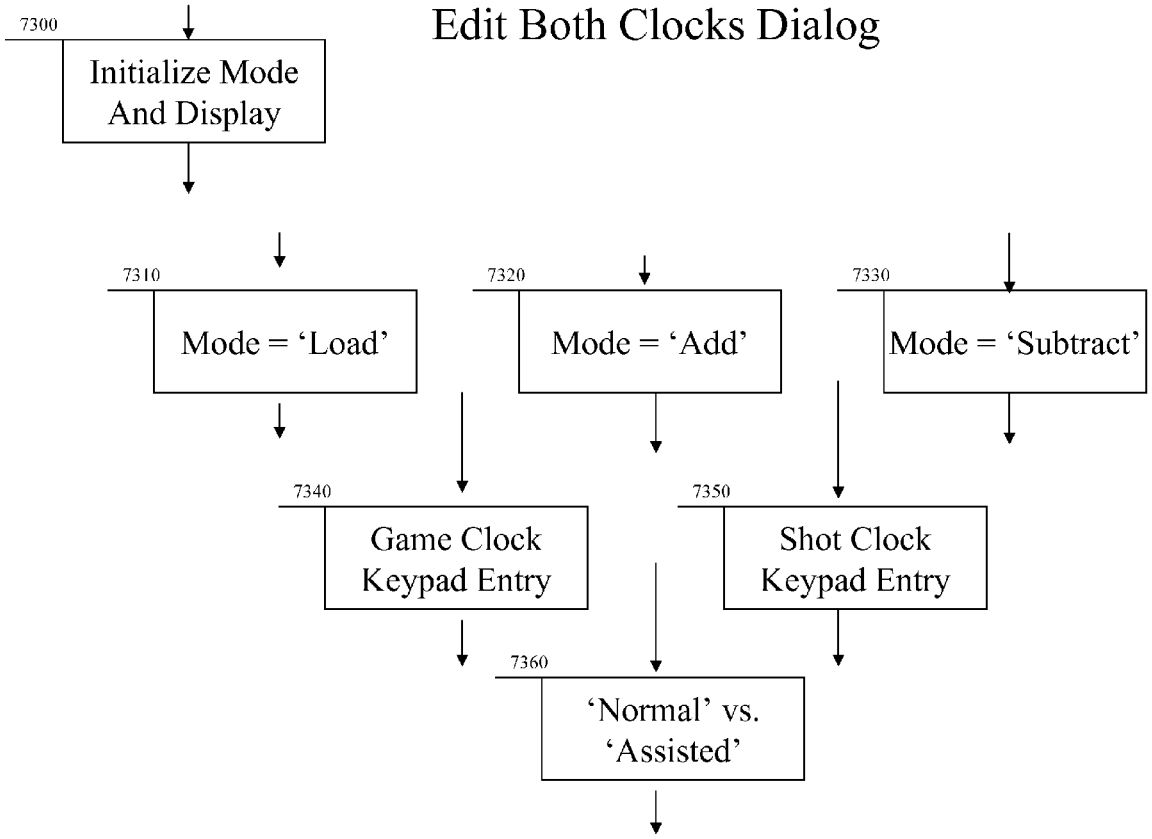

FIG. 73 illustrates the edit both clock process called in modules 4300 and 4400 in FIGS. 43 and 44, respectively. The list box display and modes are initialized in module 7300. Module 7310 sets the current clock entry mode to 'load clock'. This allows the user to explicitly load a new value for the shot and/or game clock(s). Module 7320 sets the current clock entry mode to 'add' time. This allows the user to add time to the current values of the shot and/or game clock(s). Module 7330 sets the current clock entry mode to 'subtract' time. This allows the user to subtract time from the current values of the shot and/or game clock(s). The default action is to keep the two clocks in sync when only one clock is adjusted. This can be overridden in module 7500 in FIG. 75. The current entry mode is signaled by the presence of a ' ' (blank) for load, '+' for add time mode, and '−' for subtract time. Modules 7340 and 7350 allow user keypad entry for Game and Shot Clocks, respectively. Module 7360 allows the user to toggle between 'normal' and 'assisted' entry modes. 'Normal' mode causes new digits of the clock to be shifted in from the right when entered on the keypad. 'Assisted' mode requires the user to specify the left-most significant digit. By doing so, the user is unable to press the OK button until the required number of digits is entered. In this mode, the tenths of a second are carried forward, allowing the user to easily change the clock in whole seconds.

Figure 74:
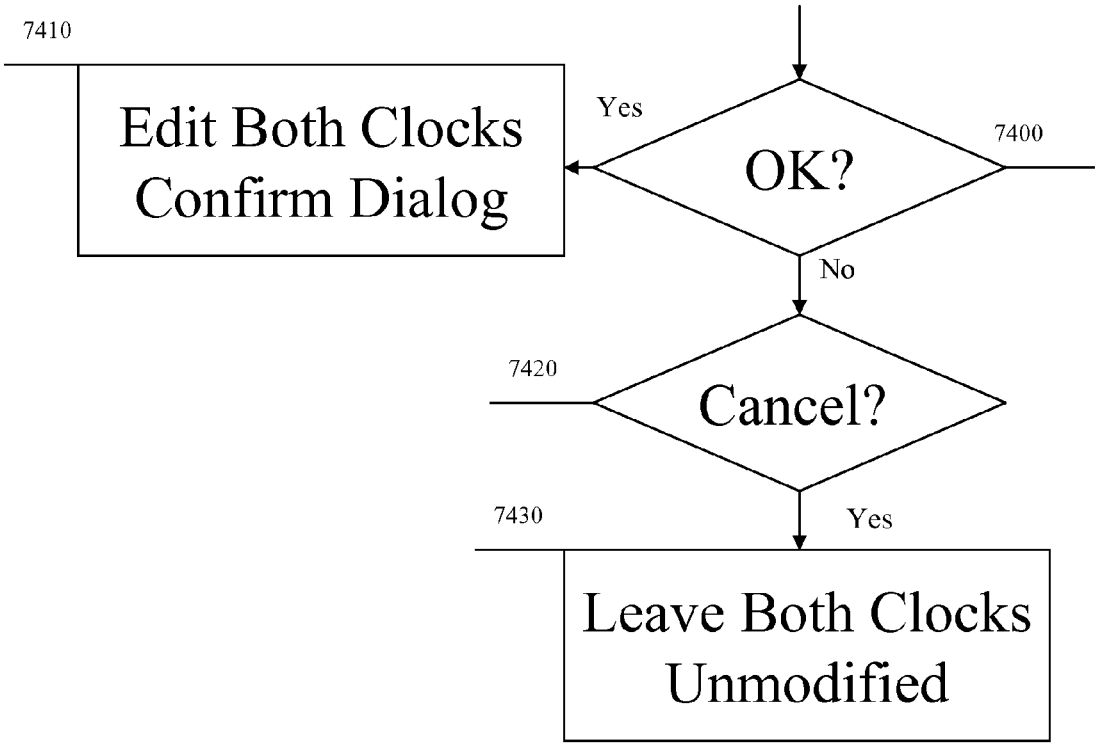

FIG. 74 continues the process started in FIG. 73. Module 7400 checks to see if the user has pressed the OK button. If so, module 7410 calls the edit both clocks confirm dialog box described in FIG. 75. Module 7420 checks to see if the user has pressed the cancel button. If so, module 7430 leaves the both the game and shot clock values unmodified and exits.

Figure 75:
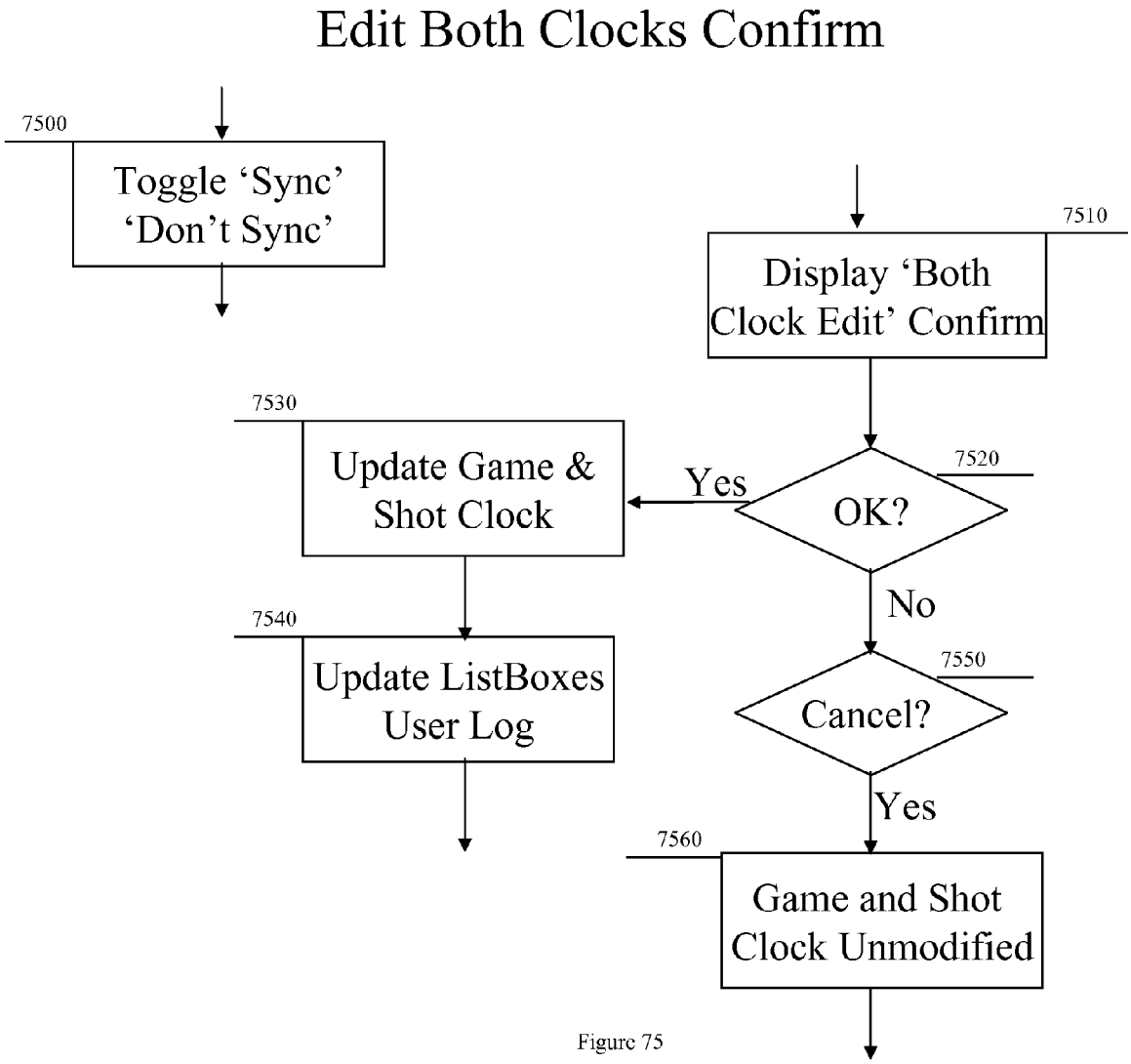

FIG. 75 illustrates the edit both clocks confirm dialog called in module 7410 in FIG. 74. Module 7500 allows the user to toggle on and off the synchronous nature of the update. Module 7510 displays the current values of both clocks, what modifications have been specified for each and the resulting new values of the both game and shot clock. Module 7520 checks to see if the user has pressed the OK button. If so, module 7530 updates the game and shot clocks with their new values, while module 7540 updates the possession, restart, and bad reset listboxes and user log. Module 7550 checks to see if the user has pressed the cancel button and if so, module 7560 leaves the values of the game and shot clock unmodified.

Figure 76:
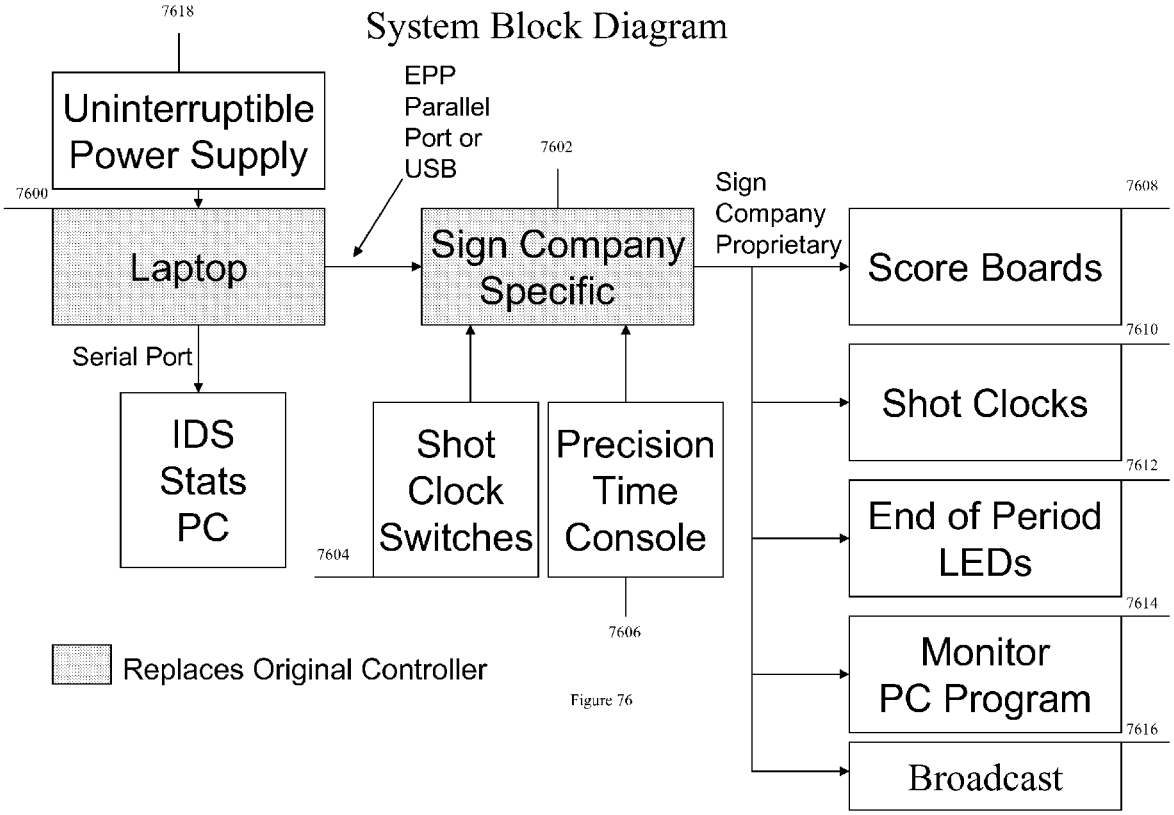

FIG. 76 illustrates a block diagram of the system of the preferred embodiment. The system is designed to be a replacement for current controllers, using the existing cables and scoreboards. The system in the preferred embodiment leverages off the hardware of a laptop computer 7600 and requires a custom hardware interface 7602 to mimic the manufacturer specific outputs. However, other types of computing devices other than a laptop computer can be used. A single circuit board within the interface 7602 supports all manufacturers' outputs types. The user interface consists of a Graphical User Interface based on the Microsoft Windows operating system (Windows 2000 or greater). The use of a computer monitor allows for instantaneous on-screen feedback for current state of the scoreboards. User input is in the form of any acceptable input to the operating system, including, but not limited to mouse and touch screen. The system accepts user inputs from remote timing boxes 7604, similar to the current devices, if not identical. The hardware interface 7602 accepts inputs from the Precision Time ™ controllers 7606. The interface between the computer 7600 and the custom hardware 7602 is by any means supported by the computer hardware and operating system, including but not limited to, serial port, parallel port, USB, Ethernet, PCI. The hardware interface 7602 also connects to sign company proprietary scoreboards 7608, shot clocks 7610, end of period LEDs 7612, a PC Monitor Program 7614 and a broadcast booth 7616. In this embodiment, the computer also has an uninterruptible power supply 7618 connected to it. In the case of a laptop, the computer can also run on it's battery, should AC power be interrupted.

Figure 77:
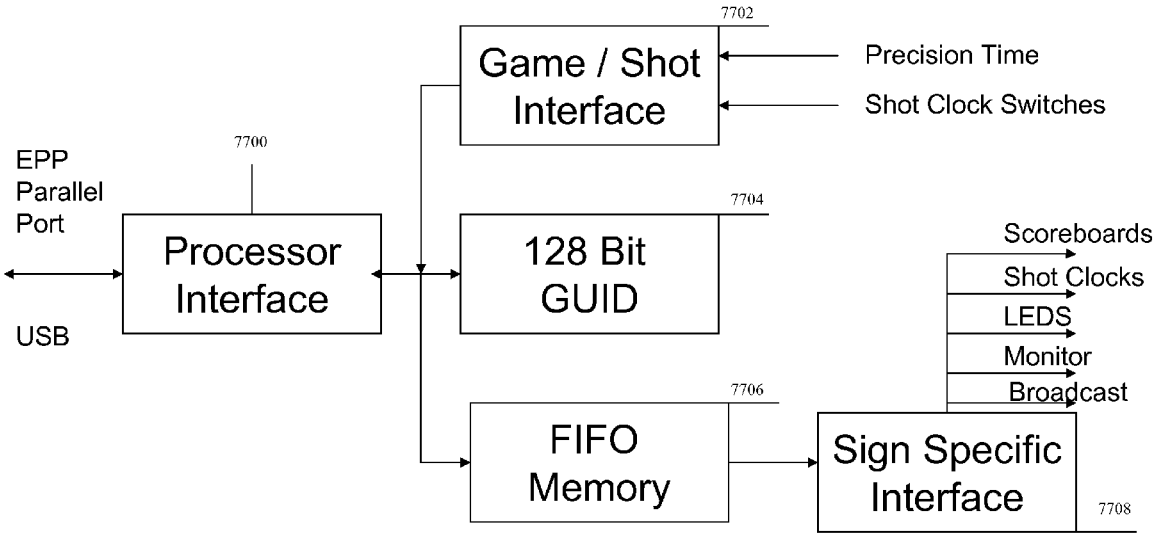

FIG. 77 illustrates more detail of interface 7602 described in FIG. 76. The hardware interface 7602 consists of a processor interface 7700, a Game/shot interface 7702, a 128 bit Globally Unique Identifier (GUID) 7704, a FIFO memory 7706 and sign specific interface unit 7708.

Custom hardware initially performs serialization of scoring data streams in the case of a software generated clock. However, all timing information can be generated in hardware and supplied to the scoreboards and user interface, greatly enhancing accuracy versus current controllers and allowing fail-safe operation if interface between the personal computer and the custom hardware should cease to function. Upon restoration of communications, the user interface software accepts the current state of the custom hardware. Additionally, the custom hardware shall have an on-board battery should it's AC power be interrupted. Under all circumstance, the current state of the game shall be stored on a non-volatile external storage medium, including but not limited to USB memory stick, floppy drive, zip drive. This allows immediate recovery from catastrophic failure by moving the current state of the game to a backup personal computer, custom hardware configuration.

Figure 78:
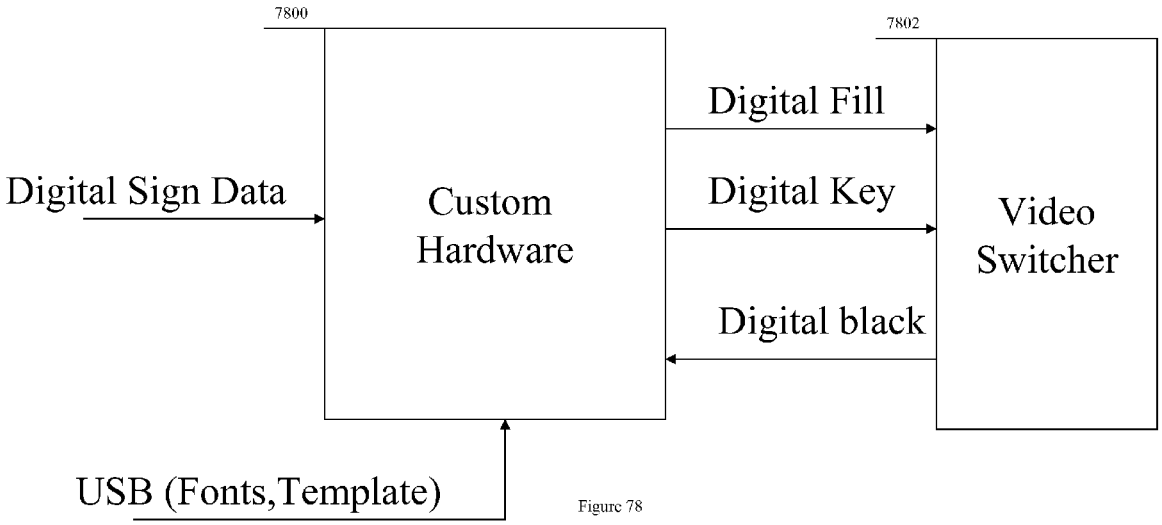

FIG. 78 illustrates more detail of the broadcast booth 7616 option referred to in FIG. 76. Digital sign data would be fed into a custom hardware controller 7800 along with text and template information from a computer via a USB connection. The custom hardware controller will provide serial digital video data to the digital switcher 7802 in the broadcast booth. The digital switcher provides a 'black' signal to the custom hardware to synchronize the entire system. The digital video data forms a linear key consisting of a black and white key signal along with a color fill signal that would include a template plus formatted data. The formatted data includes the real-time clocks, score and period, and others.

In summary, the present invention includes improved system and method for controlling multiple types of scoreboards for sporting activities. One version of the system is: processor controlled, has a custom hardware interface, a mechanical switch interface, multiple scoreboard interfaces, a custom software interface, a graphical user interface, and a method to input and manage scores, timeouts, fouls, period, and clocks.

The system is described as running on a laptop computer, but can also work on other computing devices such as a Sun workstation.

The custom hardware interface in this embodiment includes: a power input; a industry standard interface that includes a parallel port, serial port, USB, Ethernet, PCI; a mechanical switch interface for game on/off, shot on/off, horn, set 14, set 24, and set 5; and multiple scoreboard interfaces for Daktronics, Whiteway, AS&I, Fairplay and/or others.

The custom software interface includes: a graphical user interface; team logos, names and colors; the ability to edit at least one clock; makes multiple clocks sync on edit by default; option to edit multiple clocks independently; limits clocks to max and min values; updates user disk logs and real time listboxes; the ability to record electrical level signaling; the ability to detect errors in signaling; the ability to correct errors; the ability to archive to disk; the ability to measure and record the accuracy of clocks; the ability to recover previous clock states for common game situations; the ability to provide multiple types of timeouts; the ability to change timeout type during timeout; the ability to change timeout source during timeout; the ability to maintain current timeout totals of home, visitor, official; the ability to monitor mandatory timeouts; the ability to warn user of pending mandatory timeout; the ability to adjust based on rules for restore 20 second at halftime, no more than 3 timeouts at $4^{th}$ quarter start, no more than 2 in last 2 minutes of $4^{th}$ quarter and overtime; the ability to manage team fouls for first and second in the last 2 minutes, for skip $3^{rd}$ team foul in overtime, for bonus on $5^{th}$ Team Foul of Opposing Team; the ability to edit team fouls; team foul changes to user log and listboxes and an on-line rule book that's context sensitive.

The custom software interface can also include: the ability to establish a pre-game countdown; the ability to test clock during countdown; the ability to resume countdown after test; the ability to sound an automatic horn that can be a resident mechanical horn, or a wave horn digital file over the public address system, a line level wave horn digital file sent to broadcast; and the ability to light end of period LEDs.

The custom software interface can also include: the ability to monitor precision time Start/Stop, a real time log along with the ability to adjust clocks based on precision time data; the ability to edit the shot clock to $1/10^{th}$ of second; a true time shot clock; the ability to update scores in common increments; the ability to edit scores independently or simultaneously and using common decrements and increments; the ability to use 'drop and drag' to quickly correct score awarded to the wrong team.

The custom software interface can also perform: period increments; initializing timeouts, team fouls, bonus, last 2 minute indicators; period edit; capture and record clock start/stop; one touch return game/shot clock to last stop; capture and record reset start; one touch return game/shot clock on bad reset; capture and record reset release; and one touch set of game clock on violation.

The custom hardware interface can include: mechanical switch interfaces; existing game and shot clock controllers; precision time base station; supply multiple outputs; scoreboards and TV Broadcast; hardware clocks-deterministic and accurate to 40E-9 seconds; industry standard interface to a processor; multiple brands of scoreboard interfaces; and a battery backup on power failure.

In addition, the system can be adapted to other sporting events. For example, the system for a National Hockey League game, would include: choosing visiting team; set pre-game countdown to at a specific time; set current Period state; record scores, shots on goal, timeouts and penalties. The penalties include: a 2 minute minor; a 4 minute double minor; a 5 minute major; and a 10 minute misconduct. Moreover, depending on situation, if the penalty is on the clock, it's visible on scoreboard, effects number of players on ice, the player returns immediately when penalty expires and the player may return on opposition's goal scored. If the penalty is off the clock, its not displayed on scoreboard, does not effect number of players on ice, the player returns on first stoppage after penalty expires, but can not return on oppositions goal scored. A penalty wizard enters all penalties, determines on vs. off clock based on current situation, and determines if goal scoring affects penalties. All penalties 'freeze' during intermission periods (carry over) and a penalty timer reflects real-time difference between game clock and penalty end time.

Moreover, both logos are flashed for TV timeouts at 14:00, 10:00, 6:00 during 20 minute periods. There is not a TV timeout in overtime.

Clock Management includes the ability to edit the clock (load, add, subtract) and restart from previous whistle. Play may be restarted by choosing a previous stoppage from a listbox.

Additionally, the penalty timers are automatically adjusted when the game clock is adjusted, as it is the real-time result of the difference between the game clock and the end of the penalty.

A NHL hockey game consists of three 20:00 periods, separated by an intermission that is 15:00 to 17:00, based on broadcast requirements. If, after 3 full periods, the score is tied overtime period(s) are played. In the Regular season the overtime is a single 5:00 preceded by a 1:00 intermission. In the playoffs, ties are not allowed. In the playoffs, the game ends on the first goal. In the playoffs, there will be as many extra periods as are necessary to score the first goal. Each playoff overtime period will be 20:00 preceded by a 15:00 intermission.

It is understood that several modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A method for controlling at least one scoreboard using a processor, custom software and custom hardware at a timed sporting event, with multiple clocks, the method comprising:

initializing a first clock, wherein the first clock times the sporting event;

loading a second clock with whole seconds and wherein the first clock and second clock are synchronized; and displaying digits less than whole seconds.

2. The method of claim 1 further comprising:

displaying a single digit whole second in the leftmost digit of a two digit display under 10seconds, and displaying a single digit tenth of a second in the rightmost digit of a two digit display under 10 seconds.

3. The method of claim 2 further comprising:

displaying a special character left of the tenth of a second digit.

4. The method of claim 1 further comprising:

displaying digits for whole seconds and tenths of a second on a clock display of greater than 2 digits.

5. The method of claim 1 further comprising of the step of adjusting time to any clock to automatically adjust the other clock(s) to maintain timing relationship.

6. The method of claim 1 further comprising:

synchronizing a video signal with all scoreboard displays.

7. The method of claim 6 wherein a black signal is used for synchronization.

8. A controller for controlling at least one scoreboard at a timed sporting event, the controller comprising:

a processor;

custom software;

at least one user controlled switch box;

a custom hardware interface for interfacing with the processor, at least one user controlled switch box and the at least one scoreboard; and a game clock and a second clock that displays portions of a second less than one second, wherein the game clock and second clock are synchronized.

9. A system for providing a scoring controller for at least one scoreboard in a sporting activity, the system comprising:

a processor, wherein the processor: maintains synchronization of game and subordinate clocks; notifies the operator of mandatory timeouts; sets initial values of a beginning of a period; automatically records user actions; starts, stops and sets at least a game clock, scores, fouls, timeouts, period changes;

a graphical user interface wherein the graphical user interface allows a user to: input and edit game clock; input and edit shot clock; input and edit team fouls; input and edit timeouts; input and edit period;

a hardware interface, wherein the hardware interface includes: a scoreboard specific interface with a sign display control signal; at least one clock control box; an accurate timer; implemented as hardware counters; real time hardware delivery to arena displays; a synchronization signal with the video signal; and a timer that provides time signals to the processor.

10. The system of claim 9 wherein the system records clock operator inputs.

11. The system of claim 9 wherein the system records clock operator inputs and a time of day at which the inputs occurred.

12. The system of claim 9 wherein the system records clock operator inputs and the time on the game clock at which they occurred.

* * * * *